US009590339B2

(12) United States Patent
Oberski et al.

(10) Patent No.: US 9,590,339 B2
(45) Date of Patent: Mar. 7, 2017

(54) HIGH DATA RATE CONNECTORS AND CABLE ASSEMBLIES THAT ARE SUITABLE FOR HARSH ENVIRONMENTS AND RELATED METHODS AND SYSTEMS

(71) Applicant: CommScope, Inc. of North Carolina, Hickory, NC (US)

(72) Inventors: Jeffrey A. Oberski, Lucas, TX (US); Amid I. Hashim, Plano, TX (US); Scott M. Keith, Plano, TX (US); Steven W. Knoernschild, Allen, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 84 days.

(21) Appl. No.: 14/265,447

(22) Filed: Apr. 30, 2014

(65) Prior Publication Data

US 2014/0335732 A1 Nov. 13, 2014

Related U.S. Application Data

(60) Provisional application No. 61/821,345, filed on May 9, 2013, provisional application No. 61/824,174, filed
(Continued)

(51) Int. Cl.
*H01R 4/50* (2006.01)
*H01R 13/02* (2006.01)
(Continued)

(52) U.S. Cl.
CPC ..... *H01R 13/02* (2013.01); *H01R 13/6467* (2013.01); *H01R 31/06* (2013.01); *H01R 2201/26* (2013.01)

(58) Field of Classification Search
CPC ..... H01R 23/025; H01R 23/005
(Continued)

(56) References Cited

U.S. PATENT DOCUMENTS 3,737,833 A * 6/1973 Jerominek ..... H01R 12/592 439/493
4,072,390 A 2/1978 Fox
(Continued)

FOREIGN PATENT DOCUMENTS

EP 1 783 871 A1 5/2007

OTHER PUBLICATIONS

Notification of Transmittal of the International Preliminary Report on Patentability, PCT/US2014/036544, Aug. 3, 2015.
(Continued)

*Primary Examiner* — Thanh Tam Le
(74) *Attorney, Agent, or Firm* — Myers Bigel, P.A.

(57) ABSTRACT

An inline communications connector is provided that includes a housing and tip and ring contacts that are mounted in the housing. The tip contact includes an input tip socket, an output tip socket and a tip socket connection section that physically and electrically connects the input and output tip sockets. The ring contact includes an input ring socket, an output ring socket and a ring socket connection section that physically and electrically connects the input and output ring sockets. The input tip socket is not collinear with the output tip socket and the input ring socket is not collinear with the output ring socket.

21 Claims, 54 Drawing Sheets

Related U.S. Application Data on May 16, 2013, provisional application No. 61/824,698, filed on May 17, 2013, provisional application No. 61/832,278, filed on Jun. 7, 2013.

(51) Int. Cl.
*H01R 13/6467* (2011.01)
*H01R 31/06* (2006.01)

(58) Field of Classification Search
USPC ..... 439/344, 676, 941
See application file for complete search history.

(56) References Cited

U.S. PATENT DOCUMENTS 4,917,625 A * 4/1990 Haile ..... H01R 13/6392 439/271
5,282,754 A * 2/1994 Kish ..... H01R 31/00 439/108
5,362,257 A * 11/1994 Neal ..... H01R 13/6467 439/676
5,586,914 A * 12/1996 Foster, Jr. ..... H01R 13/6467 29/827
5,647,770 A * 7/1997 Belopolsky ..... H01R 13/6467 439/676
5,915,989 A 6/1999 Adriaenssens et al.
6,050,843 A 4/2000 Adriaenssens et al.
6,186,834 B1 * 2/2001 Arnett ..... H01R 13/6464 439/676
6,186,836 B1 * 2/2001 Ezawa ..... H01R 13/6467 439/676
6,309,240 B1 10/2001 Daoud
7,166,000 B2 * 1/2007 Pharney ..... H01R 13/6658 439/676
7,223,115 B2 5/2007 Hashim et al.
7,322,847 B2 1/2008 Hashim et al.
7,341,493 B2 * 3/2008 Pepe ..... H01R 13/506 439/676
7,503,798 B2 3/2009 Hashim
7,559,789 B2 7/2009 Hashim
7,614,901 B1 11/2009 Siev et al.
7,927,152 B2 * 4/2011 Pepe ..... H01R 24/64 439/676
7,999,184 B2 8/2011 Wiebelhaus et al.
2012/0129395 A1 5/2012 Davis et al.

OTHER PUBLICATIONS

International Search Report and Written Opinion Corresponding to International Application No. PCT/US2014/036544; Date of Mailing: Aug. 18, 2014; 12 Pages.

* cited by examiner

HIGH DATA RATE CONNECTORS AND CABLE ASSEMBLIES THAT ARE SUITABLE FOR HARSH ENVIRONMENTS AND RELATED METHODS AND SYSTEMS

CROSS-REFERENCE TO RELATED APPLICATIONS

The present application claims priority under 35 U.S.C. §119 to U.S. Provisional Patent Application Ser. No. 61/821,345, filed May 9, 2013, to U.S. Provisional Patent Application Ser. No. 61/824,174 filed May 16, 2013, to U.S. Provisional Patent Application Ser. No. 61/824,698, filed May 17, 2013, and to U.S. Provisional Patent Application Ser. No. 61/832,278, filed Jun. 7, 2013. The entire content of each of the above applications is incorporated herein by reference as if set forth in its entirety herein.

FIELD OF THE INVENTION

The present invention relates generally to communications systems and, more particularly, to communications connectors and cable assemblies that include one or more communications channels that may be suitable for use in harsh environments.

BACKGROUND

The use of electronic devices that transmit and/or receive large amounts of data over a communications network such as cameras, televisions and computers continues to proliferate. Data may be transferred to and from these devices by hardwired or wireless connections, or a combination thereof. Devices that are connected to a communications network via a hardwired connection often use so-called Ethernet cables and connectors as these cables and connectors can support high data rate communications with a high level of reliability. Various industry standards such as, for example, the ANSI/TIA-568-C.2 standard, approved Aug. 11, 2009 by the Telecommunications Industry Association (referred to herein as "the Category 6a standard"), set forth interface and performance specifications for Ethernet cables, connectors and channels. Ethernet connectors and cables are routinely used in office buildings, homes, schools, data centers and the like to implement hardwired, high-speed communications networks.

While hardwired Ethernet connections can provide excellent performance, the industry-standardized Ethernet plug and jack designs may not be well-suited to harsher environments that are subject to mechanical shocks, vibrations, extreme temperature changes and the like. In these more physically challenging environments, non-Ethernet connectors are generally used that may maintain good mechanical and electrical connections.

One relatively harsh environment where hardwired communications networks may be used is in automobiles and other types of vehicles, including planes, boats, etc. Communications connectors and cables that are used in automobiles are routinely subjected to high levels of vibration, wide temperature swings, and mechanical shocks, stresses and strains. Typically, single-ended communications channels and non-Ethernet connectors and cabling are used in such environments, and the cables and connectors may be rather large and heavy. For example, pin connectors and socket connectors are sometimes used in automotive applications to detachably connect two communications cables and/or to detachably connect a communications cable to a printed circuit board or electronic device, as pin and socket connections can typically maintain good mechanical and electrical connections even when used for long periods of time in harsh environments.

FIG. 1 is a perspective view of a conventional pin connector 10. As shown in FIG. 1, the pin connector 10 includes a housing 20 that has a plug aperture 22. The plug aperture 22 may be sized and configured to receive a mating socket connector. The pin connector 10 further includes a conductive pin array 24 that in the depicted embodiment includes eighteen conductive pins 30 that are mounted in the housing 20. Each conductive pin 30 has a first end 32 that extends into the plug aperture 22 and a second end 36 that extends downwardly from a bottom surface of the housing 20. The first end 32 of each conductive pin 30 may be received within a respective socket of a mating socket connector that is inserted into the plug aperture 22, and the second end 36 of each conductive pin 30 may be inserted into, for example, a printed circuit board (not shown).

FIG. 2 is a perspective view of eight of the conductive pins (namely conductive pins 30-1 through 30-8) that are included in the conductive pin array 24 of pin connector 10 of FIG. 1. Herein, when a device such as a connector includes multiple of the same components, these components are referred to individually by their full reference numerals (e.g., conductive pin 30-4) and are referred to collectively by the first part of their reference numeral (e.g., the conductive pins 30). Only eight of the eighteen conductive pins 30 that are included in pin connector 10 of FIG. 1 are illustrated in FIG. 2 in order to simplify the drawing and the explanation thereof.

As shown in FIG. 2, a middle portion 34 of each conductive pin 30 that connects the first end 32 to the second end 36 includes a right angled section 38. The first ends 32 of the conductive pins 30 extend along the x-direction (see the reference axes in FIG. 2) and are aligned in two rows. The second ends 36 of the conductive pins 30 extend along the z-direction and are also aligned in two rows. It will be appreciated that the remaining ten conductive pins 30 of pin connector 10 that are not pictured in FIG. 2 are aligned in the same two rows and that the conductive pins 30 in each row all have the exact same design and spacing from adjacent conductive pins 30.

FIGS. 3 and 4 are perspective views of a partially disassembled socket connector 50 that may be used in conjunction with the pin connector 10 of FIG. 1. As shown in FIGS. 3 and 4, the socket connector 50 includes a housing 60 that includes a plurality of pin apertures 62. The housing 60 defines an open interior 64 that receives a socket contact holder 70. The housing 60 includes a side opening 66 that provides an access opening for inserting the socket contact holder 70 within the open interior 64. The side opening 66 also provides an access opening for the conductors of a communications cable (not shown) to be routed into the open interior 64 for termination within the socket contact holder 70. A locking member 68 is mounted on an exterior surface of the housing 60. The socket connector 50 may be received within the plug aperture 22 of the pin connector 10 so that each of the conductive pins 30 of the pin connector is received within a respective socket of the socket contact holder 70. The locking member 68 may be used to lock the socket connector 50 within the plug aperture 22 of the pin connector 10.

FIG. 5 is a perspective view of the socket contact holder 70. FIG. 6 is a perspective view of a socket contact 80. As shown in FIG. 5, the socket contact holder 70 includes a plurality of sockets 76 that extend from a front face 74 to the rear face 72 of the socket contact holder 70. A plurality of socket contacts 80 may be populated into the sockets 76 in the socket contact holder 70. Each socket contact 80 includes a front end 82 and a rear end 84. The front end 82 has an opening (not visible in FIG. 6) that provides access to a longitudinal cavity. The front end 82 is configured to receive and grasp a conductive pin of a mating pin connector (e.g., one of the conductive pins 30 of pin connector 10). The front end 82 may include a spring mechanism (not visible in FIG. 6) that biases a conductive component of the socket contact 80 against the conductive pin 30 of the mating pin connector 10 that is received therein in order to maintain a good mechanical and electrical contact between the conductive pin 30 and the socket contact 80. The rear end 84 of the socket contact 80 may be configured to receive a conductor of a communications cable (not shown). In the depicted embodiment, the rear end 84 of each socket 80 includes tabs that may be crimped around a respective conductor of the cable. Thus, each socket contact 80 may be used to electrically connect a conductive pin of a pin connector to a conductor of a communications cable.

SUMMARY

Pursuant to embodiments of the present invention, inline communications connectors are provided that include a housing and tip and ring contacts that are mounted in the housing. The tip contact has a tip input contact structure, a tip output contact structure and a tip connection section that physically and electrically connects the tip input and output contact structures. The ring contact has a ring input contact structure, a ring output contact structure and a ring connection section that physically and electrically connects the ring input and output contact structures. The tip contact and the ring contact are configured as a pair of contacts for carrying a single information signal, and the tip input contact structure is not collinear with the tip output contact structure and the ring input contact structure is not collinear with the ring output contact structure. The tip input and output contact structures and the ring input and output contact structures are each implemented as one of a pin or a socket.

Pursuant to embodiments of the present invention, communications systems are provided that include a connectorized cable that has a communications cable that has an insulated tip conductor and an insulated ring conductor that are twisted together to form a first twisted pair of insulated conductors and a first connector that is on an end of the communications cable. The first connector has a first housing, a first tip contact that is in the first housing and is electrically connected to the conductive core of the insulated tip conductor, and a first ring contact that is mounted in the first housing and electrically connected to the conductive core of the insulated ring conductor. A first end of the first tip contact is longitudinally aligned with an end portion of the insulated tip conductor and a first end of the first ring contact is longitudinally aligned with an end portion of the insulated ring conductor. The communications systems further includes a second connector that is mated with the first connector. The second connector has a second housing, a second tip contact that is mounted in the second housing to mate with the first tip contact and a second ring contact that is mounted in the second housing to mate with the first ring contact. The second tip and ring contacts are positioned so that the second tip contact crosses over the second ring contact.

Pursuant to further embodiments of the present invention, communications systems are provided that include a first tip contact that has a first tip input contact structure, a first tip output socket and a first tip crossover section that physically and electrically connects the first tip input contact structure and the first tip output socket, and a first ring contact that has a first ring input contact structure, a first ring output socket and a first ring crossover section that physically and electrically connects the first ring input contact structure and the first ring output socket. The first tip contact and the first ring contact are configured as a first pair of contacts that together serve as a transmission path for a first information signal. The communications system also has a second tip contact that has a second tip input contact structure, a second tip output socket and a second tip crossover section that physically and electrically connects the second tip input contact structure and the second tip output socket, and a second ring contact that has a second ring input contact structure, a second ring output socket and a second ring crossover section that physically and electrically connects the second ring input contact structure and the second ring output socket. The second tip contact and the second ring contact are configured as a second pair of contacts that together serve as a transmission path for a second information signal, and the second pair of contacts are mounted adjacent the first pair of contacts to define a first row of contact pairs. The sum of the coupling between the first tip contact and the second tip contact and the coupling between the first ring contact and the second ring contact is substantially equal in magnitude to the sum of the coupling between the first tip contact and the second ring contact and the coupling between the second tip contact and the first ring contact when the first information signal is transmitted through the first pair of contacts.

Pursuant to still further embodiments of the present invention, inline connectors are provided that include a tip contact that has a tip input socket that defines a first pin-receiving cavity that has a first longitudinal axis, a tip output socket that defines a second pin-receiving cavity that has a second longitudinal axis and a tip crossover segment that includes a curved first end that connects to the tip input socket and a curved second end that connects to the tip output socket. These connectors further include a ring contact that has a ring input socket that defines a third pin-receiving cavity that has a third longitudinal axis, a ring output socket that defines a fourth pin-receiving cavity that has a fourth longitudinal axis and a ring crossover segment that includes a curved first end that connects to the ring input socket and a curved second end that connects to the ring output socket. The second longitudinal axis is offset from the first longitudinal axis and the third longitudinal axis is offset from the fourth longitudinal axis.

Pursuant to further embodiments of the present invention, communications systems are provided that include a first printed circuit board that has a first input contact, a second input contact, a first output contact and a second output contact, a first conductive path that electrically connects the first input contact to the first output contact and a second conductive path that electrically connects the second input contact to the second output contact. The first conductive path crosses over the second conductive path, and the first input contact, the first conductive path and the first output contact form a first tip transmission path, while the second input contact, the second conductive path and the second output contact form a first ring transmission path. The first tip transmission path and the first ring transmission path together form a first transmission line. A second printed circuit board is provided adjacent the first printed circuit board, the second printed circuit board having a third input contact, a fourth input contact, a third output contact and a fourth output contact, a third conductive path that electrically connects the third input contact to the third output contact and a fourth conductive path that electrically connects the fourth input contact to the fourth output contact. The third input contact, the third conductive path and the third output contact form a second tip transmission path, while the fourth input contact, the fourth conductive path and the fourth output contact form a second ring transmission path. The second tip transmission path and the second ring transmission path together form a second transmission line. The first input contact is not collinear with the first output contact, and the second input contact is not collinear with the second output contact.

Pursuant to yet additional embodiments of the present invention, connectorized cables are provided that include a cable that has an insulated tip and ring conductors that are twisted together to form a twisted pair of conductors and a cable jacket that surrounds the twisted pair of conductors. A cable connector is on an end of the cable. The cable connector includes a housing that has a longitudinal axis, a transverse axis and a vertical axis, the housing having an aperture for receiving a substrate of a mating connector along the longitudinal axis of the housing. A tip cable connector contact is electrically connected to the tip conductor that is mounted in an upper portion of the housing, and a ring cable connector contact that is electrically connected to the ring conductor is mounted in a lower portion of the housing. The tip cable connector contact is offset both transversely and vertically from the ring cable connector contact.

Pursuant to yet additional embodiments of the present invention, communications systems are provided that include a first printed circuit board that has a first contact pad, a second contact pad, a first pin contact and a second pin contact. A first conductive path electrically connects the first contact pad to the first pin contact and a second conductive path electrically connects the second contact pad to the second pin contact. The first conductive path crosses over the second conductive path. The first contact pad, the first conductive path and the first pin contact form a first tip transmission path and the second contact pad, the second conductive path and the second pin contact form a first ring transmission path, where the first tip transmission path and the first ring transmission path together comprising a first transmission line. The first contact pad is not collinear with the first pin contact.

Pursuant to further embodiments of the present invention, communications systems are provided that include a plurality of printed circuit boards aligned in a row, where each printed circuit board has a top surface, a bottom surface, a front end, a rear end and opposed side surfaces, and each printed circuit board includes a first contact on the top surface adjacent the front end, a second contact on the bottom surface adjacent the front end, a third contact on the bottom surface adjacent the rear end and a fourth contact on the top surface adjacent the rear end. The printed circuit boards are positioned in parallel planes and the top surface of at least one of the printed circuit boards faces the bottom surface of an adjacent one of the printed circuit boards.

Pursuant to other embodiments of the present invention, connector systems are provided that include a first connector that has a first tip contact and a first ring contact that are vertically aligned and that are configured as a first pair of contacts and a second connector that has a second tip contact and a second ring contact that are vertically aligned and that are configured as a second pair of contacts. The first and second connectors are positioned adjacent each other to define a horizontal row of connectors. A first crosstalk compensation circuit is disposed between the first tip contact and the second ring contact.

Pursuant to additional embodiments of the present invention, inline connectors are provided that include a first tip contact that has a first tip input socket and a first tip output socket, a second tip contact that has a second tip input socket and a second tip output socket, a first ring contact that has a first ring input socket and a first ring output socket, and a second ring contact that has a second ring input socket and a second ring output socket. These inline connectors further include a crosstalk compensation circuit that has a first capacitor that has a first electrode that is configured to inject first compensating crosstalk between the first tip contact and the second tip contact. The first tip contact and the first ring contact are vertically aligned, and the second tip contact and the second ring contact are vertically aligned.

Pursuant to still other embodiments of the present invention, inline connectors are provided that include a first tip contact that has a first tip input contact structure and a first tip output contact structure, a second tip contact that includes a second tip input contact structure and a second tip output contact structure, a first ring contact that includes a first ring input contact structure and a first ring output contact structure, and a second ring contact that includes a second ring input contact structure and a second ring output contact structure. The first tip input contact structure and the first ring input contact structure are vertically aligned. The first tip output contact structure and the first ring output contact structure are vertically aligned. The second tip input contact structure and the second ring input contact structure are vertically aligned. The second tip output contact structure and the second ring output contact structure are vertically aligned. The first tip input contact structure and the first tip output contact structure are longitudinally aligned. The first ring input contact structure and the first ring output contact structure are longitudinally aligned. The second tip input contact structure and the second ring output contact structure are longitudinally aligned. The second ring input contact structure and the second tip output contact structure are longitudinally aligned.

Pursuant to still other embodiments of the present invention, double-sided socket contact for an inline connector are provided that include a rolled section of sheet metal that forms a pair of longitudinally aligned and electrically connected sockets, an arm extending from a connection between the pair of sockets, and a capacitor plate attached to the arm.

Pursuant to additional embodiments of the present invention, communications channels are provided that include a first cable assembly that has a first connector mounted thereon, the first cable assembly including a first pair of conductors that are electrically connected to a first pair of contacts that are mounted in the first connector. These channels also include a second cable assembly that has a second connector mounted thereon, the second cable assembly including a second pair of conductors that are electrically connected to a second pair of contacts that are mounted in the second connector. The channels further include an inline connector that is mated with the first connector and the second connector, the inline connector including a first pair of inline contacts that are configured to carry a single communication signal. The first pair of contacts cross over each other when viewed from a first direction and the first pair of inline contacts cross over each other when viewed from a second direction that is substantially normal to the first direction.

Pursuant to still other embodiments of the present invention, connector systems are provided that include a plug that has a first pair of plug contacts and a jack that has a first pair of jack contacts that are mated with the first pair of plug contacts. The first pair of plug contacts cross over each other once when viewed from a first direction and the first pair of jack contacts cross over each other when viewed from a second direction that is different than the first direction.

Pursuant to other embodiments of the present invention, communications connectors are provided that include a first contact that has a first end portion, a second end portion and a crossover portion that connects the first end portion to the second end portion and a second contact that has a first end portion, a second end portion and a crossover portion that connects the first end portion to the second end portion. The first contact and the second contact form a first pair of contacts that together form a communications path for a first communications signal. The first contact crosses over the second contact. The first end portion of the first contact and the first end portion of the second contact are substantially collinear.

Pursuant to further embodiments of the present invention, communications connectors are provided that have a first contact and a second contact that form a first pair of contacts that together form a communications path for a first communications signal, wherein the first contact and the second contact are generally aligned in a first vertical plane and a third contact and a fourth contact that form a second pair of contacts that together form a communications path for a second communications signal, wherein the third contact and the fourth contact are generally aligned in a second vertical plane that is parallel to the first vertical plane. The first and second pairs of contacts are mounted in a housing in a horizontal row that extends in a horizontal direction that is substantially normal to each of the first and second vertical planes.

Pursuant to still further embodiments of the present invention, cable assemblies are provided that include a communications cable that has a first end and a second end, the communications cable including a plurality of insulated conductors. A communications connector is mounted on the first end of the communications cable. This communications connector includes a housing, a first contact that includes a first end that is in electrical contact with a first of the insulated conductors and a second end that is configured to mate with a first contact of a mating connector and a second contact that includes a first end that is in electrical contact with a second of the insulated conductors and a second end that is configured to mate with a second contact of the mating connector, the first and second contacts forming a first pair of contacts that together form a communications path for a first communications signal. The second end of the first contact comprises a first type of contacting structure and the second end of the second contact comprises a second type of contacting structure that is different from the first type of contacting structure.

Pursuant to additional embodiments of the present invention, communications channel segments are provided that include a first cable assembly that has a first connector that has a first pair of contacts, a second cable assembly that has a second connector that has a second pair of contacts, and an inline connector that has a first end and a second end, the inline connector including a pair of inline contacts. The first pair of contacts mechanically and electrically contact first ends of the respective pair of inline contacts when the first connector is mated with the first end of the inline connector, the second pair of contacts mechanically and electrically contact second ends of the respective pair of inline contacts when the second connector is mated with the second end of the inline connector so that the first pair of contacts, the pair of inline contacts and the second pair of contacts form a pair of conductors through the first connector, the inline connector and the second connector that includes at least two locations where the conductors of the pair of conductors cross over each other, the two conductors of the pair of conductors together forming a communications path for a first communications signal.

Pursuant to still other embodiments of the present invention, communications connectors are provided that include a housing, a first contact that is mounted in the housing, and a second contact that is mounted in the housing, the first and second contacts forming a first pair of contacts. The first and second contacts cross over each at least twice.

Pursuant to further embodiments of the present invention, communications channels are provided that include a first cable assembly that has a first connector mounted on a first end thereof and a second connector mounted on a second end thereof, the first cable assembly including a first pair of conductors that are electrically connected to a first pair of contacts that are mounted in the first connector and to a second pair of contacts that are mounted in the second connector and a second pair of conductors that are electrically connected to a third pair of contacts that are mounted in the first connector and to a fourth pair of contacts that are mounted in the second connector. These channels further include a second cable assembly that has a third connector mounted on a first end thereof and a fourth connector mounted on a second end thereof, the second cable assembly including a third pair of conductors that are electrically connected to a fifth pair of contacts that are mounted in the third connector and to a sixth pair of contacts that are mounted in the fourth connector and a fourth pair of conductors that are electrically connected to a seventh pair of contacts that are mounted in the third connector and to an eighth pair of contacts that are mounted in the fourth connector. The channel also has a fifth connector that includes a ninth pair of contacts and a tenth pair of contacts that are each mounted to extend from a first printed circuit board, wherein the ninth pair of contacts cross over each other when viewed from a first direction that is normal to a top surface of the first printed circuit board and the tenth pair of contacts cross over each other when viewed from the first direction, the fifth connector being configured to mate with the first connector. The channel also includes an inline connector that is configured to mate with the second connector and with the third connector, the inline connector including an eleventh pair of contacts and a twelfth pair of contacts. Finally, the channel includes a sixth connector that includes a thirteenth pair of contacts and a fourteenth pair of contacts that are each mounted to extend from a second printed circuit board, wherein the thirteenth pair of contacts cross over each other when viewed from a second direction that is normal to a top surface of the second circuit board and the fourteenth pair of contacts cross over each other when viewed from the second direction, the sixth connector being configured to mate with the fourth connector.

DETAILED DESCRIPTION

Figure 1:
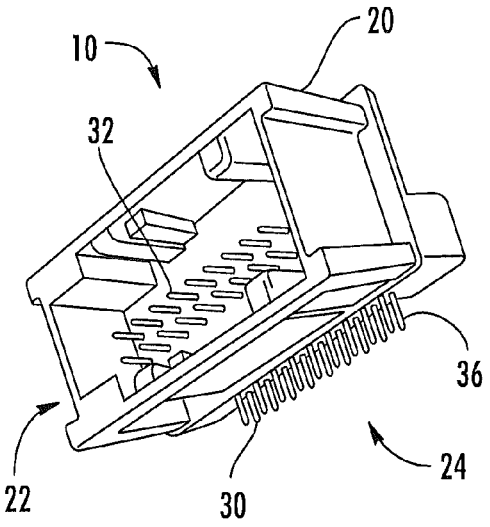
FIG. 1 (PRIOR ART)
FIG. 1 is a perspective view of a conventional pin connector.

Conventional connectors that are used in harsh environments (e.g., automotive applications) such as pin and socket connectors may not support particularly high data rates. Typically, these connectors use single-ended transmission techniques, and hence may exhibit relatively poor performance due to signal degradation from external noise sources. Additionally, conventional pin and socket connectors may also be particularly susceptible to another type of noise known as "crosstalk." "Crosstalk" refers to unwanted signal energy that is induced by capacitive and/or inductive coupling onto the conductors of a first "victim" communications channel from a signal that is transmitted over a second "disturbing" communications channel that is in close proximity to the victim communications channel. When a communications connector includes multiple communications channels (such as Ethernet connectors, which typically include four separate transmission lines or "channels") or when two communications connectors are in close proximity, crosstalk may arise between the closely located communications channels. This crosstalk may limit the data rates that may be supported on each communications channel. The induced crosstalk may include both near-end crosstalk ("NEXT"), which is the crosstalk measured at an input location corresponding to a source at the same location (i.e., crosstalk whose induced voltage signal travels in an opposite direction to that of an originating, disturbing signal in a different channel), and far-end crosstalk ("FEXT"), which is the crosstalk measured at the output location corresponding to a source at the input location (i.e., crosstalk whose signal travels in the same direction as the disturbing signal in the different channel). Both types of crosstalk comprise undesirable noise signals that interfere with the information signal on the victim communications channel.

Using differential signaling techniques instead of single-ended signaling techniques can reduce susceptibility to noise from external sources. Differential signaling refers to a communications scheme in which an information signal is transmitted over a pair of conductors rather than over a single conductor. The signals transmitted on each conductor of the pair may have equal magnitudes, but opposite phases, and the information signal is embedded as the voltage difference between the signals carried on the two conductors of the pair. When a signal is transmitted over a conductor, electrical noise from external sources may be picked up by the conductor, degrading the quality of that signal. When the victim communications channel is a pair of conductors, each conductor in the pair often picks up approximately the same amount of noise from these external sources. Because approximately an equal amount of noise is added to the signals carried by both conductors of the pair, the information signal is typically not disturbed, as the information signal is extracted by taking the difference of the signals carried on the two conductors of the pair; thus, the noise signal is cancelled out by the subtraction process. Consequently, the use of differential signaling techniques can significantly reduce the impact of external noise since such noise is picked up by both conductors of the pair and thus cancelled by the subtraction process used to recover the information signal that is transmitted over the pair.

Crosstalk signals may be coupled from a disturbing pair of conductors to a victim pair of conductors as either differential signals or as common mode signals. A differentially coupled signal couples different amounts of signal energy onto the two conductors of the victim pair. This type of crosstalk coupling degrades the information signal carried on the victim pair as the difference in signal energy does not subtract out when the information signal carried on the victim pair is extracted by taking the difference of the voltages carried by the conductors on the victim pair. In contrast to differential crosstalk, common mode crosstalk refers to a crosstalk signal which couples equal amounts of signal energy onto the two conductors of the victim pair. Notably, a common mode crosstalk signal generally does not interfere with the information signal that is carried by the victim pair, as the disturbing common mode signal is cancelled by the subtraction process used to recover the information signal on the victim pair. The injection of a common mode crosstalk signal onto a victim pair may be considered a form of "mode conversion" since the portion the differential signal that is coupled onto the victim pair is converted to a common mode signal.

Mode conversion may be problematic in communications systems that include closely spaced connectors or communications cables that are bundled together. In particular, if the communications channels in a network use tightly twisted pairs and carry only differential signals, then the amount of crosstalk that each disturbing communications channel injects onto other victim communications channel may be quite small as the disturbing signals mostly cancel themselves out due to their differential nature coupled with crosstalk reduction techniques such as tightly twisted conductors that ensure that the disturbing signals are, for the most part, self cancelling. However, if common mode signals are also present on various of the communications channels (due to the above-described mode conversion), then significantly greater amounts of crosstalk may be coupled from disturbing communications channels onto victim communications channels as the common mode disturbing signals are not generally self-cancelling like the differential signals are. Thus, mode conversion can significantly impact the performance of communications networks if the cabling and/or connectors are closely spaced together.

Figure 7:
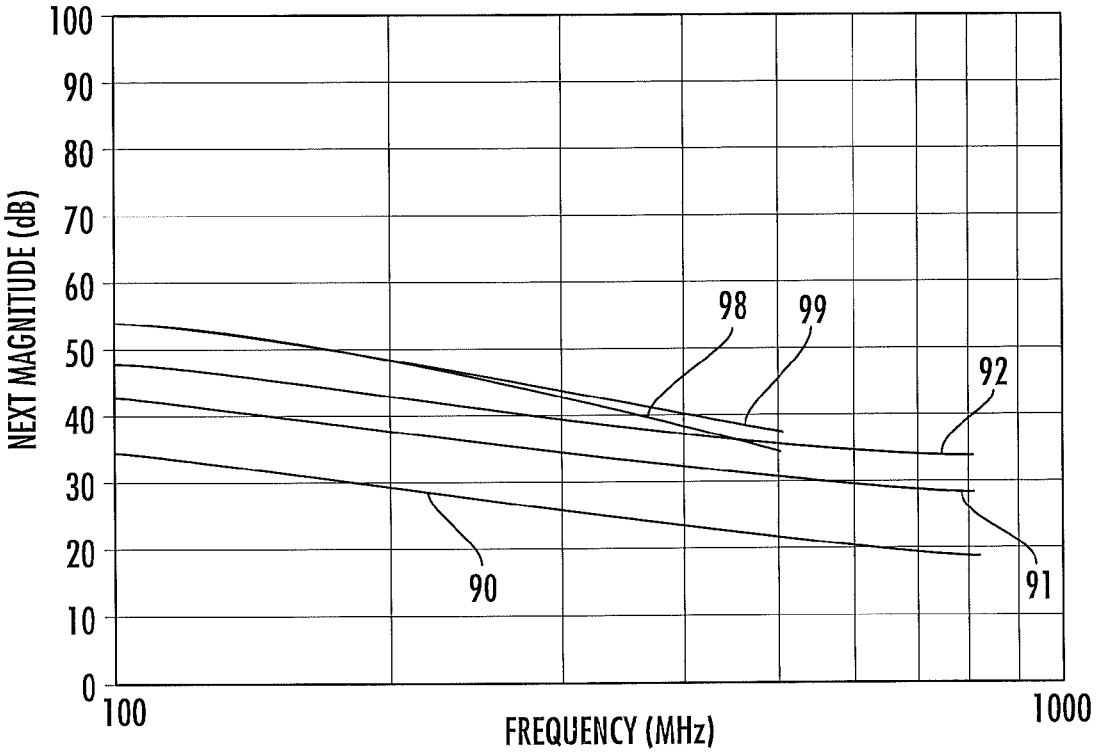
FIG. 7 (PRIOR ART)
FIG. 7 is a graph illustrating the simulated near-end crosstalk of the pin connector of FIGS. 1-2 in the forward direction.

Even if the conventional pin and socket connectors discussed above are used to transmit differential signals, they may still exhibit relatively poor performance. For example, FIG. 7 is a graph illustrating the simulated near-end crosstalk in the "forward" direction of the pin connector of FIGS. 1-2 for the eight conductive pins 30-1 through 30-8 illustrated in FIG. 2). For purposes of this simulation, pins 30-1 and 30-2 were used as a first pair 41, pins 30-3 and 30-4 were used as a second pair 42, pins 30-5 and 30-6 were used as a third pair 43, and pins 30-7 and 30-8 were used as a fourth pair 44. Herein a signal is travelling in the "forward" direction along a conductive pin 30 when it flows from the front end 32 of the conductive pin 30 to the rear end 36 of the conductive pin 30.

Figure 2:
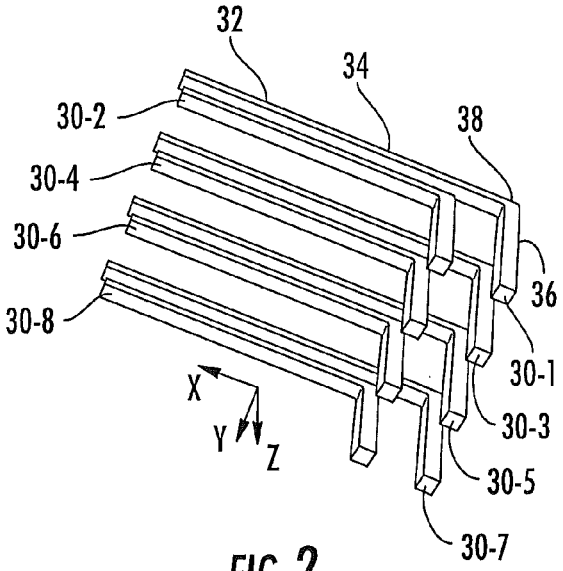
FIG. 2 (PRIOR ART)
FIG. 2 is a schematic perspective view illustrating eight of the conductive pins included in the pin connector of FIG. 1.
Figure 3:
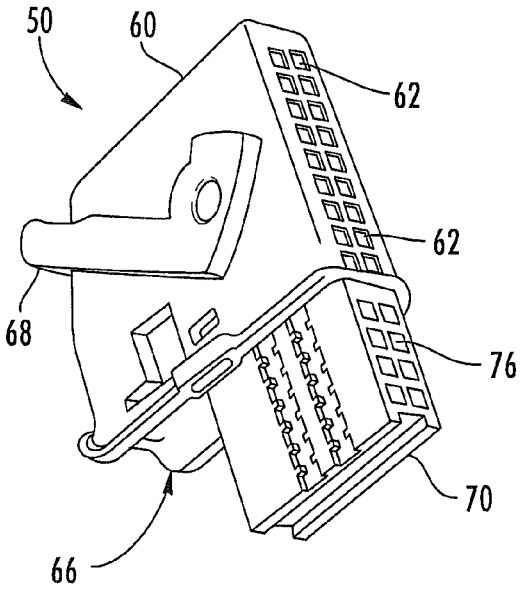
FIG. 3 (PRIOR ART)
FIG. 3 is a side perspective view of a conventional socket connector in a partially disassembled state.
Figure 4:
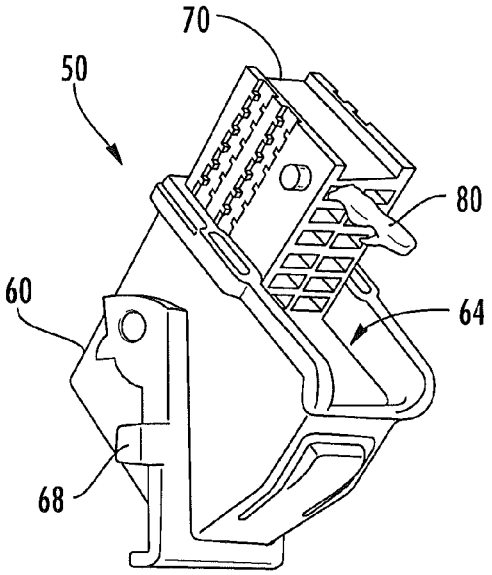
FIG. 4 (PRIOR ART)
FIG. 4 is a rear perspective view of the socket connector of FIG. 3.
Figure 5:
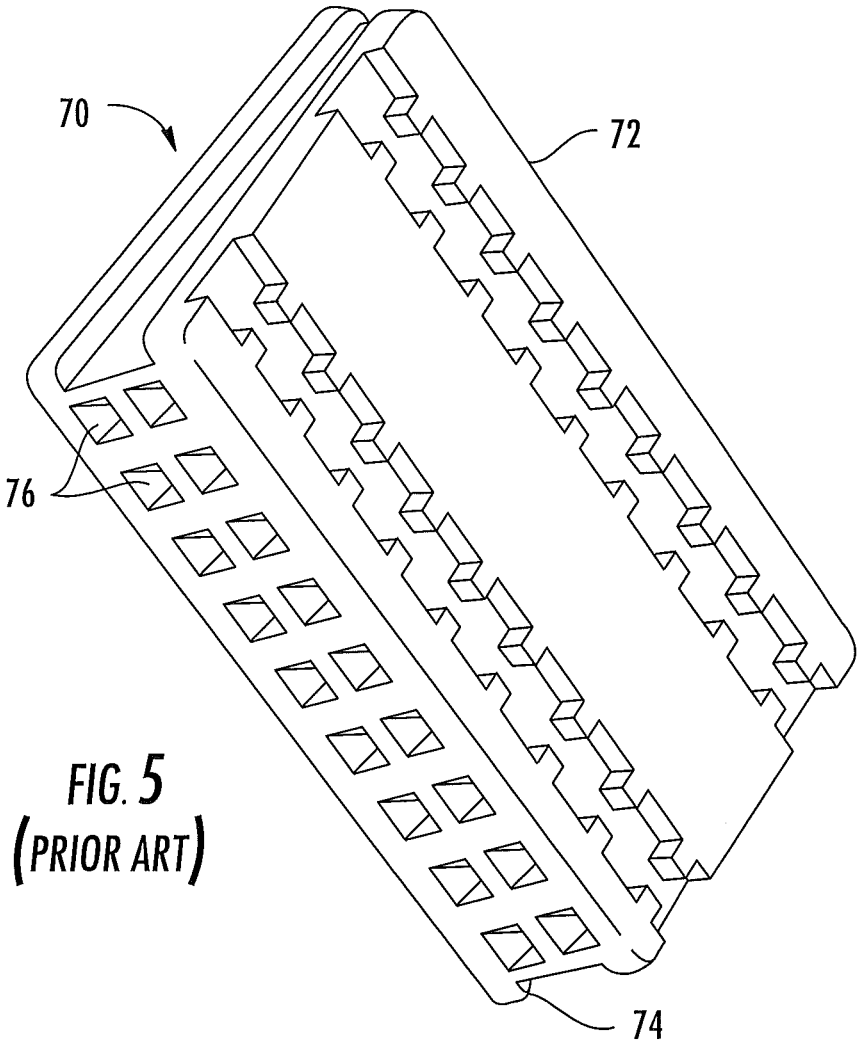
FIG. 5 (PRIOR ART)
FIG. 5 is a perspective view of a socket array that is included in the socket connector of FIGS. 3-4.

As can be seen in FIG. 2, the pins 30-1 through 30-8 have an unbalanced arrangement. For example, conductive pin 30-3 of pair 42 is always closer to conductive pin 30-1 of pair 41 than it is to conductive pin 30-2 of pair 41, and conductive pin 30-4 of pair 42 is always closer to conductive pin 30-2 of pair 41 than it is to conductive pin 30-1 of pair 41. As a result of this unbalanced arrangement, significant crosstalk may arise between adjacent pairs and even between non-adjacent pairs (e.g., pairs 41 and 43). Thus, the pin connector 10 may exhibit poor crosstalk performance due to differential-to-differential crosstalk between the pairs.

This can be seen, for example, in the graph of FIG. 7 which illustrates the near-end crosstalk performance for each of the pair combinations in the forward direction. Curve 90 in FIG. 7 illustrates the near-end crosstalk performance for directly adjacent pairs (namely the crosstalk induced on pair 42 when a signal is transmitted over pair 41 and vice versa, the crosstalk induced on pair 43 when a signal is transmitted over pair 42 and vice versa, and the crosstalk induced on pair 44 when a signal is transmitted over pair 43 and vice versa). As shown by curve 90 in FIG. 7, the near end crosstalk on adjacent pairs is at least 12 dB worse than the level of crosstalk allowed under the TIA and ISO Category 6A standards (which are illustrated by curves 98 and 99, respectively, in FIG. 7), and hence the pin connector 10 will clearly support far lower data rates than a Category 6A compliant connector.

Likewise, curve 91 in FIG. 7 illustrates the near-end crosstalk performance for "one-over" pair combinations in the connector 10 (a "one-over" pair combination refers to a combination of two pairs that have one additional pair located therebetween). In the connector 10, the "one-over" pair combinations are pairs 41 and 43 and pairs 42 and 44. As shown in FIG. 7, the near-end crosstalk on the one-over pair combinations is about 8 dB worse than the level of crosstalk allowed under the TIA and ISO Category 6A standards. Finally, curve 92 in FIG. 7 illustrates the near-end crosstalk performance for "two-over" pair combinations in the connector 10 (a "two-over" pair refers to a combination of two pairs that have two additional pairs located therebetween). In the connector 10, the only two-over pair combination is pairs 41 and 44. As shown in FIG. 7, the near end crosstalk on the two-over pair combination is still worse than the level of crosstalk allowed under the TIA and ISO Category 6A standards for all frequencies below about 450 MHz.

Pursuant to certain embodiments of the present invention, high speed communications connectors and connectorized cables are provided that may be suitable for use in harsh environments. These connectors and cables may be shielded or unshielded. The connectors according to embodiments of the present invention may have very small form factors and may be lightweight. Moreover, the connectors may exhibit good crosstalk performance and low levels of mode conversion, and hence may support high data rate communications. Embodiments of the present invention also disclose how the connectors according to embodiments of the present invention may be used to form communications channels that are suitable for automotive, industrial and other applications.

In some embodiments, pin connectors and socket connectors may be used that are well balanced and can operate within the performance characteristics set forth in the Category 6a standard. The pin and socket connectors according to embodiments of the present invention may be used to connect a plurality of conductors of a communications cable to, for example, a second cable or a printed circuit board. The connectors may be designed to transmit a plurality of signals over pairs of conductors. The connector designs according to embodiments of the present invention may be readily expanded to accommodate any number of pairs. Moreover, the connectors according to embodiments of the present invention may employ self-compensation techniques that may significantly reduce the amount of differential crosstalk and/or common mode crosstalk that arises within the connectors. The connectors according to embodiments of the present invention may be used, for example, as connectors in automobiles. Certain embodiments of pin and socket connectors that may be used, for example, in communications channels according to embodiments of the present invention will now be described with reference to FIGS. 8-14.

Figure 8:
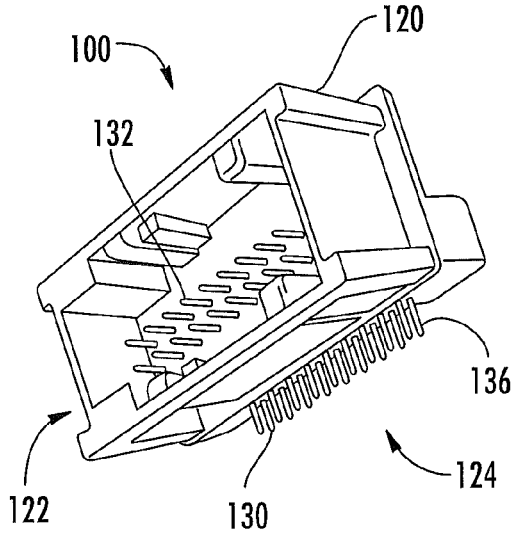
FIG. 8 is a perspective view of a pin connector that may be used in communications channels according to embodiments of the present invention.

FIG. 8 is a perspective view of a pin connector 100 that includes a housing 120 that has a plug aperture 122. The plug aperture 122 may be sized and configured to receive a mating socket connector. The pin connector 100 includes a conductive pin array 124 that has eighteen conductive pins 130. Each of the conductive pins 130 is mounted in the housing 120. These conductive pins 130 may be arranged as nine pairs of conductive pins 130.

Figure 9A:
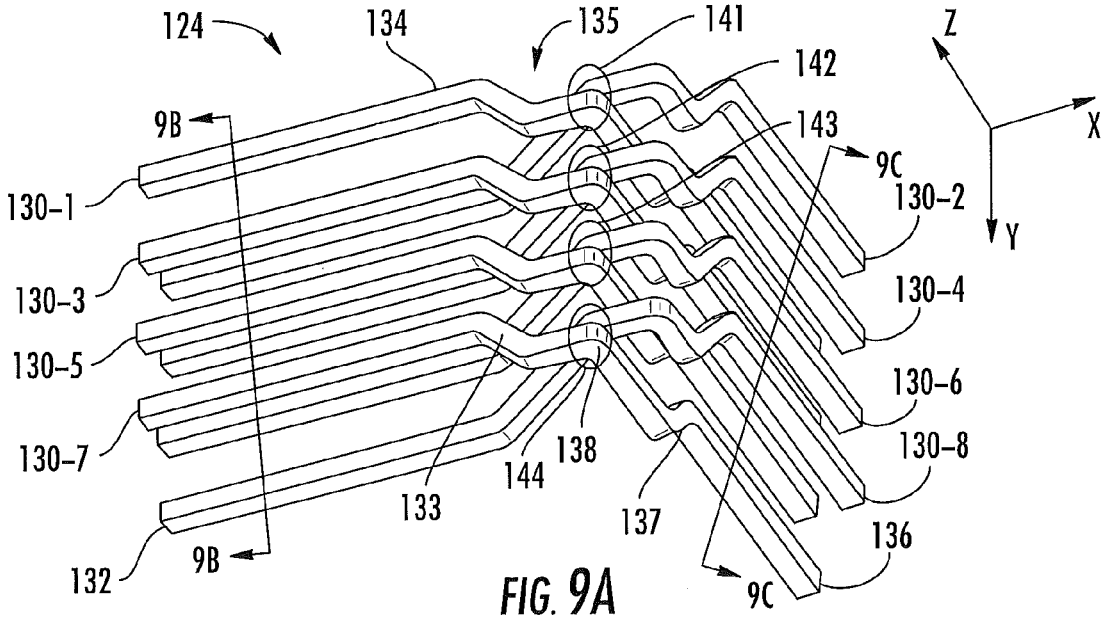
FIG. 9A is a schematic perspective view of a conductive pin array that is included in the pin connector of FIG. 8.
Figure 9B:
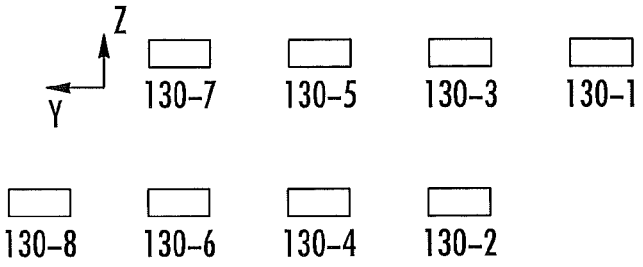
FIG. 9B is a cross-sectional view taken along the line 9B-9B of FIG. 9A.
Figure 9C:
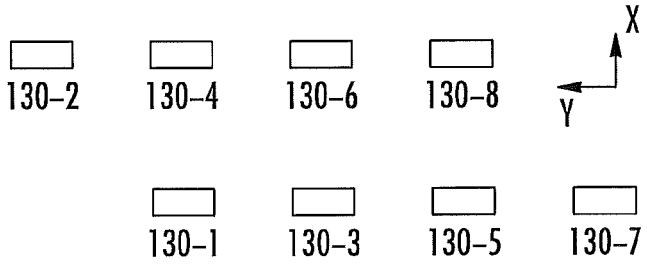
FIG. 9C is a cross-sectional view taken along the line 9C-9C of FIG. 9A.
Figure 9D:
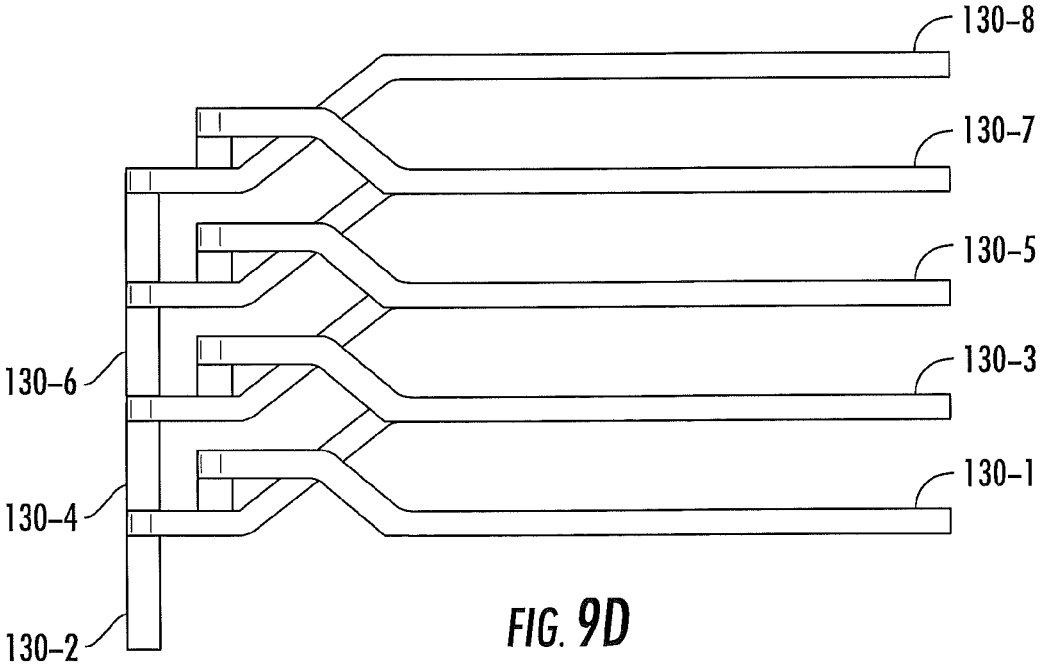
FIG. 9D is a top view of the conductive pin array of FIG. 9A.

FIG. 9A is a schematic perspective view of eight of the conductive pins (namely conductive pins 130-1 through 130-8) that are included in the conductive pin array 124 of the pin connector 100 of FIG. 8. FIG. 9B is a cross-sectional view taken along the line 9B-9B of FIG. 9A, and FIG. 9C is a cross-sectional view taken along the line 9C-9C of FIG. 9A. Finally, FIG. 9D is a top view of the conductive pins 130 that more clearly shows crossovers that are included in each pair of conductive pins 130.

As shown in FIG. 9A, pins 130-1 and 130-2 form a first pair 141, pins 130-3 and 130-4 form a second pair 142, pins 130-5 and 130-6 form a third pair 143, and pins 130-7 and 130-8 form a fourth pair 144. As known to those of skill in the art, the positive conductor of a pair is referred to as the "tip" conductor and the negative conductor of a pair is referred to as the "ring" conductor. In some embodiments, conductive pins 130-1, 130-3, 130-5 and 130-7 may be the tip conductive pins and conductive pins 130-2, 130-4, 130-6 and 130-8 may be the ring conductive pins of the four pairs 141-144.

As is further shown in FIGS. 9A-9D, each conductive pin 130 includes a first end 132, a middle portion 134, and a second end 136. The first end 132 of each conductive pin 130 generally extends along the x-direction. The second end 136 of each conductive pin 130 generally extends along the z-direction. The middle portion 134 of each conductive pin 130 includes a right angled section 138 that provides the transition from the x-direction to the z-direction. Additionally, each conductive pin 130 further includes two jogged sections that are provided so that the first conductive pin 130 of each pair of conductive pins 130 crosses over the second conductive pin 130 of the pair at a crossover location 135. The provision of these crossovers may allow the pin connectors 100 to achieve substantially improved electrical performance.

As shown in FIG. 9A, the two jogged sections that are provided on each conductive pin 130 comprise a first transition section 133 and a second transition section 137. The first transition section 133 is provided on each of the conductive pins 130 between the first end 132 thereof and the right-angled section 138. On each of the tip conductive pins 130-1, 130-3, 130-5, 130-7 the first transition section 133 causes the conductive pin to jog in the positive direction along the y-axis. In contrast, on each of the ring conductive pins 130-2, 130-4, 130-6, 130-8 the first transition section 133 causes the conductive pin to jog in the opposite (negative) direction along the y-axis. As a result of the opposed nature of these transition sections on the tip and ring conductive pins 130 of each pair 141-144, the tip and ring conductive pins 130 cross over each other between their first ends 132 and the right-angled section 138. These crossovers may be clearly seen in FIGS. 9A and 9D. Note that the first transition sections 133 need not form a right angle with respect to the x-axis, nor need the second transition sections 137 form a right angle with respect to z-axis. Instead, as shown in FIG. 9A, the first and/or second transition sections 133, 137 merely need to change the path of the conductive pin at issue from a first coordinate along the y-axis to a second (different) coordinate along the y-axis in order to effect the crossover.

The second transition section 137 that is provided on each of the conductive pins 130 is located between the second end 136 and the right-angled section 138. The second transition sections 137 cause jogs in the same direction on all eight of the conductive pins 130, namely in the negative direction along the y-axis. While in the embodiment of FIG. 9A the first transition sections 133 and the second transition sections 137 are implemented by bending each conductive pin 130 by about 45° at the beginning of the transition section and by bending the conductive pin 130 by about −45° at the end of the transition section, it will be appreciated that any angles may be used to implement the transition sections 133, 137. For example, in other embodiments, the transition sections 133, 137 may have angles of 60° and −60° or angles of 90° and −90°.

As shown in FIGS. 9A and 9B, the first ends 132 of the conductive pins 130 are aligned in two rows, with the first ends of conductive pins 130-2 and 130-3 vertically aligned, the first ends of conductive pins 130-4 and 130-5 vertically aligned, and the first ends of conductive pins 130-6 and 130-7 vertically aligned. As shown in FIGS. 9A and 9C, the second ends 136 of the conductive pins 130 are similarly aligned in two rows, with the second ends of conductive pins 130-1 and 130-4 vertically aligned, the second ends of conductive pins 130-3 and 130-6 vertically aligned, and the second ends of conductive pins 130-5 and 130-8 vertically aligned. It will be appreciated, however, that the first and second ends of the various conductive pins 130 may not be vertically aligned in this fashion in other embodiments (i.e., they may only be generally vertically aligned).

The above-described pin connectors may exhibit significantly improved electrical performance as compared to the conventional pin connector 10 discussed above. As shown in FIGS. 9A-9D, because of the staggered contact arrangement at the two ends of the pin connector 100, different "unlike" conductive pins 130 of two adjacent pairs of pairs 141-144 (i.e., a tip conductive pin from one pair and a ring conductive pin from the other pair) are vertically aligned at either end of the pin connector 100. By way of example, on the left-hand side of FIG. 9A, conductive pins 130-2 and 130-3 are vertically aligned, while conductive pins 130-1 and 130-4 are offset to either side of conductive pins 130-2 and 130-3. In contrast, on the right-hand side of FIG. 9A conductive pins 130-1 and 130-4 are vertically aligned, while conductive pins 130-2 and 130-3 are offset to either side of conductive pins 130-1 and 130-4. By using this staggered arrangement, and by controlling the lengths of the conductive pins 130, the distances between the conductive pins 130, etc., the pin connectors may generate coupling between "unlike" conductive pins that substantially cancels the crosstalk between the "like" conductive pins of each set of adjacent pairs ("like" conductive pins refer to two or more of the same type of conductive pin, such as two tip conductive pins or two ring conductive pins). Thus, the conductive pin arrangements may result in self cancellation of any "offending" crosstalk that may otherwise arise at either the front end region or rear end region of the conductive pins 130.

Additionally, the same crosstalk compensation benefits may also be achieved with respect to crosstalk between non-adjacent pairs such as "one-over" combinations of pairs (e.g., pairs 141 and 143 in FIG. 9A), "two-over" combinations of pairs (e.g., pairs 141 and 144 in FIG. 9A), etc.

Moreover, the crosstalk compensation arrangement that is implemented in the conductive pin arrangement of FIGS. 9A-9D is "stackable" in that any number of additional pairs of conductive pins 130 can be added to the first and second rows. For example, while FIGS. 9A-9D illustrate a conductive pin arrangement in which eight conductive pins 130 are used to form four pairs 141-144, any number of pairs may be provided simply by adding additional conductive pins on either or both ends of the rows.

Figure 10:
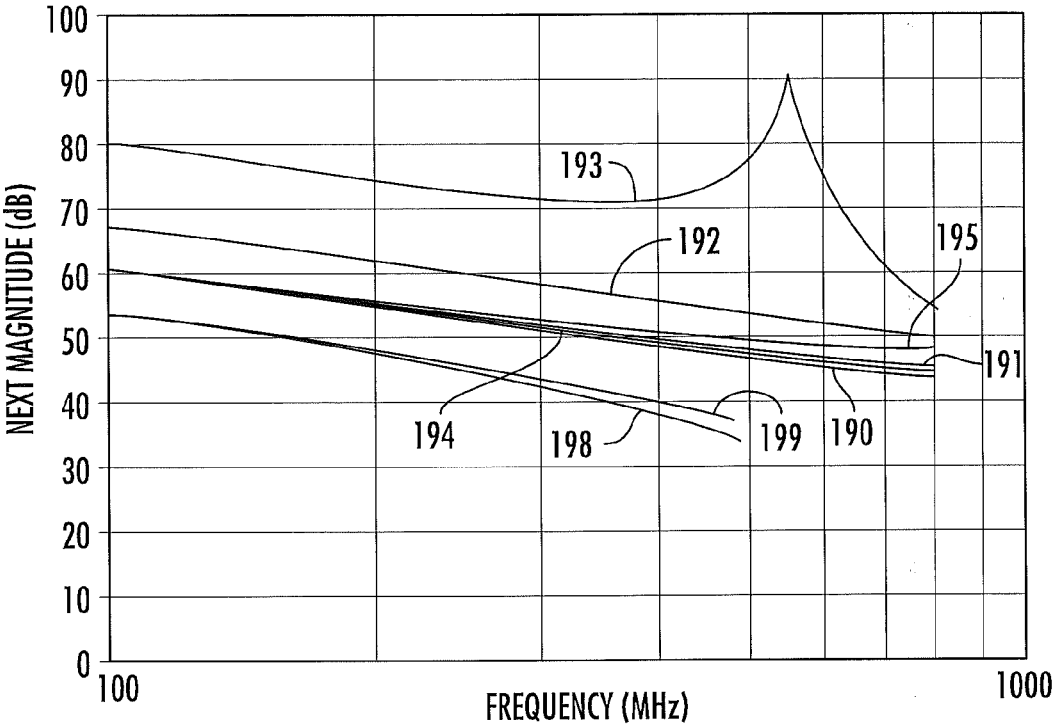
FIG. 10 is a graph illustrating the simulated near-end crosstalk in the forward direction of a pin connector that includes the conductive pin array illustrated in FIG. 8.

FIG. 10 is a graph illustrating the simulated near-end crosstalk performance in the forward direction for each of the pair combinations of the conductive pin array 124 of FIG. 9. In FIG. 10, curve 190 illustrates the near-end crosstalk performance between pairs 141 and 142, curve 191 illustrates the near-end crosstalk performance between pairs 141 and 143, curve 192 illustrates the near-end crosstalk performance between pairs 141 and 144, curve 193 illustrates the near-end crosstalk performance between pairs 142 and 143, curve 194 illustrates the near-end crosstalk performance between pairs 142 and 144, curve 195 illustrates the near-end crosstalk performance between pairs 143 and 144, and curves 198 and 199 illustrate the near-end crosstalk limits under the TIA and ISO versions of the Category 6a standard, respectively.

As shown in FIG. 10, the simulated near-end crosstalk in the forward direction between adjacent pairs (namely curves 190, 193 and 195) is at least 5 dB better than the level of crosstalk allowed under the TIA and ISO Category 6a standards (i.e., the performance exceeds these standards with a minimum of 5 dB margin). This represents about a 17 20 dB improvement in crosstalk performance as compared to the crosstalk performance illustrated in FIG. 7 for the conventional pin connector 10. The simulated near-end crosstalk in the forward direction between "one-over" pair combinations (namely curves 191 and 194) is at least 7 dB below the maximum amount of crosstalk allowed under the TIA and ISO Category 6a standards. Finally, the simulated near-end crosstalk in the forward direction between the one two-over pair combination (namely curve 192) is at least 13 dB below the maximum amount of crosstalk allowed under the TIA and ISO Category 6a standards. Thus, FIG. 10 illustrates that the pin connector 100 may provide significantly enhanced crosstalk performance as compared to pin connector 10.

Figure 11:
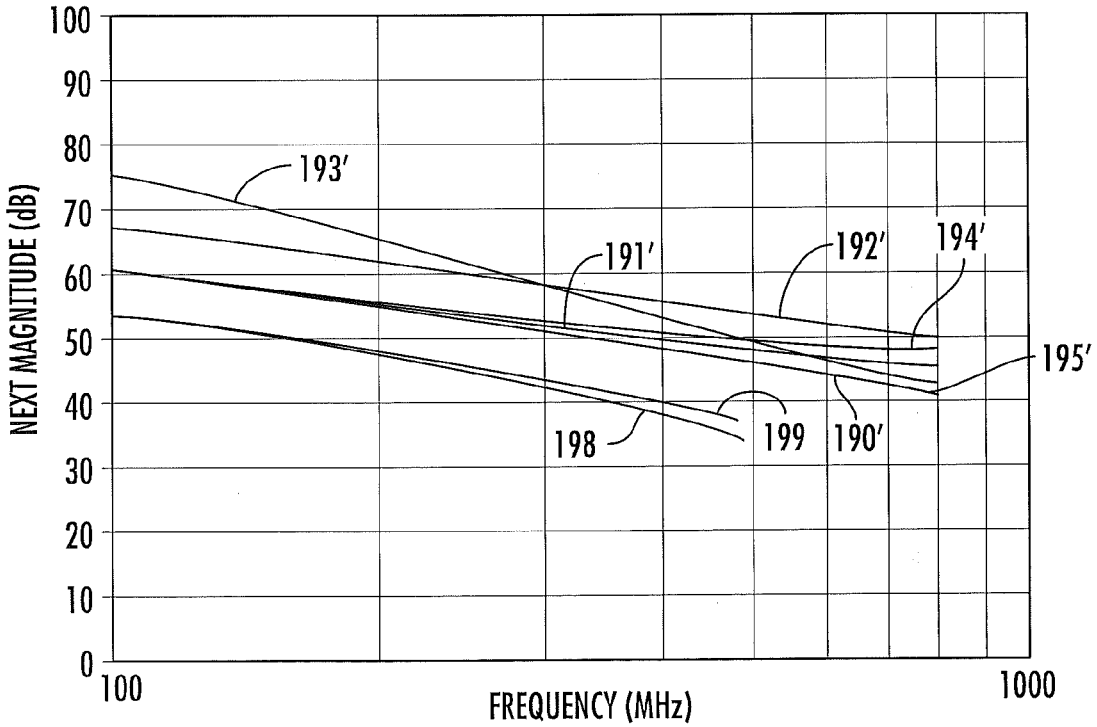
FIG. 11 is a graph illustrating the simulated near-end crosstalk in the reverse direction of a pin connector that includes the conductive pin array illustrated in FIG. 8.

FIG. 11 is a graph illustrating the simulated reverse near end crosstalk performance for each of the pair combinations of the pin connector 100 of FIGS. 8-9. In FIG. 11, curve 190' illustrates the near-end crosstalk performance between pairs 141 and 142, curve 191' illustrates the near-end crosstalk performance between pairs 141 and 143, curve 192' illustrates the near-end crosstalk performance between pairs 141 and 144, curve 193' illustrates the near-end crosstalk performance between pairs 142 and 143, curve 194' illustrates the near-end crosstalk performance between pairs 142 and 144, curve 195' illustrates the near-end crosstalk performance between pairs 143 and 144, and curves 198 and 199 illustrates the near-end crosstalk limits under the TIA and ISO versions of the Category 6a standard, respectively. As shown in FIG. 11, the simulated near-end crosstalk in the reverse direction is quite similar to the simulated cross-talk performance in the forward direction, and all pair combinations have significant margin with respect to meeting the TIA and ISO Category 6a standards. Simulations also indicate that all pair combinations have significant margin with respect to meeting the TIA and ISO Category 6a standards for far-end crosstalk performance, although the results of these simulations are not provided herein for purposes of brevity.

Another potential advantage of the conductive pin arrangement of FIG. 9A is that the structure may also be self-compensating for common mode crosstalk. Common mode crosstalk may be viewed as the crosstalk that arises where the two conductors of a pair, when excited differentially, couple unequal amounts of energy on both conductors of another pair when the two conductors of the victim pair are viewed as being the equivalent of a single conductor. However, because the conductive pins 130 of each of the pairs 141-144 include a crossover, the conductive pin arrangement employed in pin connector 100 also self-compensates for common mode crosstalk. This can be seen, for example, by analyzing pairs 141 and 142. When the conductive pins 130-1 and 130-2 of pair 141 are excited differentially (i.e., carry a differential signal), in the front end of the conductive pin array 124, conductive pin 130-2 will induce a higher amount of crosstalk onto pair 142 (i.e., onto conductive pins 130-3 and 130-4 viewed as a single conductor) than will conductive pin 130-1, thereby generating an offending common mode crosstalk signal. However, at the rear end of the conductive pin array, conductive pin 130-1 will induce a higher amount of crosstalk onto pair 142 (i.e., onto conductive pins 130-3 and 130-4 viewed as a single conductor) than will conductive pin 130-2 due to the crossover of the conductive pins of pair 141, thereby generating a compensating common mode crosstalk signal that may cancel much of the offending common mode crosstalk signal. This same effect will occur on all of the other pair combinations.

Additionally, balancing the tip and ring conductors of a pair may be important for other electrical performance parameters such as minimizing emissions of and susceptibility to electromagnetic interference (EMI). In pin connector 100, each pair may be well-balanced as the tip and ring conductive pins may be generally of equal lengths. In contrast, the tip conductive pins in the pin connector 10 of FIGS. 1-2 are longer than the ring conductive pins, which may negatively impact their EMI performance.

Figure 12:
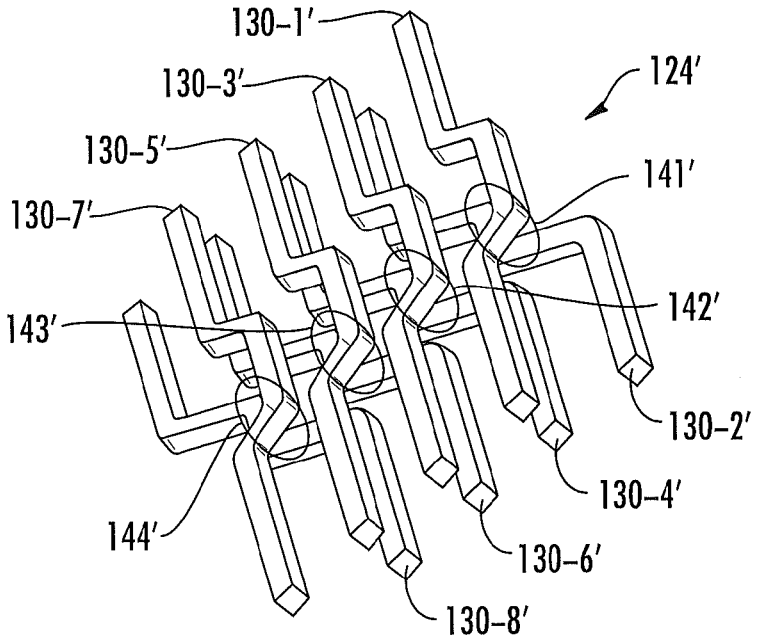
FIG. 12 is a schematic perspective view of a conductive pin array of another pin connector that may be used in the communications channels according to embodiments of the present invention.

FIG. 12 is a perspective view of an alternative conductive pin array 124'. As shown in FIG. 12, the conductive pin array 124' includes eight conductive pins 130-1' through 130-8' that are arranged as four pairs of conductive pins 141'-144'. The conductive pin array 124' is quite similar to the conductive pin array 124 of pin connector 100 that is illustrated in FIGS. 9A-9C, except that the conductive pins 130-1' through 130-8' in the conductive pin array 124' of FIG. 12 do not include the right angle bend 138. Pin connectors that use the conductive pin array 124' of FIG. 12 may be more suitable for connecting two communications cables, while pin connectors that use the conductive pin array 124 of FIGS. 9A-9C may be more suitable for connecting a communications cable to, for example, a printed circuit board. The housing 120 of FIG. 8 may be suitably modified to hold the conductive pin array 124'.

Figure 6:
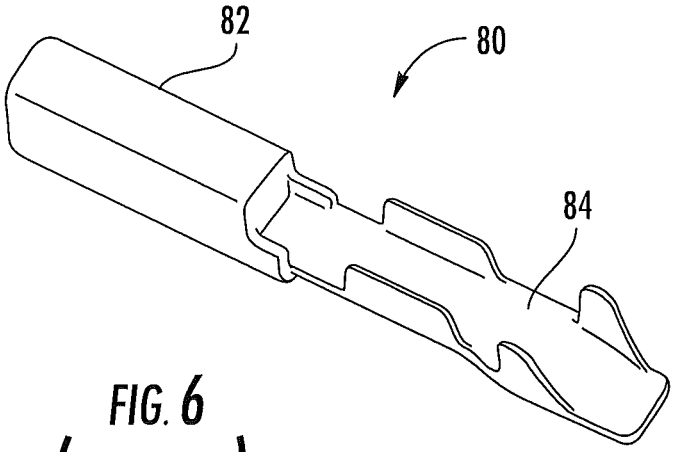
FIG. 6 (PRIOR ART)
FIG. 6 is a perspective view of one of the socket contacts that is included in the socket array of FIG. 5.
Figure 13:
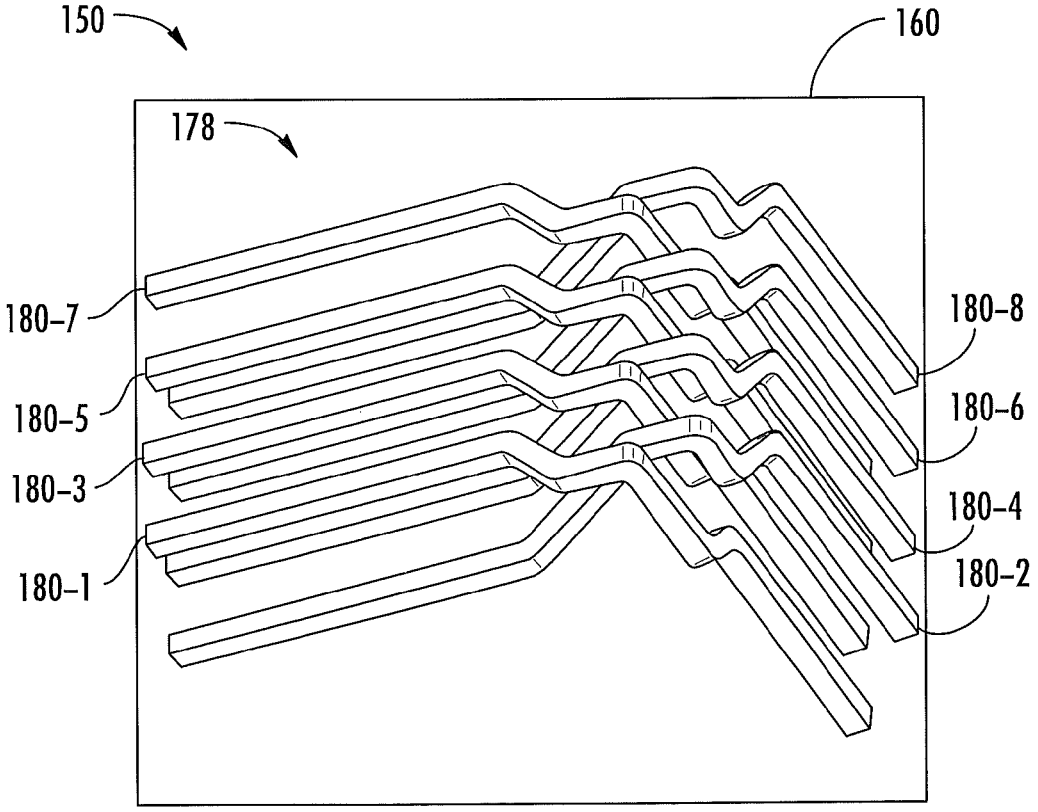
FIG. 13 is a schematic diagram illustrating a socket contact array of a socket connector that may be used in the communications channels according to embodiments of the present invention.

It will likewise be appreciated that the concepts discussed above with respect to pin connectors may also be applied to socket connectors to improve the electrical performance of such connectors. By way of example, FIG. 6 is an enlarged perspective view of a conventional socket contact 80. Socket connectors may be provided which include socket contacts similar to the socket contact 80 illustrated in FIG. 6, except that each socket contact included in the socket connector is bent to, for example, have the same general shape as the conductive pins in the conductive pin array 124 of pin connector 100. FIG. 13 schematically illustrates such a socket connector 150. The socket connector 150 includes a socket contact array 178 that includes eight socket contacts 180-1 through 180-8. In order to simplify the drawing, each socket contact 180 in the socket contact array 178 is illustrated as a metal wire, and the housing 160 of the connector is indicated by a simple box. By controlling various parameters including the spacing between the socket contacts 180, the lengths of the front ends and rear ends of the socket contacts 180, the amount of facing surface area between adjacent socket contacts 180 in the socket contact array 178, etc., the socket contact array 178 of FIG. 13 may be designed to substantially cancel both differential and common mode crosstalk. While the socket contact array 178 of FIG. 13 includes a right angle 188 in each socket contact 180, it will be appreciated that in other embodiments the socket contact array 178 may instead omit the right angles so as to correspond to the conductive pin array design of FIG. 12.

The above-discussed pin and socket contacts may be mated together to provide mated pin and socket connectors. By designing both the pin connector and the socket connector to employ crosstalk compensation, it is possible to provide mated pin and socket connectors that may support very high data rates such as the data rates supported by the Ethernet Category 6a standards. However, it will also be appreciated that another way of achieving such performance is to provide a pin and socket connector which when mated together act as one integrated physical structure that enables a low crosstalk mated pin and socket connector.

In particular, in the above-described embodiments, the conductive pin array of the pin connector includes both staggers and crossovers as crosstalk reduction techniques so that the amount of uncompensated crosstalk that is generated in these pin connectors may be very low. Likewise, the socket contact array of the socket connectors include both staggers and crossovers as crosstalk reduction techniques so that the amount of uncompensated crosstalk that is generated in these socket connectors may also be very low. Thus, in the mated pin and socket connectors that are formed using the above-described pin and socket connectors, each conductive path through the mated connectors includes multiple staggers and crossovers.

In further embodiments, the combination of a pin connector that is mated with a socket connector may be viewed as a single connector that employs the above-described crosstalk compensation techniques. Two such mated pin and socket connectors are schematically illustrated in FIGS. 14A and 14B.

Figure 14A:
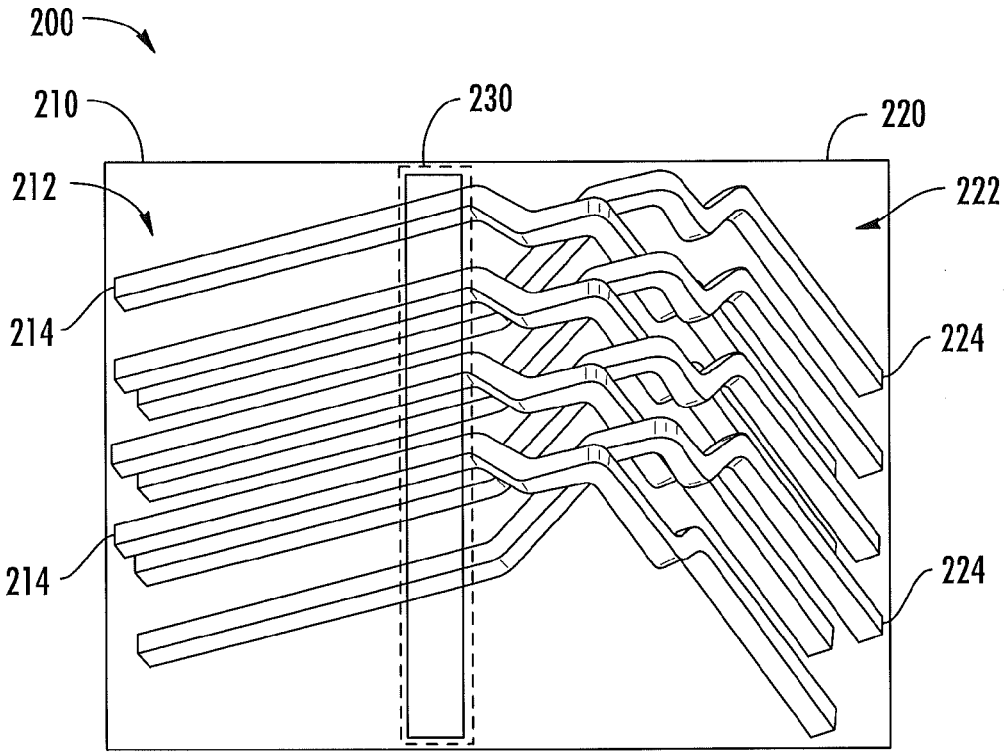
FIGS. 14A and 14B are schematic diagrams of pin connectors mated with socket connectors to provide mated pin-socket connectors.

In particular, FIG. 14A schematically illustrates a mated pin and socket connector 200 that includes a pin connector 210 and a socket connector 220. As shown in FIG. 14A, the pin connector 210 may include a conductive pin array 212 that includes a plurality of straight conductive pins 214. The socket connector 220 may include a socket contact array 222 that includes a plurality of socket contacts 224. As shown in FIG. 14A, each socket contact 224 may be bent to have a right angle bend and may also be bent so that it crosses over or under another socket contact 224. Consequently, the combination of each tip conductive pin 214 and its mating tip socket contact 224 may be designed to have the same shape as the tip conductive pins 130-1, 130-3, 130-5, 130-7 of FIGS. 9A-9C, and the combination of each ring conductive pin 214 and its mating socket contact 224 may be designed to have the same shape as the ring conductive pins 130-2, 130-4, 130-6, 130-8 of FIGS. 9A-9C. The shape, size and relative locations of the conductive pins 214 and the socket contacts 224 may be adjusted so that while the differential crosstalk at the pin or socket end of the connector self cancels due to their staggered arrangement at either end, the common mode pair-to-pair crosstalk that is generated on one side of the crossovers is substantially cancelled by opposite polarity common mode pair-to-pair crosstalk that is generated on the opposite side of the crossovers. Note that when the pin connector 210 is mated with the socket connector 220 a mating region 230 is formed where the conductive pins 214 of the pin connector 210 are received within their respective socket contacts 224 of the socket connector 220.

Figure 14B:
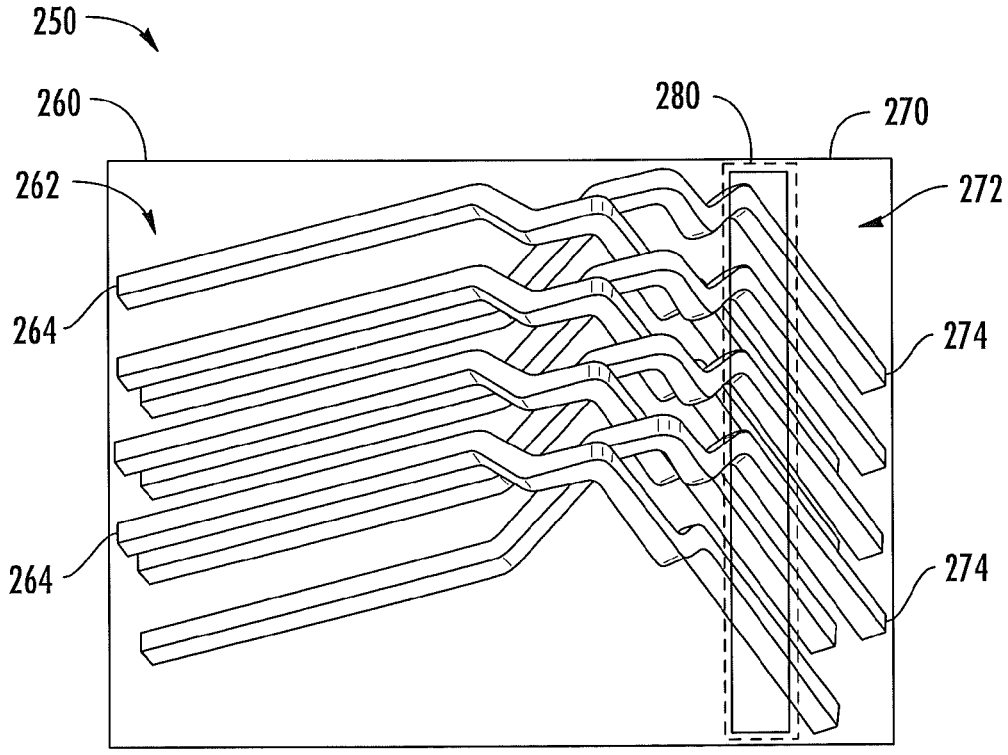

As shown in FIG. 14B, in another embodiment, a mated pin and socket connector 250 that includes a pin connector 260 and a socket connector 270 is provided. The pin connector 260 may include a conductive pin array 262 that includes a plurality of conductive pins 264. Each of the conductive pins 264 may have the general design of the conductive pins 130 of pin connector 100. The socket connector 270 may include a socket contact array 272 that includes a plurality of socket contacts 274 that may have the design of socket contact 80 of FIG. 6. The combination of each tip conductive pin 264 and its mating tip socket contact 274 may be designed to have the same shape as the tip conductive pins 130-1, 130-3, 130-5, 130-7 of FIGS. 9A-9C, and the combination of each ring conductive pin 264 and its mating socket contact 274 may be designed to have the same shape as the ring conductive pins 130-2, 130-4, 130-6, 130-8 of FIGS. 9A-9C. The shape, size and relative locations of the conductive pins 264 and the socket contacts 274 may be adjusted so that while the differential crosstalk at the pin or socket end of the connector self cancels due to their staggered arrangement at either end, the common mode pair-to-pair crosstalk that is generated on one side of the crossovers is substantially cancelled by opposite polarity pair-to-pair crosstalk that is generated on the opposite side of the crossovers. Note that when the pin connector 260 is mated with the socket connector 270, a mating region 280 is formed where the conductive pins 264 of the pin connector 260 are received within their respective socket contacts 274 of the socket connector 270.

While the pin connectors discussed above have a plug aperture (and hence are "jacks") and the socket connectors are received within the plug aperture (and hence are "plugs"), it will be appreciated that in other embodiments, the socket connectors may have a plug aperture that the pin connectors are received within such that the socket connectors are jacks and the pin connectors are plugs. The same is true with respect to various other pin and socket connectors discussed herein. It will likewise be appreciated that while the pin and socket connectors discussed above and below may either have straight conductive pins/socket contacts or conductive pins/socket contacts that include a 90° angle, in other embodiments any appropriate angle, curve, series of angles or the like may be included in either the conductive pins or the socket contacts. It will similarly be appreciated that the pin and socket connectors may include any number of conductive pins/sockets, and that the pins/sockets may be aligned in more than two rows in other embodiments.

Figure 15:
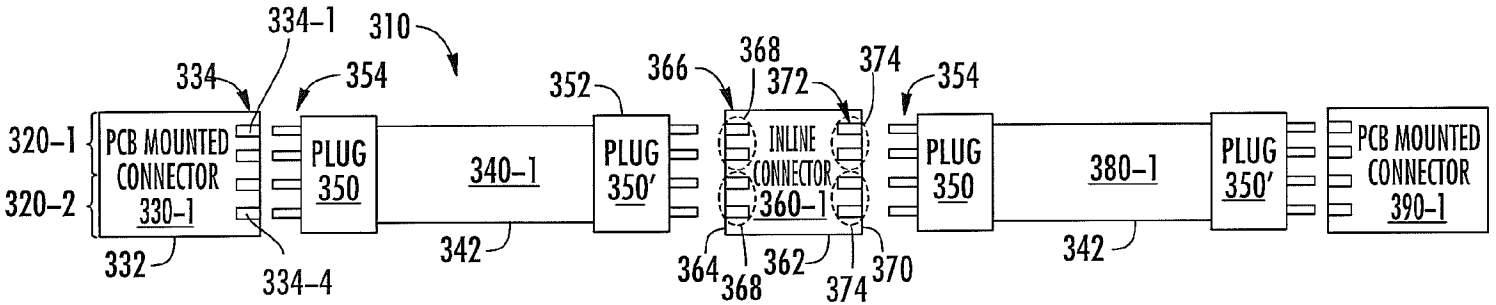
FIG. 15 is a schematic block diagram of a communications system in which the connectors according to embodiments of the present invention may be used.
Figure 15:
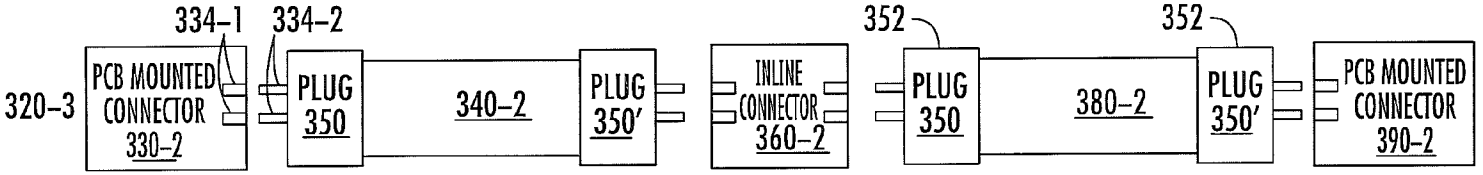
Figure 16:
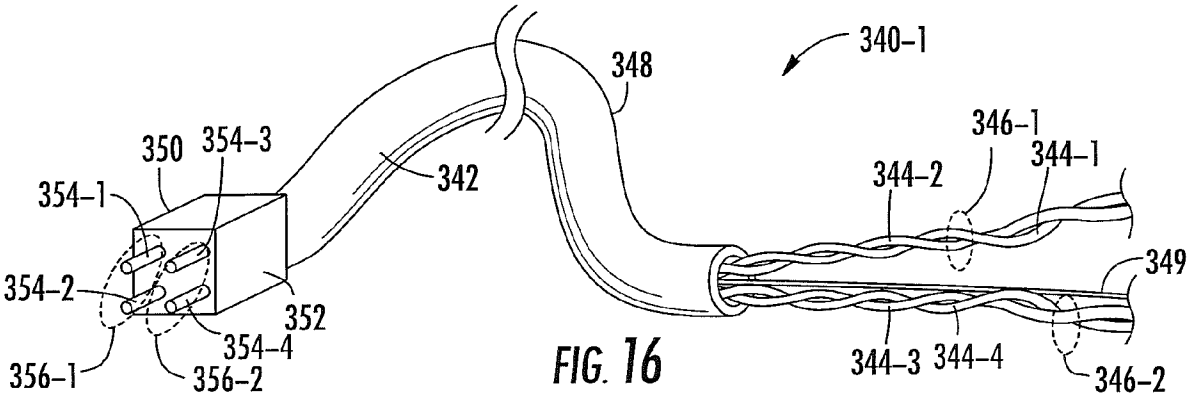
FIG. 16 is a perspective, cut-away view of one of the connectorized cables of FIG. 15 that shows the pairs of conductors included therein.

The pin and socket connectors according to embodiments of the present invention that are described herein may be used in vehicles, industrial applications and other harsh environments. The configuration of connectors and cables that may be used to form an end-to-end communications channel in automobiles and other example environments will differ based on the specific equipment that is connected and the surrounding environment. FIG. 15 is a schematic block diagram of a communications system 310 that illustrates one example configuration in which three communications channels are provided between two printed circuit boards using printed circuit board mounted connectors, inline connectors, and patch cords. The pin and socket connectors according to embodiments of the present invention may be used to implement the communications system 10. FIG. 16 is a perspective, cut-away view of one example embodiment of one of the connectorized cables of FIG. 15.

As shown in FIG. 15, the communications system 310 may include a plurality a communications channels 320. In the depicted embodiment, a total of three communications channels 320-1, 320-2, 320-3 are illustrated, but it will be appreciated that the system may have any number of communications channels 320. Note that herein, a communications channel refers to an end-to-end conductive path that includes at least one connector and at least one cable segment. As the connectors according to embodiments of the present invention use two conductor signaling techniques, each communications channel includes two end-to-end conductive paths that form a pair of tip and ring conductive paths. The cable segments and connectors may include a single communications channel or multiple communications channels.

In some embodiments, each communications channel 320 may extend from a first electronic device to a second electronic device. As shown in FIG. 15, a first printed circuit board mounted connector 330 may be mounted on a printed circuit board of the first electronic device, and a second printed circuit board mounted connector 390 may be mounted on a printed circuit board of the second electronic device. Each communications channel may further include a first connectorized cable 340, an inline connector 360, and a second connectorized cable 380 that together electrically connect extend the first printed circuit board mounted connector 330 to the second printed circuit board mounted connector 390.

The connectors 330, 360, 390 and connectorized cables 340, 380 may each include a single communications channel 320 or a plurality of communications channels 320. For example, in the embodiment depicted in FIG. 15, a first set of connectors and connectorized cables 330-1, 340-1, 360-1, 380-1, 390-1 are used to implement two communications channels 320-1, 320-2, while a second set of connectors and connectorized cables 330-2, 340-2, 360-2, 380-2, 390-2 are used to implement the third communications channel 320-3. The connectors 330-1, 360-1, 390-1 thus each have four contacts and the connectorized cables 340-1, 380-1 each have four insulated conductors, while the connectors 330-2, 360-2, 390-2 each have two contacts and the connectorized cables 340-2, 380-2 each have two insulated conductors. It will be appreciated that in other embodiments, connectors and connectorized cables that have one, three, four or more communications channels 320 may be used. It will also be appreciated that the connectorized cables 340-1, 380-1 may be implemented as "break-out" cables where multiple pairs of insulated conductors are included in the cable and each end of the cable has multiple cable connectors that terminate, for example, a respective one of the pairs of insulated conductors.

Referring again to FIG. 15, each first printed circuit board connector 330 may comprise, for example, a connector such as a communications jack that is mounted on a printed circuit board of a controller, a computer or other electronic device (not shown). In some embodiments, the printed circuit board connector may be at least partially integrated into the printed circuit board of the controller, computer or other electronic device. A plurality of connectors 330 may be mounted on the printed circuit board of the controller, typically in side-by-side fashion. Each connector 330 may include a housing 332 (or, alternatively, the connectors 330-1, 330-2 may include a common housing 332). The first printed circuit board connectors 330 may include two contacts 334 for each communications channel supported by the connector 330. Thus, for example, connector 330-1 has four contacts 334-1 through 334-4, while connector 330-2 has two contacts 334-1, 334-2. Example embodiments of connectors that may be used to implement the first printed circuit board connectors 330 are discussed above and below.

As is further shown in FIG. 15, each connectorized cable 340 may include a communications cable 342 that has cable connectors 350, 350' mounted on the respective ends thereof. FIG. 16 is a schematic perspective view of a portion of the connectorized cable 340-1 of FIG. 15. As shown in FIG. 16, the communications cable 342 may comprise, for example, an unshielded twisted pair Ethernet-style cable that includes four insulated conductors 344-1 through 344-4 that are arranged as two twisted pairs 346-1, 346-2 of conductors, each of which may carry a single information signal. The twisted pairs 346-1, 346-2 may be enclosed in a cable jacket 348, and additional structures such as, for example, a tape separator 349 may be included in the cable 342 to separate the twisted pairs 346-1, 346-2 from each other. The twisted pairs 346-1, 346-2 and any separator 349 may be twisted together in a core twist. Each twisted pair 346-1, 346-2 may be implemented, for example, in the same manner as a twisted pair of an Ethernet communications cable that is compliant with the above-referenced Category 6a standard. Connectorized cable 340-2 may be implemented in a similar fashion to connectorized cable 340-1, except that only one twisted pair 346-1 would be included in connectorized cable 340-2, the separator 349 would be omitted, and there would be no core twist. It will also be appreciated that in other embodiments connectorized cables 340 may be provided that include more than two twisted pairs.

As is further shown in FIG. 16, the cable connectors 350, 350' may be implemented as plug connectors. However, it will be appreciated that connectorized cables may be implemented that include either (or both) plug connectors, jack connectors or other types of connectors. Each cable connector 350, 350' may include a housing 352 and a plurality of contacts 354 that are arranged as pairs of contacts 356. Each cable connector 350, 350' may include a number of contacts 354 that matches the number of insulated conductors 344 that are included in the cable 342. Thus, for example, as shown in FIG. 16, if the communications cable 342 includes four insulated conductors 344-1 through 344-4 that are arranged as two twisted pairs 346-1, 346-2, then cable connector 350 (as well as cable connector 350', which is not shown in FIG. 16) will include four contacts 354-1 through 354-4 that are arranged as two pairs of contacts 356-1, 356-2. Each contact 354-1 through 354-4 will be electrically connected to a respective one of the insulated conductors 344-1 through 344-4. In the embodiment of FIG. 16, each contact 354 comprises a pin contact.

Referring again to FIG. 15, it can be seen that each inline connector 360 may include a housing 362 and first and second connector portions 364, 370. In embodiments where the inline connectors 360 are implemented as jacks, the connector portions 364, 370 may comprise a pair of plug apertures 364, 370. In such embodiments, the first plug aperture 364 may receive the plug 350' of the first connectorized cable 340 and the second plug aperture 370 may receive the plug 350 of the second connectorized cable 380. A plurality of jack input contacts 366 are mounted in the first plug aperture 364, and a plurality of jack output contacts 372 are mounted in the second plug aperture 370. Alternatively, in embodiments in which the inline connectors 360 are implemented as plug connectors, the connector portions 364, 370 may comprise a pair of plugs 364, 370. In such embodiments, the first plug 364 may be inserted into a plug aperture of the jack connector 350' of the first connectorized cable 340 and the second plug 370 may be inserted into the plug aperture of the jack connector 350 of the second connectorized cable 380. In these embodiments, a plurality of plug input contacts 366 are mounted in and/or to extend from the first plug 364, and a plurality of plug output contacts 372 are mounted in and/or to extend from the second plug 370. In either case, the plurality of plug input contacts 366 are arranged as pairs of input contacts 368 and the plurality of plug output contacts 372 are arranged as pairs of output contacts 374. Each input contact pair 368 and corresponding output contact pair 374 (along with any intervening structures) form a communications channel through the inline connector 360. In some embodiments, each input contact 366 and its corresponding output contact 372 may be formed of a unitary piece of metal. The inline connector 360-1 includes four input contacts 366 and four output contacts 374 that define two communications channels, while the inline connector 360-2 includes two input contacts 366 and two output contacts 374 that define a single communications channel.

Each of the second connectorized cables 380 may be identical to the first connectorized cables 340. Accordingly, further description of the connectorized cables 380 will be omitted. Each second printed circuit board mounted connector 390 may be identical to the first printed circuit board mounted connector 330. Accordingly, further description of the second printed circuit board mounted connectors 390 will also be omitted.

The communications channels 320 depicted in FIG. 15 may be well-suited for automotive applications. Automobiles are increasingly incorporating high end electronics such as vehicle location transponders to indicate the position of the vehicle to a remote station; blue tooth connections for cell phone connections and portable music players (e.g., an IPOD® device); personal and virtual assistance services for vehicle operators (e.g., the ON STAR® service); a WiFi Internet connection area within the vehicle; back-up and side-view cameras; one or more rear passenger DVD players and/or gaming systems; Global Positioning Systems (GPS); collision warning radar systems; proximity sensors; and braking, acceleration and steering controllers for backing up, parallel parking, accident avoidance and self-driving vehicles and the like. In many cases, these electronic devices are located throughout the automobile and communicate with one or more controllers or head unit devices that are typically located at a centralized location. In order to facilitate production line techniques, these electronic devices may be installed in subcomponents of the automobile (e.g., doors, the trunk, side panels, etc.) that are separately manufactured.

Figure 76:
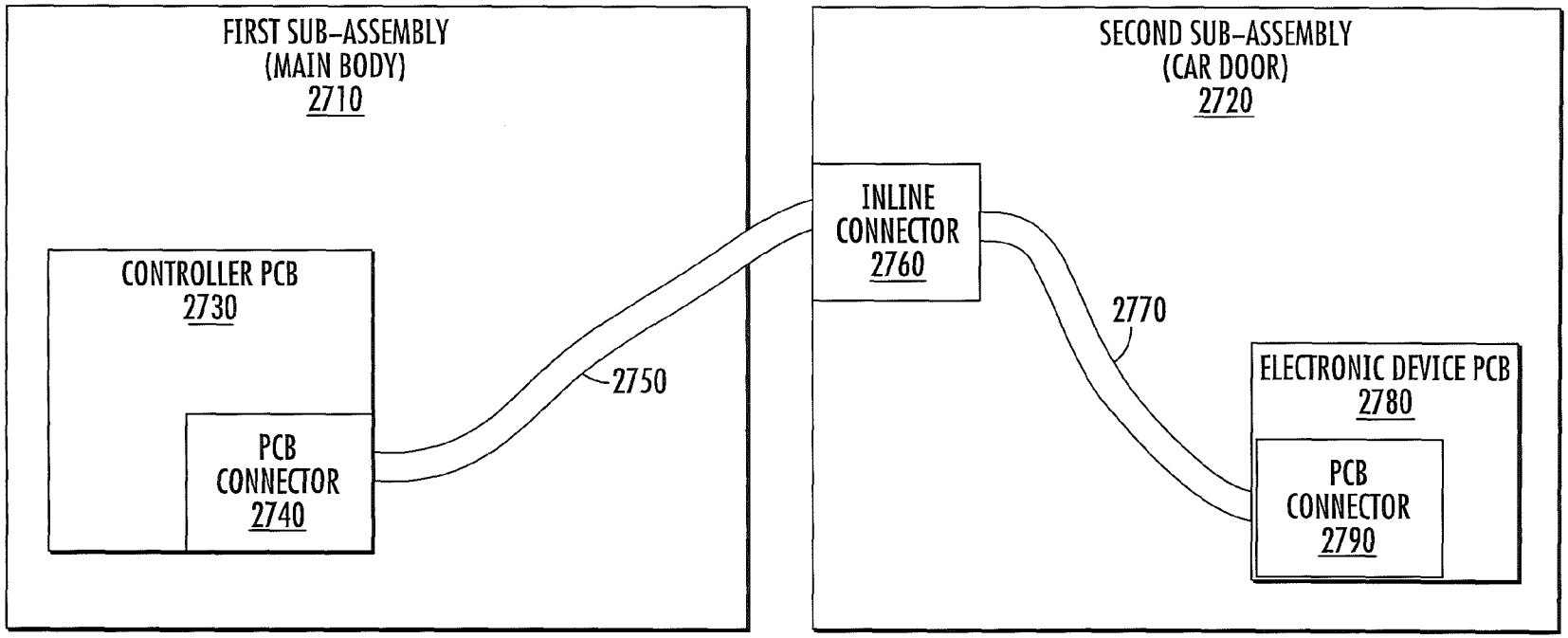
FIG. 76 is a block diagram illustrating how connectors and connectorized cables according to embodiments of the present invention may be used in automotive applications.

For example, an electronic device such as a camera may be installed in the door of an automobile. This door may be manufactured separately from the body of the automobile. The camera may include a printed circuit board mounted connector 390. During assembly of the door, a first connector 350' of a connectorized cable 380 may be mated with the printed circuit board mounted connector 390, and the second connector 350 that is on the opposite end of this connectorized cable 380 may be mated with the second connector portion 370 of an inline connector 360. A controller (not shown) may be installed behind the dashboard of the automobile. The controller may include a first printed circuit board connector 330. During assembly of the main body of the automobile, a first connector 350 of a connectorized cable 340 may be mated with the first printed circuit board connector 330, and the second connector 350' that is on the opposite end of the connectorized cable 340 may be routed to a hole in the automobile main body that is adjacent the door. When the door is attached to the main body, the second connector 350' of the connectorized cable 340 may be routed through the hole and into the door where it is mated with the first connector portion 364 of the inline connector 360, thereby completing a communication channel 320 between the camera and the controller. It will be appreciated that while FIG. 15 illustrates communications channels 320 that each include two connectorized cables 340, 380 and one inline connector 360, in some cases one or more of these communications channels 320 may include additional elements (e.g., additional connectorized cables and inline connectors) while in other cases the communications channels may include fewer elements (e.g., the inline connector 360 and the connectorized cable 380 may be omitted). FIG. 76 schematically illustrates how two printed circuit board mounted connectors 2740, 2790, an inline connector 2760 and two connectorized cables 2750, 2770 according to embodiments of the present invention may be used to provide a communications path between controller 2730 that is installed in a first sub-assembly 2710 of an automobile (the main body) and an electronic device 2780 that is installed in a second sub-assembly 2720 (a door) of the automobile.

Figure 17:
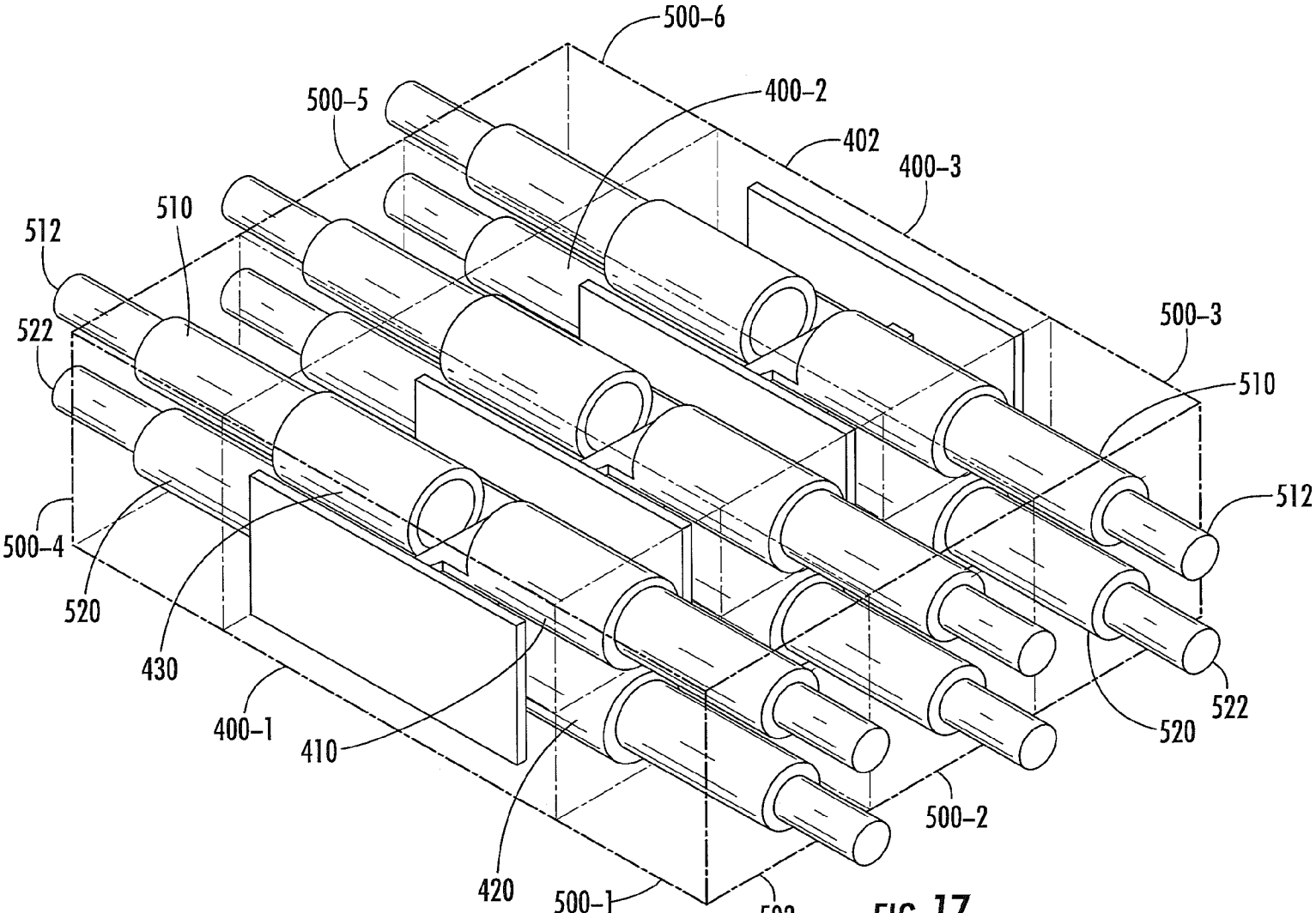
FIG. 17 is a schematic perspective view of three inline connectors according to embodiments of the present invention, where each inline connector is mated with two corresponding cable connectors.

FIG. 17 is a schematic perspective view of three inline connectors 400-1, 400-2, 400-3 according to embodiments of the present invention and portions of six cable connectors 500 that are mated therewith. In FIG. 17, inline connector 400-1 is mated with cable connectors 500-1, 500-4, inline connector 400-2 is mated with cable connectors 500-2, 500-5, and inline connector 400-3 is mated with cable connectors 500-3, 500-6. As shown in FIG. 17, the three inline connectors 400-1, 400-2, 400-3 may be aligned in a row directly adjacent to each other, and may be physically mated/attached to each other. This arrangement may minimize space requirements and provide a convenient connector interface, but may also increase coupling between the communications paths of adjacent connectors.

As shown in FIG. 17, each cable connector 500 may have a housing 502 and first and second pin contacts 510, 520. Each pin contact 510, 520 may comprise a hollow pin that is crimped onto a bare end portion of respective insulated conductors 512, 522 of a communications cable. In other embodiments, the pin contacts 510, 520 could be soldered to the respective conductors 512, 522, connected by insulation piercing or insulation displacement contacts or by other suitable means. The conductors 512, 522 may comprise a twisted pair of conductors of a communications cable (the cables are not shown in FIG. 17 to better illustrate the components of the cable connectors 500), where the insulation has been removed from the end portion that is inserted into the pin contacts 510, 520. Each pin contact 510 is a tip pin contact, and each pin contact 520 is a ring pin contact. The pin contacts 510, 520 may extend, for example, from a front face of the housing (as is the case in the embodiment of FIG. 16) or from an internal wall (not shown) of the housing 502.

In FIG. 17, the cable connectors 500 and the inline connectors 400 are illustrated generically. Typically, each cable connector 500 would be implemented as a plug connector 500, and each inline connector 400 would be implemented as a two-sided jack connector that has first and second plug apertures. However, it will be appreciated that one or both of the cable connectors 500 could be implemented as jack connectors and one or both sides of the inline connectors 400 could be implemented as plug connectors, and thus FIG. 17 is drawn generically to make clear that all of these various implementations are within the scope of the present invention. It will be appreciated that the cable connectors 500 may include additional elements such as, for example, strain relief mechanisms or wire guide mechanisms that may, for example, facilitate maintaining the twist of the conductors 512, 522 right up to the point where the pin contacts 510, 520 are received over the conductors 512, 522. These additional components are not illustrated in FIG. 17 to simplify the drawing.

As is also shown in FIG. 17, the three inline connectors 400 may have a common housing 402. However, it will be appreciated that in other embodiments, each inline connector 400 may have a separate housing 402. In such embodiments, the three separate housings 402 may, for example, be mounted side-by-side in a frame or the like. Alternatively or additionally, the individual housings 402 may have features that allow each individual housing 402 to be mated with adjacent housing(s) 402 such as, for example, snap clips or the like. In this manner, the individual housings 402 may facilitate maintaining the connectors 400 at predetermined distances from adjacent connectors 400 in order to control the crosstalk between the connectors 400.

Figure 18:
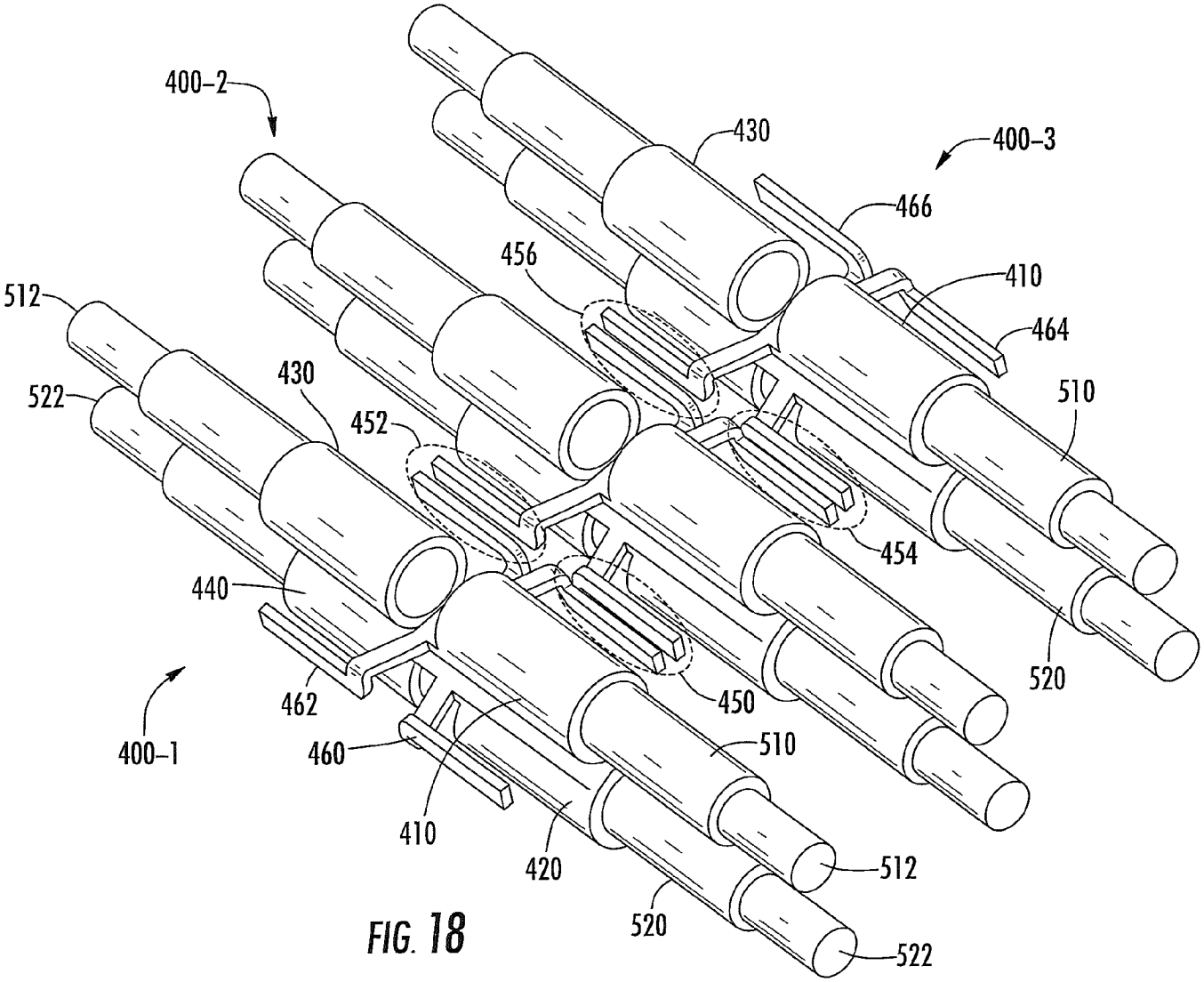
FIG. 18 is a schematic perspective view of the contact structures of the three inline connectors of FIG. 17.

Each of the inline connectors 400 includes four socket contacts 410, 420, 430, 440 (the socket contacts 440 are not visible in FIG. 17, but can be seen in FIG. 18). Socket contacts 410, 430 are longitudinally aligned with each other and may be formed from a unitary piece of metal to provide a contact that includes an input socket contact 410 and an output socket contact 430. Likewise socket contacts 420, 440 are longitudinally aligned with each other and may be formed from a unitary piece of metal to provide a contact that includes an input socket contact 420 and an output socket contact 440. Each of the socket contacts 410, 420, 430, 440 is configured to receive a respective pin contact 510 or 520 of a mating cable connector 500. For example, with respect to inline connector 400-1, socket contact 410 receives pin contact 510 of cable connector 500-1, socket contact 420 receives pin contact 520 of cable connector 500-1, socket contact 430 receives pin contact 510 of cable connector 500-4, and socket contact 440 receives pin contact 520 of cable connector 500-4. In the depicted embodiment, socket contacts 410 and 430 receive tip pin contacts while socket contacts 420 and 440 receive ring pin contacts. However, it will be appreciated that the tip and ring contact positions may be reversed.

Socket contacts 410 and 420 are vertically aligned, as are socket contacts 430 and 440. Additionally, in each inline connector 400, socket contact 410 is electrically connected to socket contact 430 to form a first tip conductive path through the inline connector 400, and socket contact 420 is electrically connected to socket contact 440 to form a first ring conductive path through the inline connector 400. Accordingly, each inline connector 400 may be used to electrically connect tip pin contact 510 of one of the cable connectors 500 to the tip pin contact 510 of another of the cable connectors 500, and electrically connect the ring pin contact 520 of one of the cable connectors 500 to the ring pin contact 520 of another of the cable connectors 500.

Figure 19:
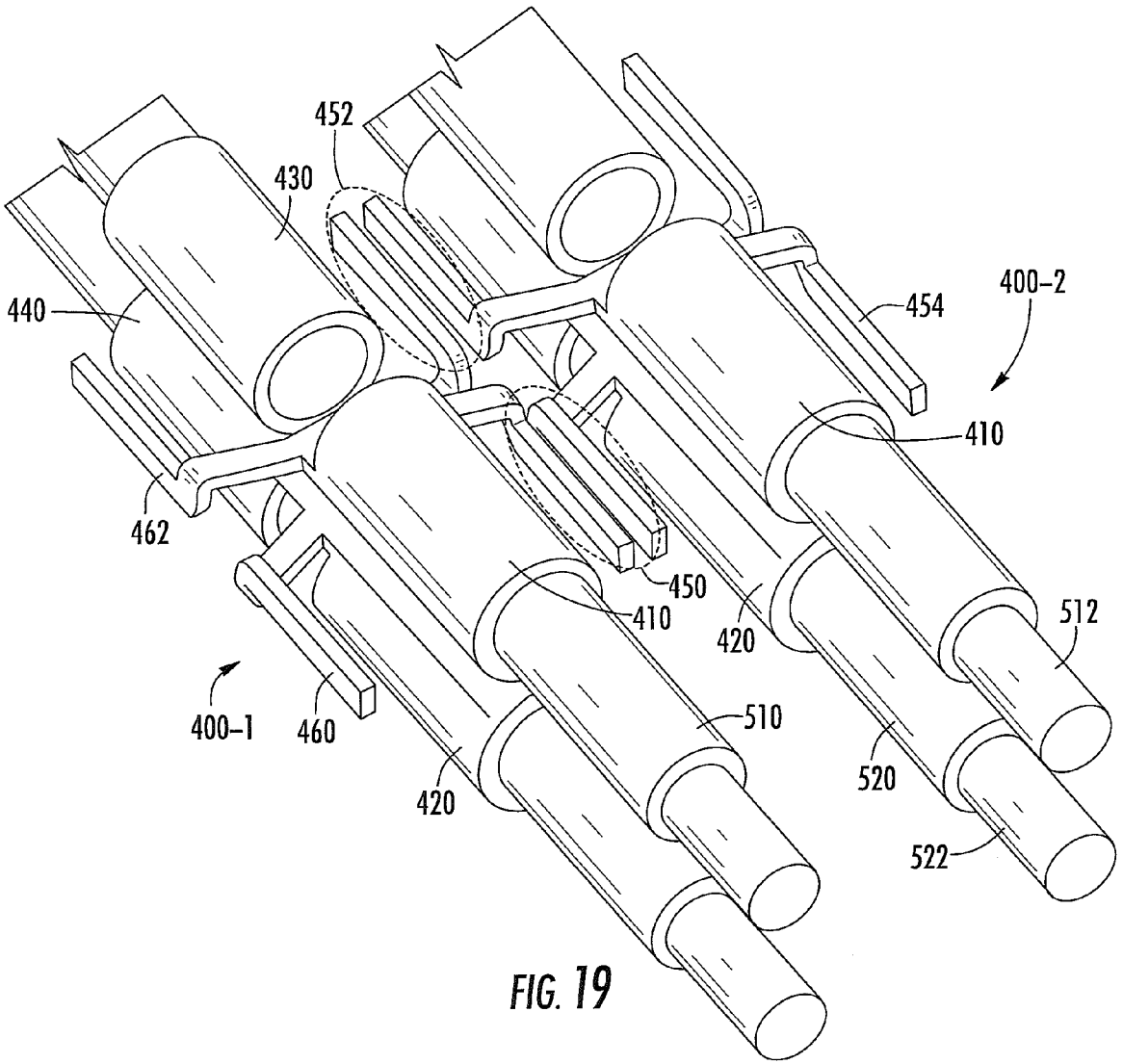
FIG. 19 is an enlarged view of a portion of the contact structures of FIG. 18.
Figure 19A:
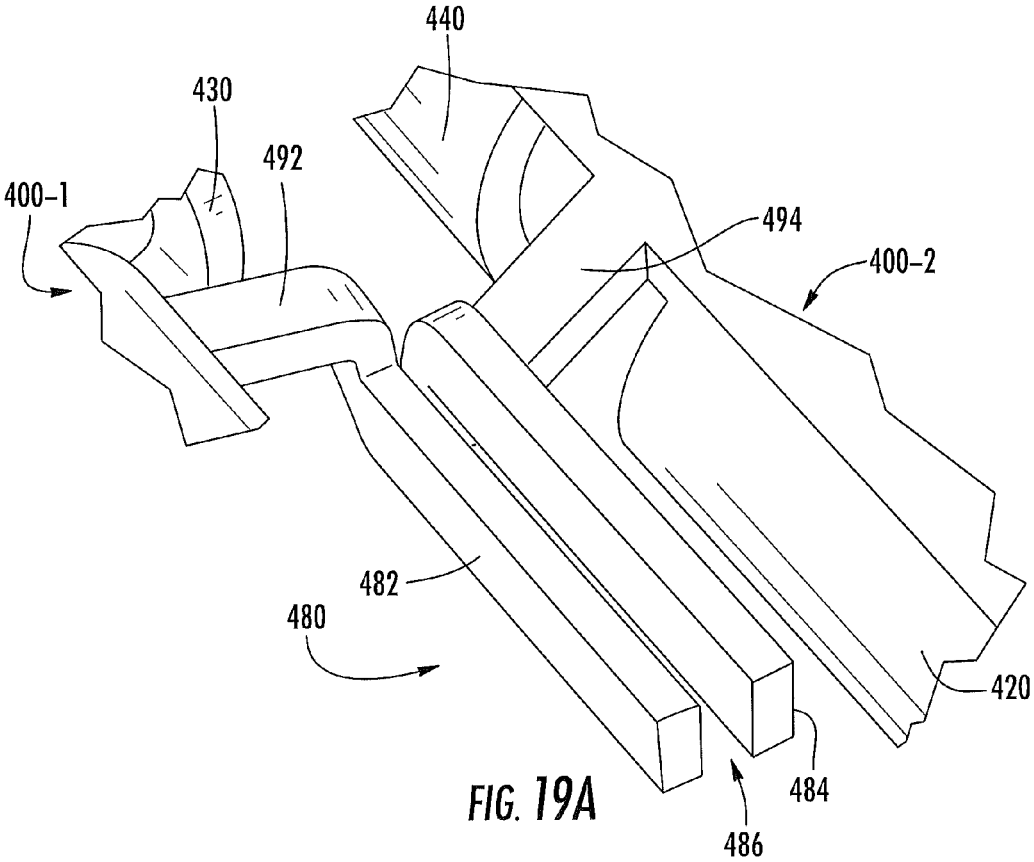
FIG. 19A is an enlarged view of a crosstalk compensation circuit included in the inline connectors of FIG. 17.
Figure 20:
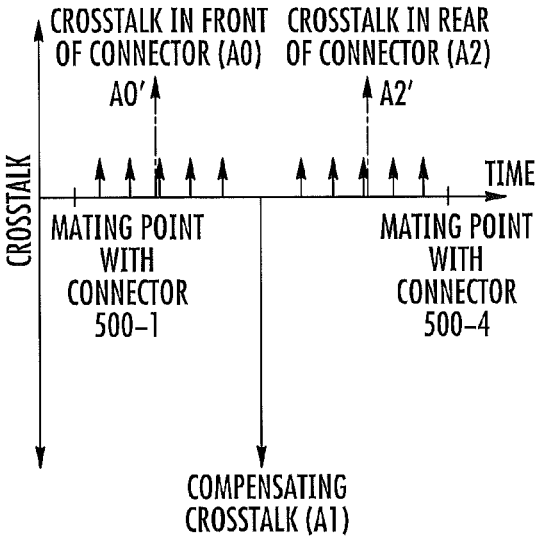
FIG. 20 is a vector diagram illustrating the crosstalk compensation scheme for canceling the offending crosstalk coupled from the conductive paths of a first of the inline connectors onto the conductive path of a second of the inline connectors of FIG. 17.
Figure 21:
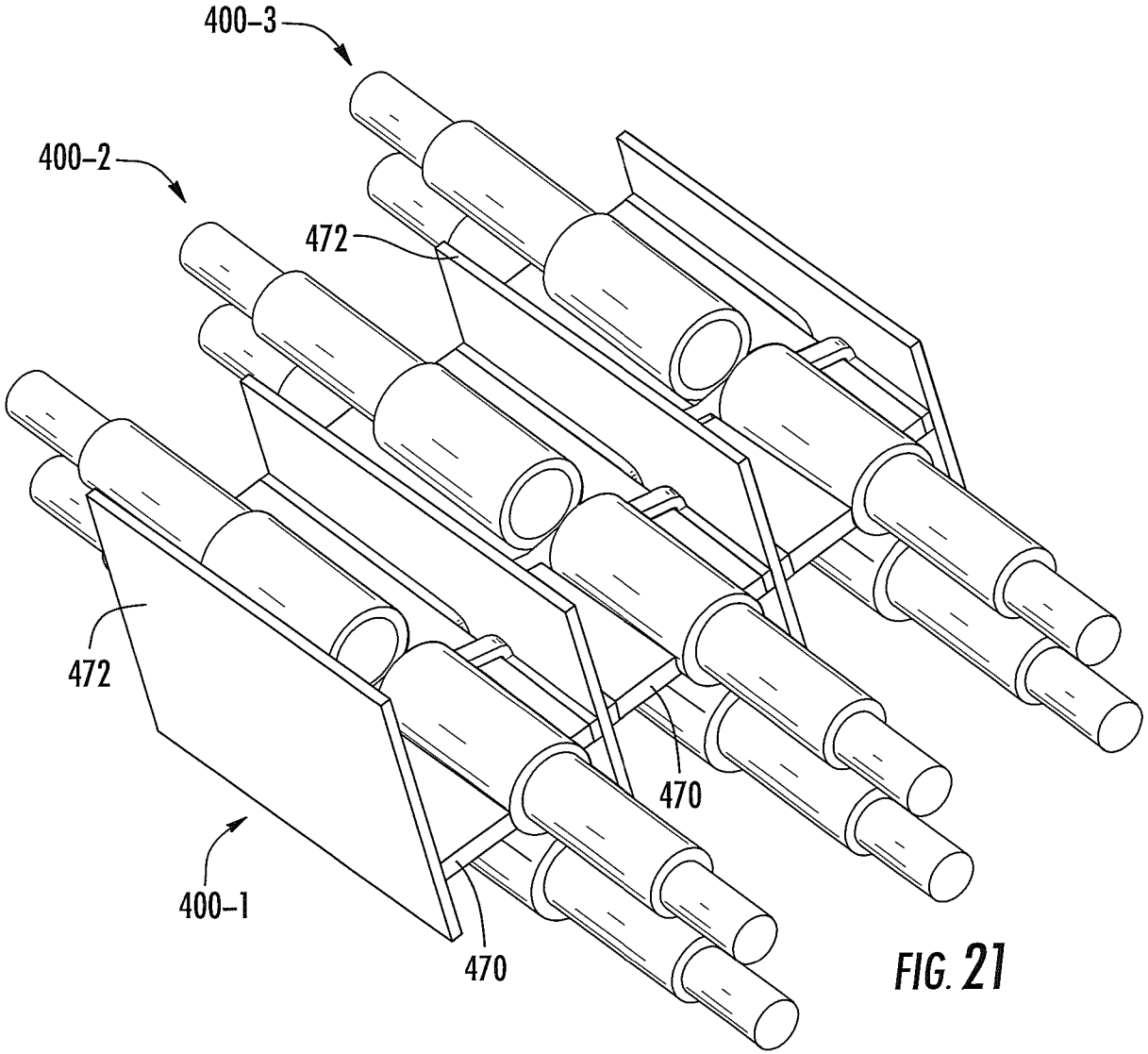
FIG. 21 is a schematic perspective view of the three inline connectors of FIG. 17 with the connector housings omitted that illustrates the positions of the dielectric spacers that may be included in each connector.

FIG. 18 is a schematic perspective view of the three inline connectors 400 and the six mating cable connectors 500 of FIG. 17 with the connector housings omitted to more clearly illustrate the pin and socket connections. FIG. 19 is an enlarged view of several of the pin and socket connections of FIG. 18. FIG. 19A is an enlarged view of a crosstalk compensation circuit included in the inline connectors 400. FIG. 20 is a schematic vector diagram illustrating the crosstalk from the tip conductive path of a first of the inline connectors 400 of FIG. 17 onto the tip conductive path of a second of the inline connectors 400 of FIG. 17. FIG. 21 is a schematic perspective view of the three inline connectors 400 of FIG. 17 with the connector housings omitted but with dielectric spacers included to illustrate how the dielectric spacers may be used in some embodiments.

As shown in FIGS. 18 and 19, the socket contacts of adjacent connectors (e.g., socket contact 410 of connector 400-1 and socket contact 410 of connector 400-2) may be positioned very close to each other. Moreover, as is also apparent from FIGS. 18 and 19, the tip and ring conductive paths of each communications channel will couple unevenly onto the tip and ring conductive paths of each adjacent communications channel. For example, tip socket contact 410 of inline connector 400-1 (and tip pin contact 510 of cable connector 500-1 that is received therein) will couple more signal energy to tip socket contact 410 of adjacent inline connector 400-2 than will be coupled onto ring socket contact 420 of adjacent inline connector 400-2 due to the differing distances from tip socket contact 410 of connector 400-1 to tip and ring socket contacts 410 and 420 of connector 400-2. This differential coupling appears as near-end crosstalk on any communications signal being transmitted through inline connector 400-2. Similarly, ring socket contact 420 of inline connector 400-1 (and ring pin contact 520 of cable connector 500-1) will couple more signal energy to ring socket contact 420 of adjacent inline connector 400-2 than will be coupled onto tip socket contact 410 of adjacent inline connector 400-2 due to the differing distances from ring socket contact 420 of connector 400-1 to the tip and ring socket contacts 410 and 420 of connector 400-2. This differential coupling also appears as near-end crosstalk on any communications signal being transmitted through inline connector 400-2. The exact same differential coupling will be injected from tip and ring socket contacts 430 and 440 of inline connector 400-1 to tip and ring socket contacts 430 and 440 of adjacent inline connector 400-2. The differential coupling will also occur in the reverse direction (i.e., the conductive paths through inline connector 400-2 will inject near-end crosstalk onto the conductive paths through inline connector 400-1), and differential coupling will also occur between inline connectors 400-2 and 400-3 (in both directions). The near-end and far-end crosstalk that results from this differential coupling can limit the data rates at which communications signals may be transmitted over the communications channels that pass through inline connectors 400-1 through 400-3.

In order to reduce the impact of this differential coupling, a plurality of crosstalk compensation circuits are provided that extend between the adjacent inline connectors 400. In particular, as shown in FIG. 18, first and second crosstalk compensation circuits 450, 452 are disposed between inline connector 400-1 and inline connector 400-2, and third and fourth crosstalk compensation circuits 454, 456 are disposed between inline connector 400-2 and inline connector 400-3. Additionally portions of four additional crosstalk compensation circuits 460, 462, 464, 466 are provided. These additional crosstalk compensation circuits 460, 462, 464, 466 will provide crosstalk compensation if additional inline connectors are placed on the sides of inline connectors 400-1 and 400-3 that are opposite inline connector 400-2.

As shown in FIGS. 18 and 19, each crosstalk compensation circuit 450, 452, 454, 456 may be implemented as a capacitor that extends between the tip conductive path of one of the inline connectors 400 and a ring conductive path of an adjacent inline connector 400. For example, crosstalk compensation circuit 450 comprises a first capacitor that couples signal energy between the tip conductive path of inline connector 400-1 (i.e., socket contact 410) and the ring conductive path of inline connector 400-2 (i.e., socket contact 420) and crosstalk compensation circuit 452 comprises a second capacitor that couples signal energy between the tip conductive path of inline connector 400-2 and the ring conductive path of inline connector 400-1. Similarly, crosstalk compensation circuit 454 comprises a first capacitor that couples signal energy between the tip conductive path of inline connector 400-2 and the ring conductive path of inline connector 400-3, and crosstalk compensation circuit 456 comprises a second capacitor that couples signal energy between the tip conductive path of inline connector 400-3 and the ring conductive path of inline connector 400-2. While two crosstalk compensation circuits are provided between each of the adjacent inline connectors 400, it will be appreciated that in other embodiments only a single crosstalk compensation circuit may be provided between adjacent inline connectors 100, and that in still further embodiments more than two crosstalk compensation circuits may be provided between adjacent inline connectors 400.

As shown in FIGS. 19 and 19A, each crosstalk compensation circuit 450, 452, 454, 456 may be implemented as a capacitor 480 which extends between a first inline connector (e.g., connector 400-1) and a second inline connector (e.g., connector 400-2). The capacitors 480 each include a first electrode 482 and a second electrode 484. In some embodiments, the first and second electrodes 482, 484 may be separated by a dielectric spacer 486, while in other embodiments, the housing of one or both of the inline connectors 400-1, 400-2 or air may serve as the capacitor dielectric 486. Other capacitor dielectrics may also be used. A first arm 492 may be used to hold the first electrode 482 in place. The first arm 492 connects to the double-sided tip socket contact (e.g., sockets 410, 430) of the first inline connector 400-1. Compensating crosstalk is thus injected onto a signal that is carried through the first inline connector 400-1 at the location where the first arm 492 connects to the double-sided tip socket contact 410, 430. As is discussed below, this location may be selected to provide improved performance. Similarly, a second arm 494 may be used to hold the second electrode 484 in place. The second arm 494 connects to the double-sided ring socket contact (e.g., sockets 420, 440) of the second inline connector 400-2. Compensating crosstalk is thus injected onto a signal that is carried through the first inline connector 400-1 at the location where the first arm 492 connects to the double-sided socket contact 410, 430. While FIG. 19A illustrates one possible capacitor design, it will be appreciated that any appropriate capacitor design may be used.

In some embodiments, crosstalk compensation circuit 450 may be designed to couple an amount of energy between the tip conductive path of inline connector 400-1 and the ring conductive path of inline connector 400-2 that is equal to half the amount of near-end crosstalk that is coupled between inline connector 400-1 and inline connector 400-2. Likewise, crosstalk compensation circuit 452 may be designed to couple an amount of energy between the ring conductive path of inline connector 400-1 and the tip conductive path of inline connector 400-2 that is equal to half the amount of near-end crosstalk that is coupled between inline connector 400-1 and inline connector 400-2. Thus, together crosstalk compensation circuits 450, 452 may inject compensating near-end crosstalk that has approximately the same magnitude as the near-end crosstalk that is coupled between inline connector 400-1 and inline connector 400-2.

In the embodiment of FIGS. 17-19, the offending crosstalk primarily comprises inductive offending crosstalk that arises because the magnetic field that is generated when a signal traverses the tip conductive path of one of the inline connectors (e.g., inline connector 400-1) will couple more heavily onto the tip conductive path of the adjacent inline connector (here inline connector 400-2) than it will to the ring conductive path of inline connector 400-2, due to the greater physical separation between the adjacent tip and ring conductive paths as compared to adjacent tip conductive paths. In some embodiments, this offending crosstalk may occur at a fairly constant level as the signal travels from one end of a mated inline connector (e.g., the end of inline connector 400-1 that mates with cable connector 500-1) to the other end of the mated inline connector (e.g., the end of inline connector 400-1 that mates with cable connector 500-4). It will be appreciated that while the near-end crosstalk that arises in the inline connectors 400 primarily comprises inductive crosstalk, that some amount of capacitive crosstalk will also be generated. It will also be appreciated that in other connector designs the amount of capacitive crosstalk may exceed the amount of inductive crosstalk.

In the embodiment of FIGS. 17-19, the crosstalk compensation circuits 450, 452, 454, 456 inject compensating crosstalk at approximately the "weighted midpoint" of the region where the offending near-end crosstalk is generated between adjacent inline connectors 400. In particular, offending near-end crosstalk may be generated along the entire length of the adjacent inline connectors 400. The "midpoint" of this offending crosstalk region is the location where a signal will be when it has travelled halfway across the region where the offending near-end crosstalk is generated. In a connector system where the connectors are symmetrical (such as the connector system of FIGS. 17-19), the weighted midpoint will be the actual midpoint of each inline connector 400. However, if the connector system is not symmetrical, then more offending crosstalk may be generated on one end of the connector system than the other. In this case, the location where the compensating crosstalk is injected may be repositioned to the "weighted midpoint" so that approximately half of the offending crosstalk is injected on one side of this location (e.g., in a first crosstalk region) and the other half of the offending crosstalk is injected on the other side of the location (e.g., in a second crosstalk region).

By injecting the compensating crosstalk at the weighted midpoint of the offending near-end crosstalk generation region it may be possible to achieve improved crosstalk cancellation. In particular, improved crosstalk cancellation can typically be achieved if the compensating crosstalk signal is injected electrically closer to the location at which the offending crosstalk is generated, as any delay between the offending crosstalk signal and the compensating crosstalk signal acts to degrade the effectiveness of the crosstalk compensation, particularly for higher frequency signals. The manner in which delay may degrade the effectiveness of crosstalk compensation circuits is discussed in detail in U.S. Pat. No. 5,997,358 ("the '358 patent"), the entire contents of which is incorporated by reference as if set forth in its entirety herein.

By injecting the compensating crosstalk at the weighted midpoint of the offending near-end crosstalk generation region, the delay between the location where the offending crosstalk and the compensating crosstalk are injected may be reduced. As shown in FIG. 20, with respect to crosstalk injected from the tip conductive path of inline connector 400-1 onto the tip conductive path of inline connector 400-2, the offending crosstalk may be viewed as a series of small crosstalk vectors that extend all the way along the tip conductive path of inline connector 400-2. The compensating crosstalk vector may be viewed as a large vector at the midpoint of tip conductive path through inline connector 400-2 that has a polarity opposite each of the small offending crosstalk vectors and that has a magnitude that is approximately equal to the sum of the small offending crosstalk vectors.

Each of the inline connectors 400 may be viewed as implementing a multistage crosstalk compensation scheme. Such compensation schemes are discussed in detail in the aforementioned '358 patent. As shown in FIG. 20, the crosstalk injected from inline connector 400-1 to 400-2 may be viewed as an offending crosstalk stage A0 that extends from the input of the connector 400-1 that mates with cable connector 500-1 to the approximate midpoint of the tip conductive path through inline connector 400-2. This offending crosstalk comprises distributed inductive coupling along with a smaller amount of distributed capacitive coupling. This distributed offending crosstalk may be represented by a single vector A0' at the weighted midpoint of the coupling region, as shown in FIG. 20. A first compensating crosstalk stage A1 in the form of crosstalk compensation circuits 450 and 452 is provided at the midpoint of the tip conductive path through inline connector 400-2. The magnitude of the first offending crosstalk stage A1 may be approximately twice the magnitude of the offending crosstalk vector A0'. The offending crosstalk that extends from the approximate midpoint of the tip conductive path through the inline connector 400-2 to the input of the connector 400-1 that mates with cable connector 500-4 may serve as a second compensating crosstalk stage A2. The second compensating crosstalk stage A2 comprises distributed inductive coupling along with a smaller amount of distributed capacitive coupling. This distributed offending crosstalk may be represented by a single vector A2' at the weighted midpoint of the coupling region, as shown in FIG. 20.

FIG. 21 is a schematic perspective view of the three inline connectors of FIG. 17 with the connector housing 402 omitted, but with the dielectric spacers included to illustrate how such dielectric spacers may be used to precisely control both the impedance of the transmission lines through each inline connector 400 and the crosstalk that is coupled between adjacent inline connectors 400. In particular, horizontal dielectric spacers 470 may be provided that separate the tip sockets 410, 430 from the ring sockets 420, 440 in each inline connector 400. The housing 402 may comprise a two piece housing, and the horizontal spacers 470 may be placed between the two housing pieces. The thickness of the horizontal dielectric spacers 470 and the dielectric constants thereof may be selected to maintain the impedance of the transmission line formed of the tip conductive path and the ring conductive path through each inline connector 400 at a desired level (e.g., 100 ohms). This may improve the overall return loss performance of the inline connectors 400. It will be appreciated, though, that other structures in the connector (e.g., the compensating crosstalk circuits 450, 452, 454, 456 may impart loads on the transmission lines that may cause the impedance to differ from a desired value. Moreover, to the extent that the horizontal dielectric spacers 470 increase coupling between the tip sockets 410, 430 and the ring sockets 420, 440 in each inline connector 400, they may reduce crosstalk between adjacent connectors, since the increased coupling between the tip and ring sockets of a connector may reduce coupling with adjacent connectors.

A plurality of vertical spacers 472 may also be provided, particularly in embodiments in which the three inline connectors 400 are enclosed by a common housing 402. The vertical dielectric spacers 472 may be used to ensure that the capacitor electrodes 482, 484 of each compensating crosstalk circuit 450, 452, 454, 456, 460, 462, 464, 466 are not inadvertently short-circuited, and to precisely maintain the amount of coupling generated by each capacitor 480 by controlling both the distance between the capacitor electrodes 482, 484 and the dielectric constant of the material between the electrodes 482, 484 of each capacitor 480. In the embodiment of FIG. 21, a single vertical dielectric spacer 472 is provided on each side of each inline connector 400. However, it will be appreciated that in other embodiments more than one vertical dielectric spacer 472 may be provided on each side of the inline connectors 400. In some embodiments, the vertical spacers 472 may be sandwiched in between the housings 402 of two adjacent connectors 400. In some embodiments, the dielectric spacers 472 may have a thickness of less than 25 mils.

In some embodiments, the size and/or shape of the vertical spacers 472 may be used to tune the inline connectors 400. In particular, the amount of compensating crosstalk injected by the crosstalk compensation circuits will vary based on the length, width and thickness of the vertical spacers 472, and based on the dielectric constant of the vertical spacers 472. For example, vertical spacers 472 having different dielectric constants can be tested in a particular inline connector design to fine-tune the amount of compensation provided in order to optimize the performance of the inline connector 400.

The inline connectors 400 may have a very small form factor. For example, in some embodiments, the center-to-center vertical spacing between the socket contacts of a pair (e.g., socket contacts 410 and 420) may be on the order of 50 mils. Likewise, the center-to-center horizontal spacing between tip contacts of adjacent connectors may be on the order of 100 mils to meet Category 6a internal near and far end crosstalk requirements, or on the order of 200 to 250 mils to meet Category 6a alien near and far end crosstalk requirements. Thus, the connectors may have a very small form factor. Moreover, even with these small form factors the inline connectors may easily meet the specifications for near-end crosstalk performance, far-end crosstalk performance and return loss set forth in the Category 6a standard. The inline connectors 400 are also highly balanced, and hence exhibit only minimal mode-conversion. Accordingly, these connectors may also provide very good channel performance.

Figure 22:
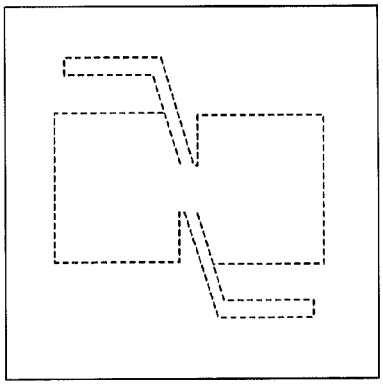
FIG. 22 is a plan view of a blank of sheet metal that illustrates how the metal may be stamped (and subsequently rolled) to form a pair of socket contacts that may be used in connectors according to embodiments of the present invention.

In some embodiments, the sockets 410, 420, 430, 440 may be stamped and formed very inexpensively from sheet metal. In particular, as is shown in FIG. 22, a blank of metal can be stamped along the dotted lines as indicated and then rolled to form a pair of longitudinally aligned sockets (e.g., sockets 410, 430) that may be used in the inline connectors 400. Moreover, while not shown in the figures, the sockets 410, 420, 430, 440 may have internal indents that may be compliant when a pin is received within the socket, thereby maintaining a good mechanical and electrical connection, even in harsh operating environments.

While the inline connectors 400 and the cable connectors 500 are illustrated as having socket and pin contacts with round cross-sections, respectively, it will be appreciated that other socket and pin designs may be used (e.g., square cross-sections, rectangular cross-sections, etc.).

Figure 23:
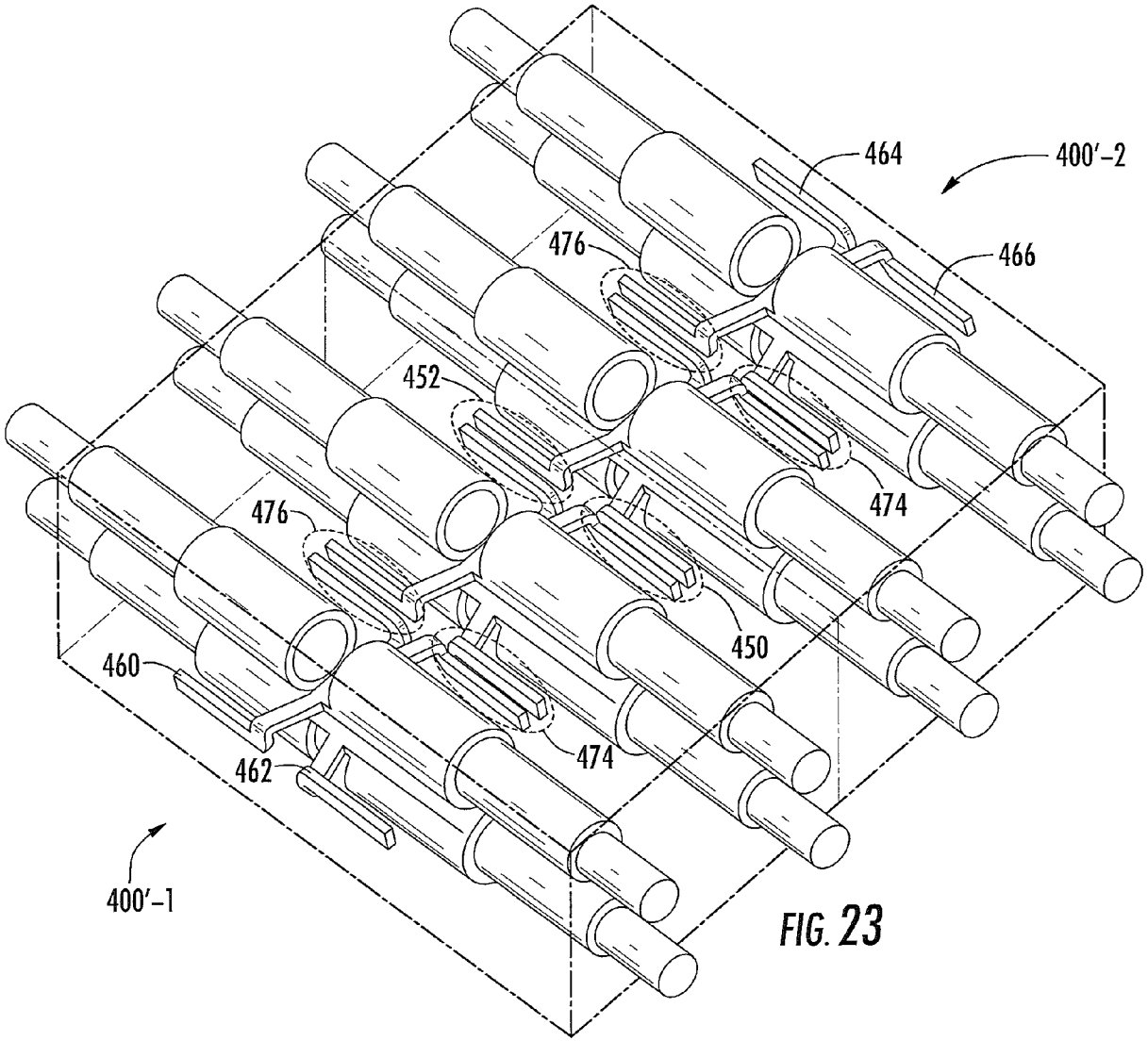
FIG. 23 is a schematic perspective view of two inline connectors according to embodiments of the present invention that each include two pairs of contacts.

FIG. 23 is a schematic perspective view of two inline connectors 400' (namely 400'-1, 400'-2) according to further embodiments of the present invention that each include two pairs of contacts. As is readily apparent, the inline connectors 400' of FIG. 23 may be almost identical to the inline connectors 400 of FIGS. 17-19 and 21, with the one difference being that the inline connectors 400 each include only a single pair of double-sided socket contacts, while the inline connectors 400' each include two pairs of double-sided socket contacts. The inline connectors 400' include crosstalk compensation circuits 450, 452, 460, 462, 464, 466 that are used to compensate for crosstalk that arises between adjacent inline connectors 400'. Additionally, each inline connector 400' includes internal crosstalk compensation circuits 474, 476 that are used to compensate for internal crosstalk that arises between the two pairs of double-sided socket contacts within each inline connector 400'. These internal crosstalk compensation circuits 474, 476 may also be identical to the crosstalk compensation circuits 450, 452, 454, 456 that are discussed above with respect to FIGS. 18 and 19, except that they provide crosstalk compensation between two pairs that are part of the same communications channel as opposed to two pairs that are part of different communications channels. While not shown in the drawings, in some embodiments the pairs of double-sided socket contacts that are included in each inline connector 400 may be spaced more closely together than the pairs of double-sided socket contacts that are in adjacent connectors 400'. This may be possible because typically the internal near-end crosstalk specifications may allow for higher levels of crosstalk than the alien near-end crosstalk specifications, as the network computer chips may compensate for some degree of internal crosstalk, but typically cannot compensate for alien crosstalk. This may allow the pairs of conductive paths within an inline connector 400 to be spaced more closely together than the pairs of conductive paths of adjacent inline connectors 400'.

Figure 24:
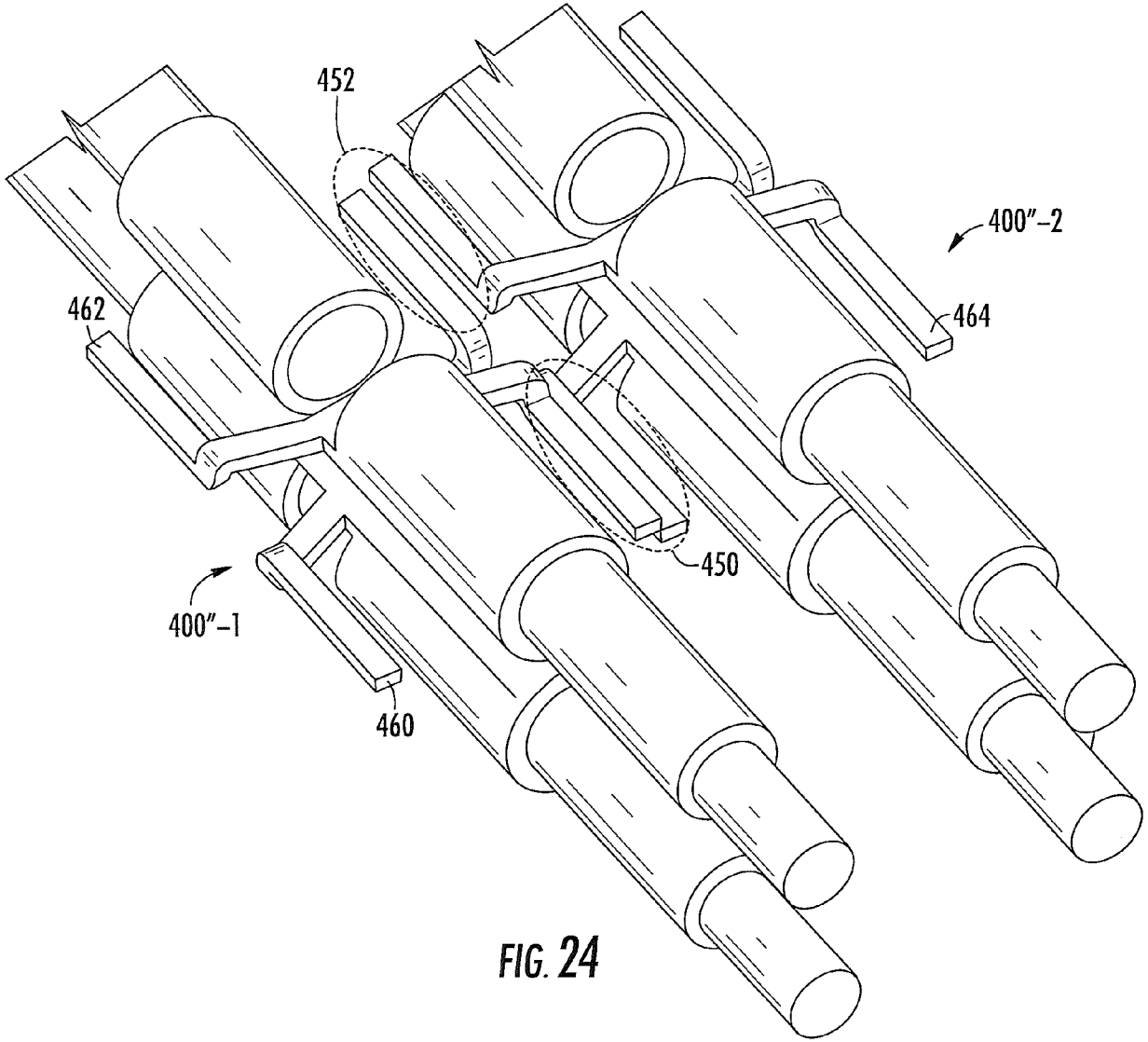
FIG. 24 is a schematic perspective view of the contact structures of two inline connectors according to further embodiments of the present invention.

FIG. 24 is a schematic perspective view of the two inline connectors 400"-1, 400"-2 according to further embodiments of the present invention with the connector housings and dielectric spacers omitted to more clearly illustrate the pin and socket connections.

As shown in FIG. 24, the inline connectors 400" may be almost identical to the inline connectors 400 that are discussed above. However, in the inline connectors 400", the crosstalk compensation circuits 450, 452, 460, 462, 464 are implemented using so-called "edge capacitors" as opposed to the plate capacitors that are used to implement the corresponding crosstalk compensation circuits that are included in the inline connectors 400. As the inline connectors 400" are otherwise identical to the inline connectors 400 that are discussed above, further description thereof will be omitted.

Figure 25:
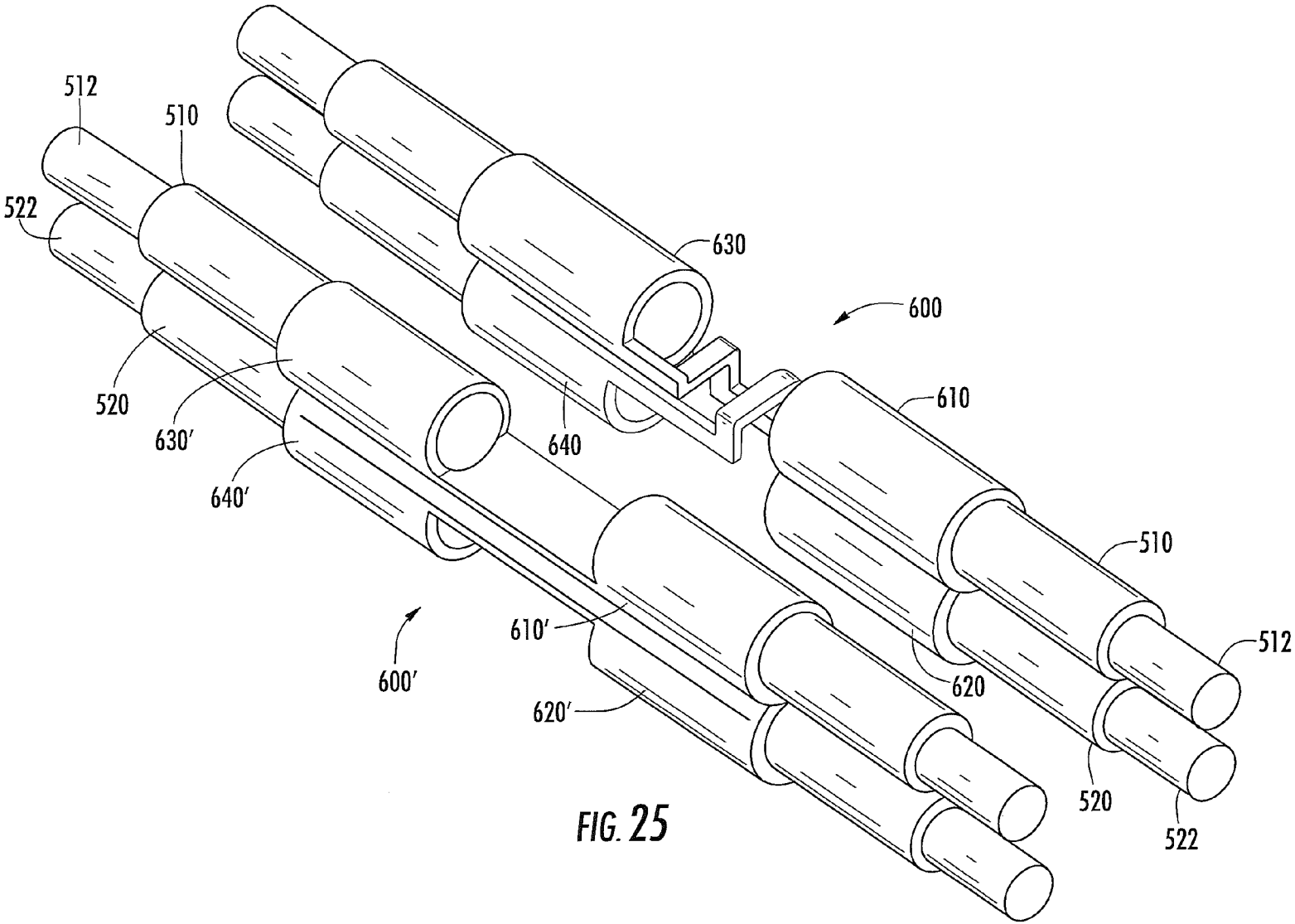
FIG. 25 is a schematic perspective view of the contact structures of two inline connectors according to still further embodiments of the present invention.

FIG. 25 is a schematic perspective view of first and second inline connectors 600, 600' according to still further embodiments of the present invention with the connector housings and dielectric spacers omitted to more clearly illustrate the pin and socket connections. As shown in FIG. 25, the inline connector 600 includes four socket contacts 610, 620, 630, 640. Socket contacts 610 and 630 are longitudinally aligned with each other, and socket contacts 620 and 640 are longitudinally aligned with each other. Each of the socket contacts 610, 620, 630, 640 is configured to receive a respective pin contact 510, 520 of a mating cable connector (only the pins 510, 520 and the conductors 512, 522 of the mating cable connectors are shown in FIG. 25). However, in contrast to the inline connector 400 that is discussed above, in the inline connector 600 the socket contact 610 is physically and electrically connected to socket contact 640, and socket contact 620 is physically and electrically connected to socket contact 630. Thus, on the right side of the inline connector 600, the tip socket contact 610 is located above the ring socket contact 630, while on the left side of the connector the tip socket contact 640 is located below the ring socket contact 620. Thus, the tip and ring conductive paths trade positions within the inline connector 600 by effecting a crossover in the middle of the connector.

The inline connector 600' also includes four socket contacts 610', 620', 630', 640'. Socket contacts 610' and 630' are longitudinally aligned with each other, and socket contacts 620' and 640' are longitudinally aligned with each other. Each of the socket contacts 610', 620', 630', 640' is configured to receive a respective pin contact 510, 520 of a mating cable connector 500. Socket contact 610' is physically and electrically connected to socket contact 630', and socket contact 620' is physically and electrically connected to socket contact 640'.

The inline connectors 600 and 600' may exhibit good crosstalk performance when positioned side-by-side in the configuration shown in FIG. 25. In particular, on the right hand side of FIG. 25, offending crosstalk will be generated because the tip socket contact 610 will couple more heavily with the tip socket contact 610' than it will with the ring socket contact 620', and because the ring socket contact 620 will couple more heavily with the ring socket contact 620' than it will with the tip socket contact 610'. However, on the left side of FIG. 25, the tip socket contact 640 will couple more heavily with the ring socket contact 640' than it will with the tip socket contact 630', and the ring socket contact 630 will couple more heavily with the tip socket contact 630' than it will with the ring socket contact 640'. Thus, "compensating" crosstalk will be generated on the left side of the connector pair illustrated in FIG. 25 that may substantially cancel the "offending" crosstalk that is generated on the right side of the pair of connectors 600, 600' illustrated in FIG. 25. As a result, the crosstalk compensation circuits 450, 452, 454, 456 that are included in the inline connectors 400 of FIGS. 17-19 and 21 may be omitted in the inline connectors 600 and 600' of FIG. 25. Note that a plurality of inline connectors 600 and 600' may be aligned in a row, with the connectors 600 and 600' alternating positions along the row (i.e., every other connector will have the connector 600 design).

Figure 26:
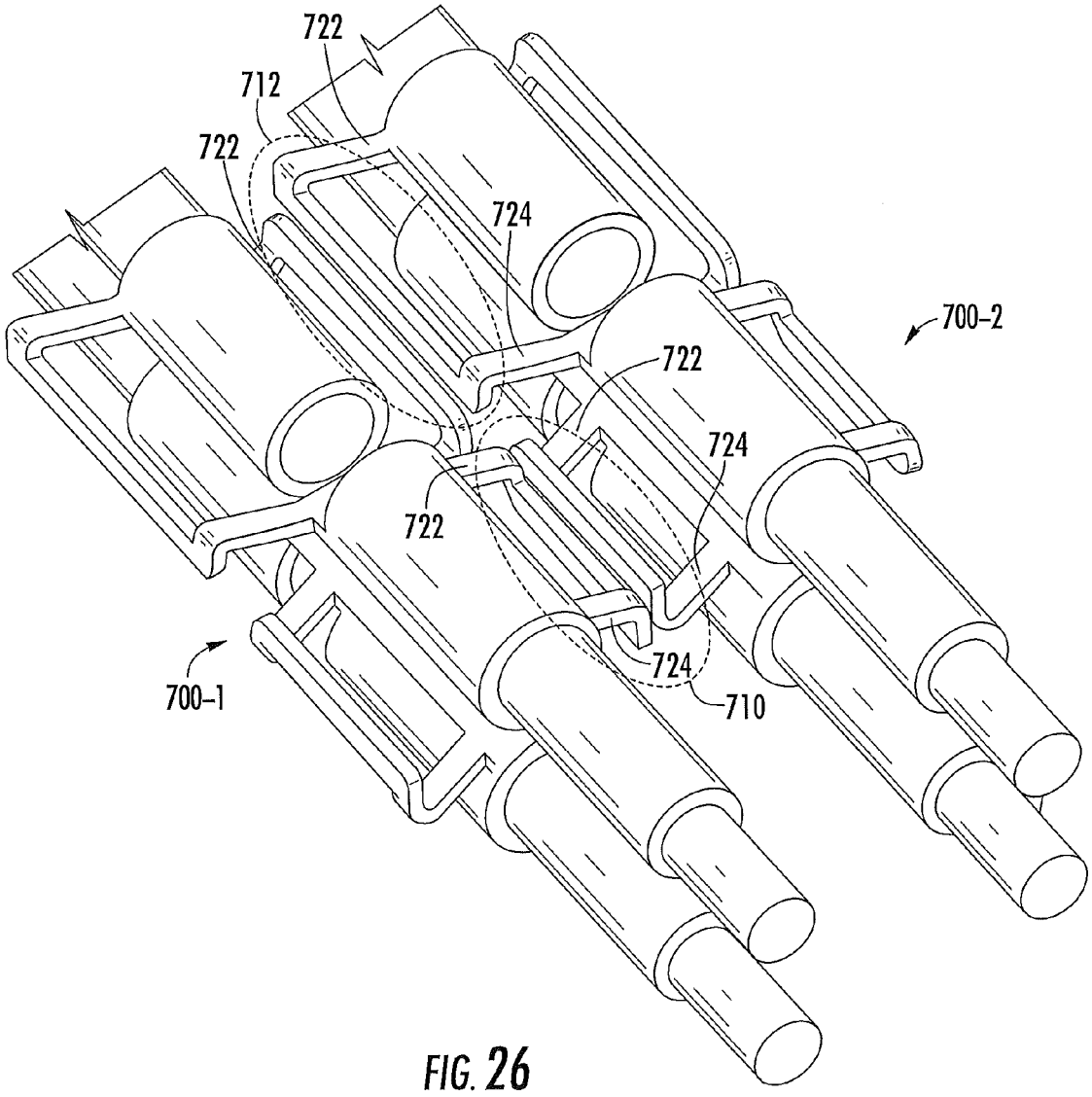
FIG. 26 is a schematic perspective view of the contact structures of two inline connectors according to additional embodiments of the present invention.

FIG. 26 is a schematic perspective view of two inline connectors 700-1, 700-2 according to still further embodiments of the present invention. In FIG. 26 the connector housings and dielectric spacers have been omitted to more clearly illustrate the pin and socket connections. The inline connectors 700 are similar to the inline connectors 400 discussed above. However, instead of using purely capacitive crosstalk compensation, the inline connectors 700 include crosstalk compensation circuits such as circuits 710, 712 that will generate both capacitive and inductive crosstalk compensation. In particular, in the inline connectors 700, each electrode of the capacitors used to form the crosstalk compensation circuits 710, 712 is connected by both a first arm 722 and a second arm 724 to the double-sided socket contact structures. As a result, each crosstalk compensation circuit 710, 712 will provide a second signal carrying path for signals that are carried through the connector 700. Thus, in addition to capacitive coupling, each crosstalk compensation circuit 710, 712 will also generate inductive coupling that may be used to cancel the crosstalk that is generated in the connector 700. Note that in some embodiments the connecting sections between longitudinally-aligned sockets may be omitted so that the current flows solely between longitudinally-aligned sockets via the crosstalk compensation circuits 710, 720. By balancing the amount of inductive crosstalk compensation with the amount of capacitive crosstalk compensation that is generated it is possible to simultaneously cancel both the near-end crosstalk and the far-end crosstalk to a high degree. This may allow separating the inline connectors 700 by smaller distances while still meeting all crosstalk and return loss specifications or goals. Additionally, the compensating crosstalk may be injected at a smaller average delay, which may result in more effective crosstalk compensation.

Figure 27:
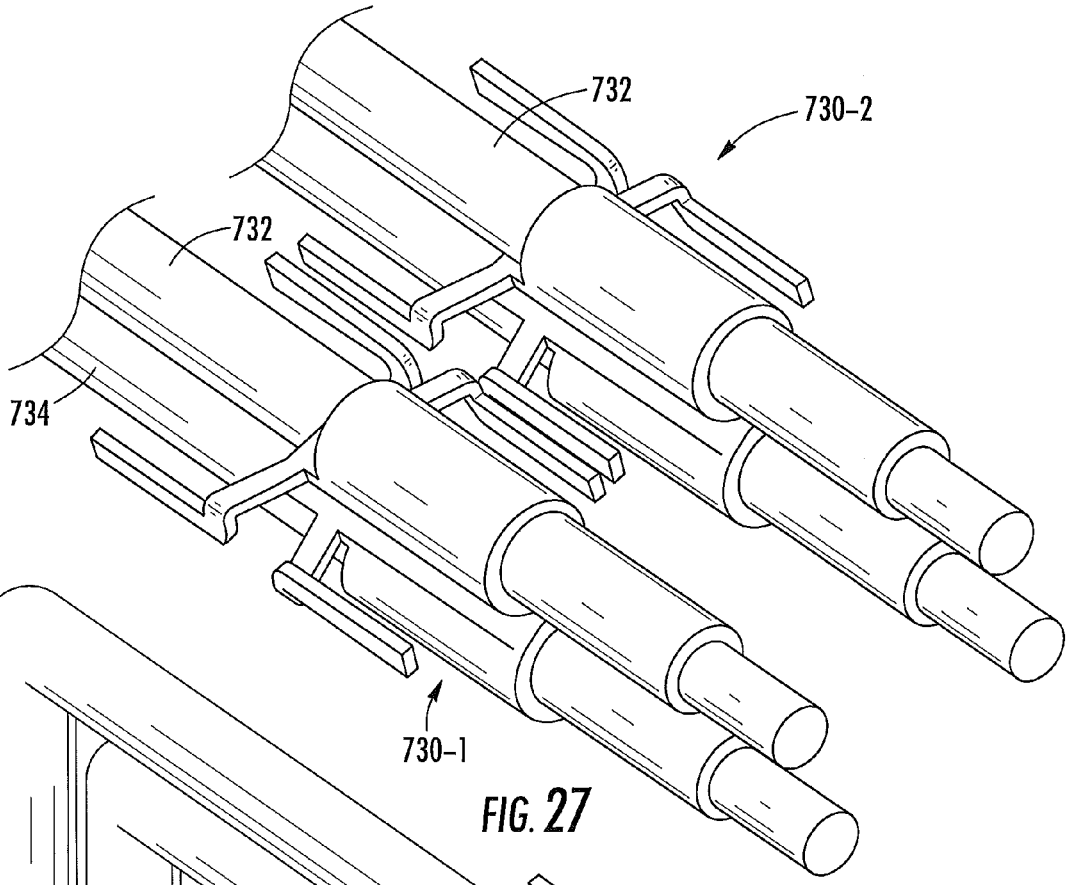
FIG. 27 is a schematic perspective view of the contact structures of two inline connectors according to still further embodiments of the present invention.
Figure 28:
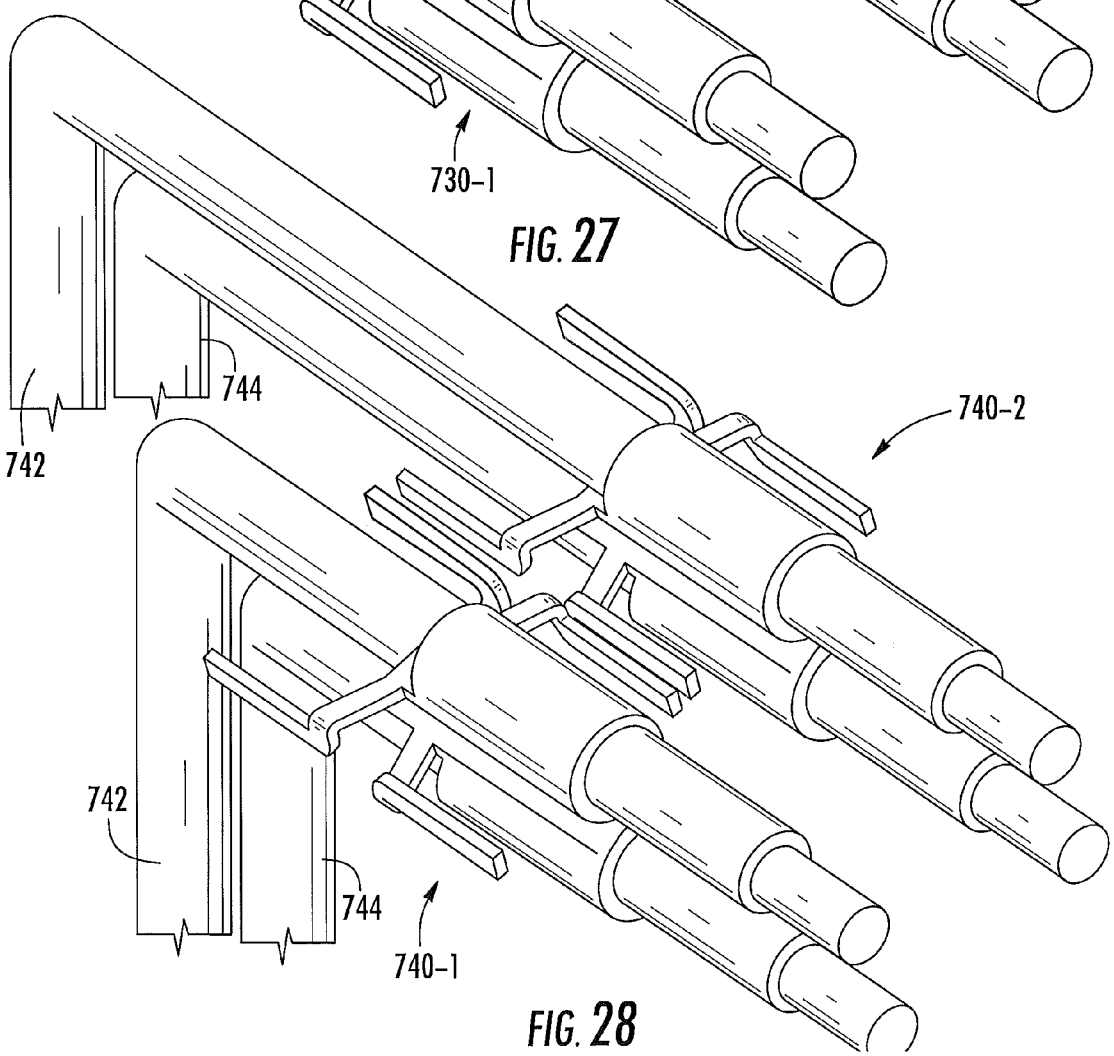
FIG. 28 is a schematic perspective view of the contact structures of two inline connectors according to yet further embodiments of the present invention.

While embodiments of the present invention may provide inline connectors, it will be appreciated that the same concepts discussed above may also be used to provide printed circuit board mounted connectors that exhibit excellent crosstalk and return loss performance. FIGS. 27 and 28 illustrate examples of such printed circuit board connectors.

In particular, FIG. 27 is a schematic perspective view of the two printed circuit board mounted connectors 730-1, 730-2 according to still further embodiments of the present invention. In FIG. 27, the connector housings and dielectric spacers of the connectors 730 have been omitted to more clearly illustrate the pin and socket connections. As shown in FIG. 27, the right half of each inline connector 730 may be identical the right half of the inline connectors 400 discussed above with respect to FIGS. 17-21. However, the socket contacts 430, 440 that are included in the inline connectors 400 are replaced in the inline connectors 730 with conductive pins 732, 734 that are suitable for mounting in a printed circuit board (not shown).

FIG. 28 is a schematic perspective view of the two inline connectors 740-1, 740-2 according to still further embodiments of the present invention with the connector housings and dielectric spacers omitted to more clearly illustrate the pin and socket connections. The inline connectors 740 are identical to the inline connectors 730 of FIG. 27, except that the straight conductive pins 732, 734 of connectors 730 are replaced with right-angled conductive pins 742, 744. It will be appreciated that the crosstalk compensation circuits in the connectors 730 and 740 of FIGS. 27 and 28 would be sized to provide compensating crosstalk signals that substantially cancel the offending crosstalk that is generated in the connectors.

Figure 29:
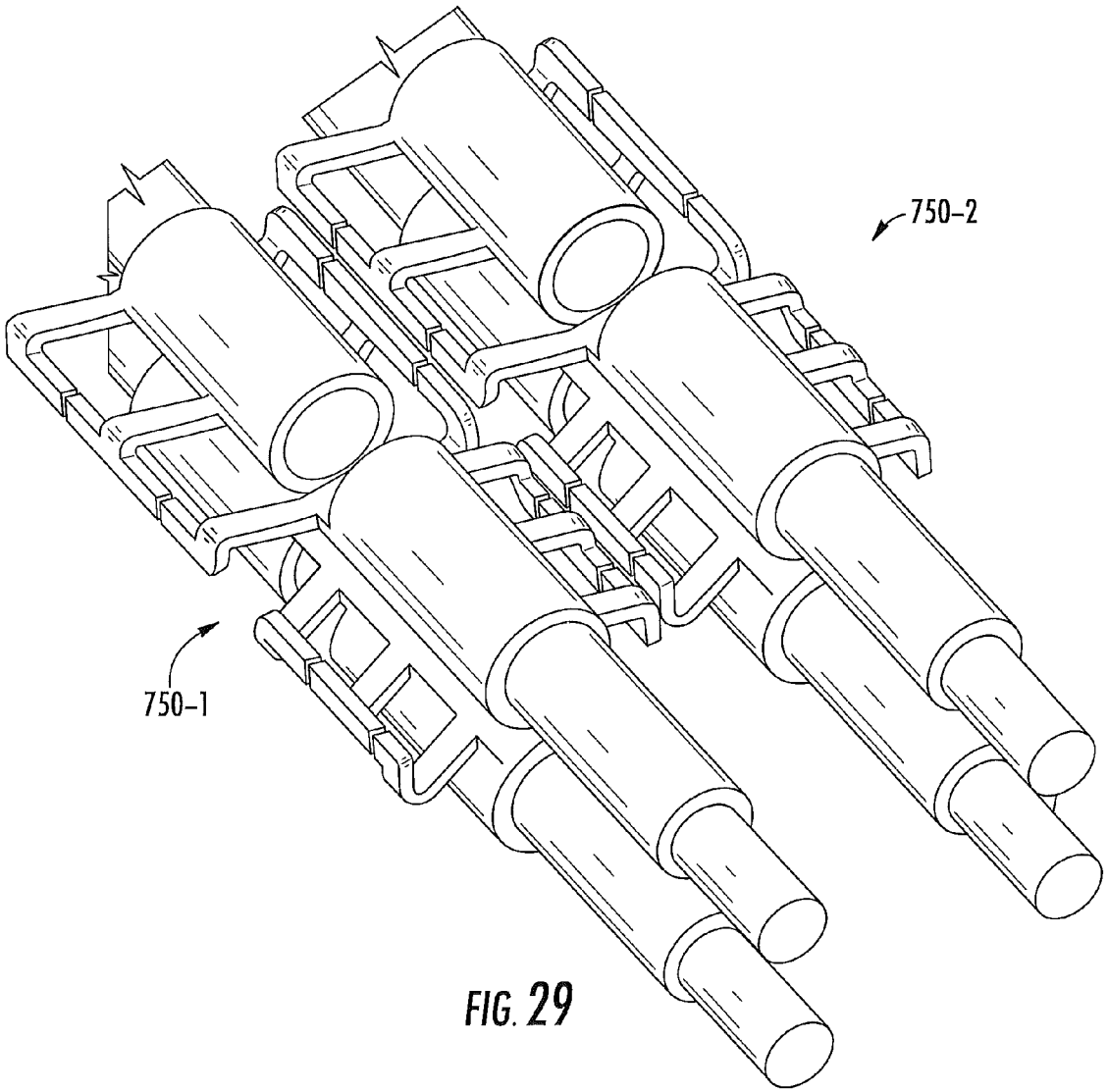
FIG. 29 is a schematic perspective view of two inline connectors according to still further embodiments of the present invention.

In further embodiments, a series of crosstalk compensation circuits may be provided in place of each of the crosstalk compensation circuits 450, 452 that are included in the connector of FIGS. 17-19 and 21. In particular, FIG. 29 is a schematic perspective view of two inline connectors 750-1, 750-2 according to still further embodiments of the present invention. In FIG. 29 the connector housings and dielectric spacers have been omitted to more clearly illustrate the pin and socket connections. The inline connectors 750 are similar to the inline connectors 400 discussed above. However, each crosstalk compensation capacitor has been replaced with a series of capacitors. Moreover, the arms that connect these capacitors to the socket contacts do so along the lengths of the socket contacts, and thereby inject the compensating crosstalk as a series of small, time-delayed vectors. This may allow the compensating crosstalk to be injected with even less delay as compared to the inline connectors 400, and hence may provide improved performance.

While the connectors in the above embodiments use pin and socket contacts, it will be appreciated that other contact structures may be used. For example, in other embodiments, the pin contacts could be replaced with blade contacts, and the socket contacts could be replaced with a wide-variety of spring contacts that each exert a contact force against a mating blade. In still other embodiments, both the pin and socket contacts could be replaced with insulation displacement contacts.

Figure 30:
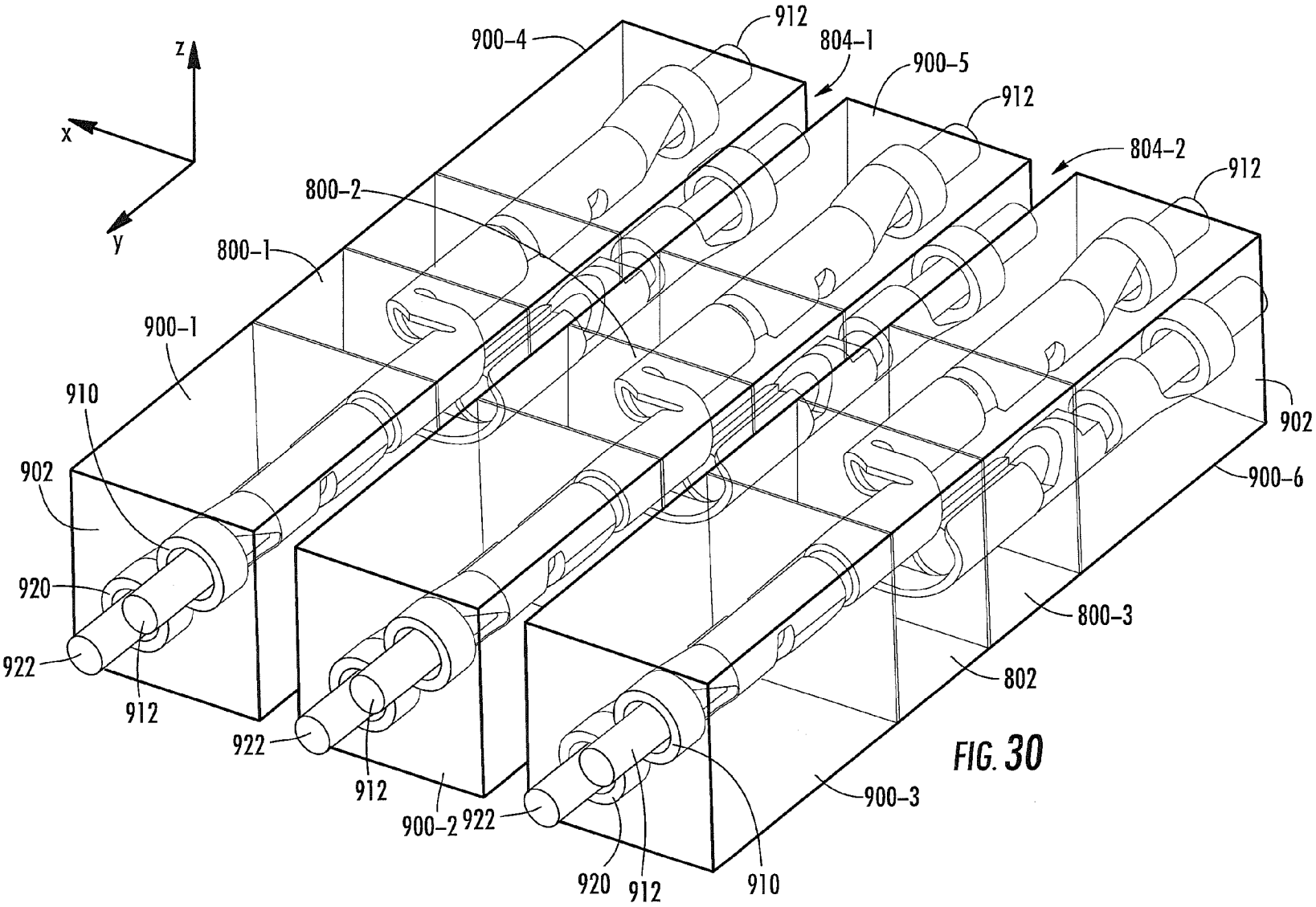
FIG. 30 is a schematic perspective view of three inline connectors according to still further embodiments of the present invention, where each inline connector is mated with two corresponding cable connectors.

FIG. 30 is a schematic perspective view of three inline connectors 800-1, 800-2, 800-3 according to further embodiments of the present invention that are mated with cable connectors of six connectorized cables. In particular, in FIG.

30, inline connector 800-1 is mated with cable connectors 900-1, 900-4, inline connector 800-2 is mated with cable connectors 900-2, 900-5, and inline connector 800-3 is mated with cable connectors 900-3, 900-6. The cable connectors 900 of FIG. 30 may generally correspond to the cable connectors 350, 350' of FIG. 15 (which are part of connectorized cables 340 and 380), and the inline connectors 800 may generally correspond to the inline connectors 360 of FIG. 15.

As shown in FIG. 30, the three inline connectors 800-1, 800-2, 800-3 may be aligned in a row adjacent to each other. In some embodiments, air gaps 804 may be provided between adjacent ones of the inline connectors 800. These air gaps 804 may help reduce capacitive coupling between the contact structures of adjacent inline connectors 800 and cable connectors 900. The tightly packed connector arrangement of FIG. 30 may minimize space requirements and provide a convenient connector interface, but may also increase coupling between the communications paths of adjacent connectors 800 and 900. In the embodiment of FIG. 30, the inline connectors 800-1, 800-2, 800-3 are implemented as three separate inline connectors that each include one communications channel. However, it will be appreciated that in other embodiments a single inline connector may be used that includes three communications channels, or two inline connectors may be used in which one includes two communications channels and the other includes a single communications channel.

As shown in FIG. 30, each cable connector 900 may have a housing 902 and first and second pin contacts 910, 920. Each pin contact 910, 920 may comprise a hollow pin that is crimped onto a bare end portion of respective insulated conductors 912, 922 of a communications cable. In other embodiments, the pin contacts 910, 920 could be soldered to the respective conductors 912, 922, connected by insulation piercing or insulation displacement contacts or by other suitable means. The conductors 912, 922 may comprise a twisted pair of conductors of a communications cable such as cable 342 of FIG. 16 (aside from the ends of conductors 912, 922, the cables are not shown in FIG. 30 to better illustrate the components of the cable connectors 900), where the insulation has been removed from the end portion that is inserted into the pin contacts 910, 920. Each pin contact 910 is a tip pin contact, and each pin contact 920 is a ring pin contact. The pin contacts 910, 920 may extend, for example, from a front face of the housing 902 or from an internal wall of the housing 902.

In FIG. 30, the cable connectors 900 and the inline connectors 800 are illustrated generically. In some embodiments, each cable connector 900 is implemented as a plug connector 900, and each inline connector 800 is implemented as a two-sided jack connector that has first and second plug apertures. However, it will be appreciated that one or both of the cable connectors 900 could, for example, be implemented as jack connectors and one or both sides of the inline connectors 800 could be implemented as plug connectors, and thus FIG. 30 is drawn generically to make clear that all of these various implementations are within the scope of the present invention. It will be appreciated that the cable connectors 900 may include additional elements such as, for example, wire guide mechanisms. Moreover, while relatively long pin contacts 910, 920 are illustrated in FIG. 30, it will be appreciated that in other embodiments much shorter pin contacts 910, 920 may be used. For example, in some embodiments, the length of each pin contact 910, 920 may be approximately equal to the length of each socket contact 810, 820, 830, 840 (see FIGS. 31-33) of the inline connectors 800.

As noted above, in some embodiments, it may be desirable to align the inline connectors 800 in one or more rows. This may, for example, facilitate mating the inline connectors 800 with the cable connectors 900 of a bundle of cables. In some embodiments, features such as, for example, snap clips, mating protrusions and recesses or other connector mechanisms (not shown) may be provided on exterior surfaces of the housings 802 of the connectors 800 that allow the housings to be connected together into a single unit. In other embodiments, a common housing (not shown) may be provided and housings 802-1, 802-2 and 802-3 may be mounted in this common housing. The use of external features on the housings 802, a second common housing or other mechanisms may be employed in some embodiments in order to maintain the inline connectors 800 at predetermined separations that facilitate controlling crosstalk coupling between the inline connectors 800.

Figure 31:
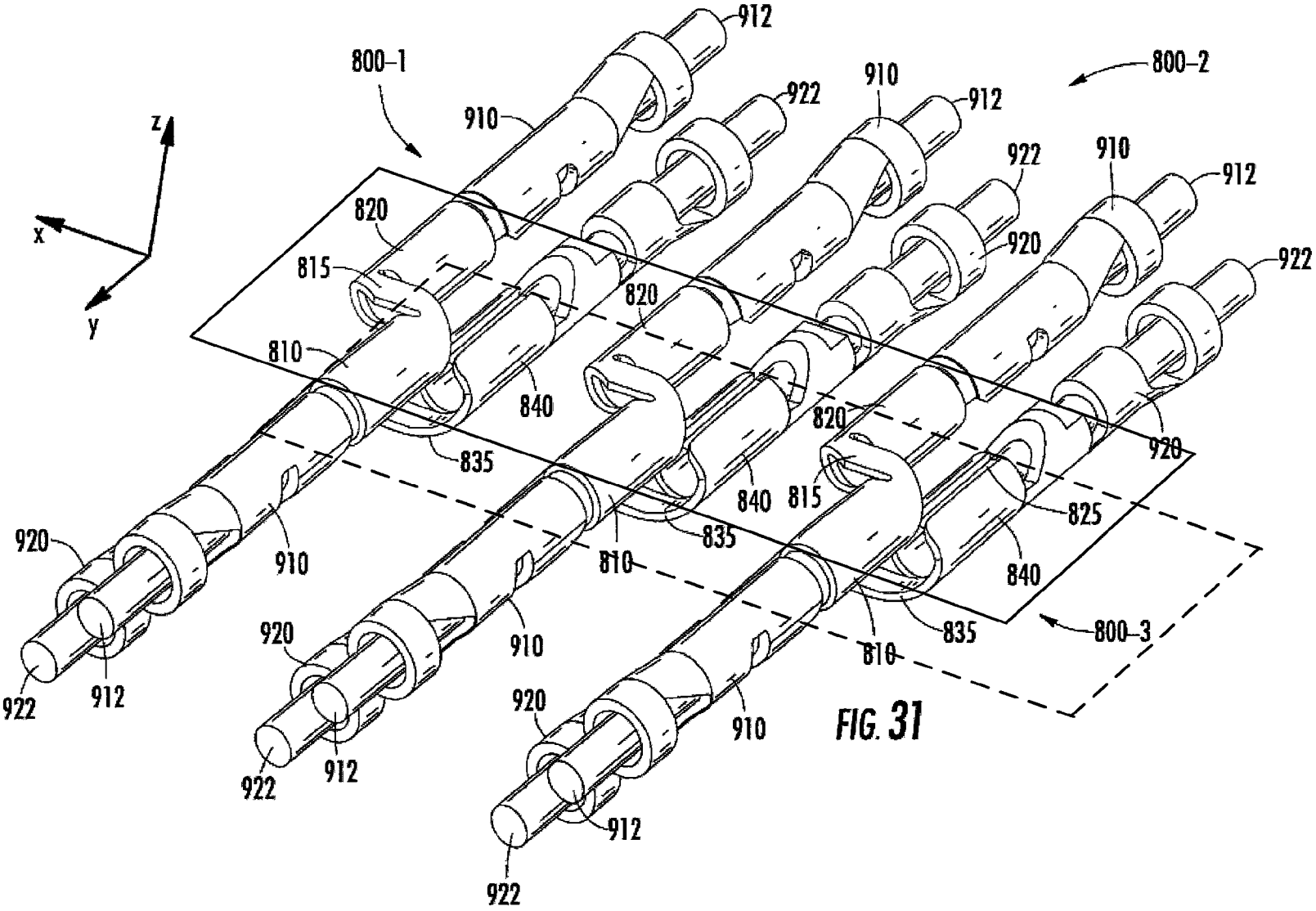
FIGS. 31 and 32 are schematic perspective views of the contact structures of the inline connectors and corresponding cable connectors of FIG. 30.
Figure 32:
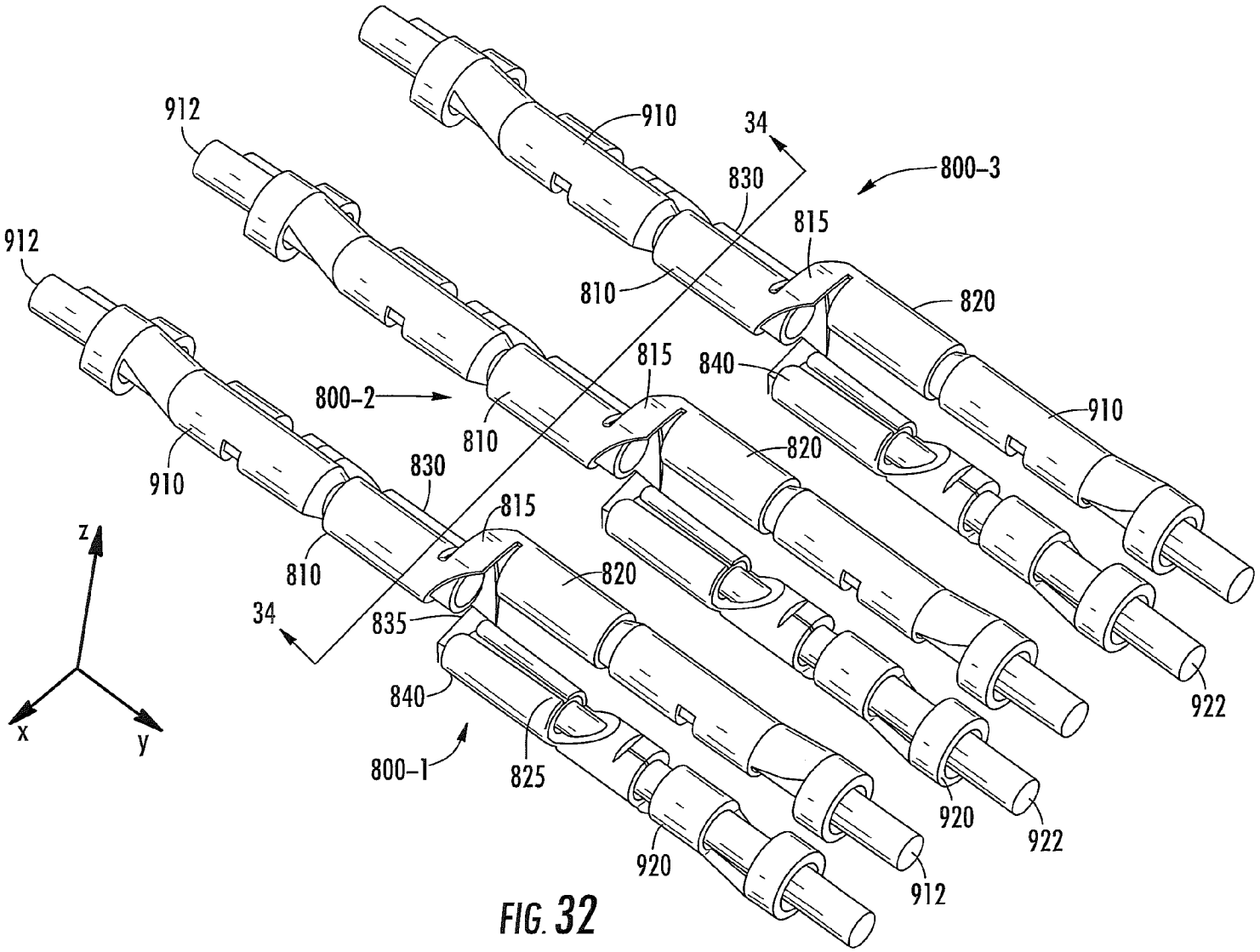
Figure 33:
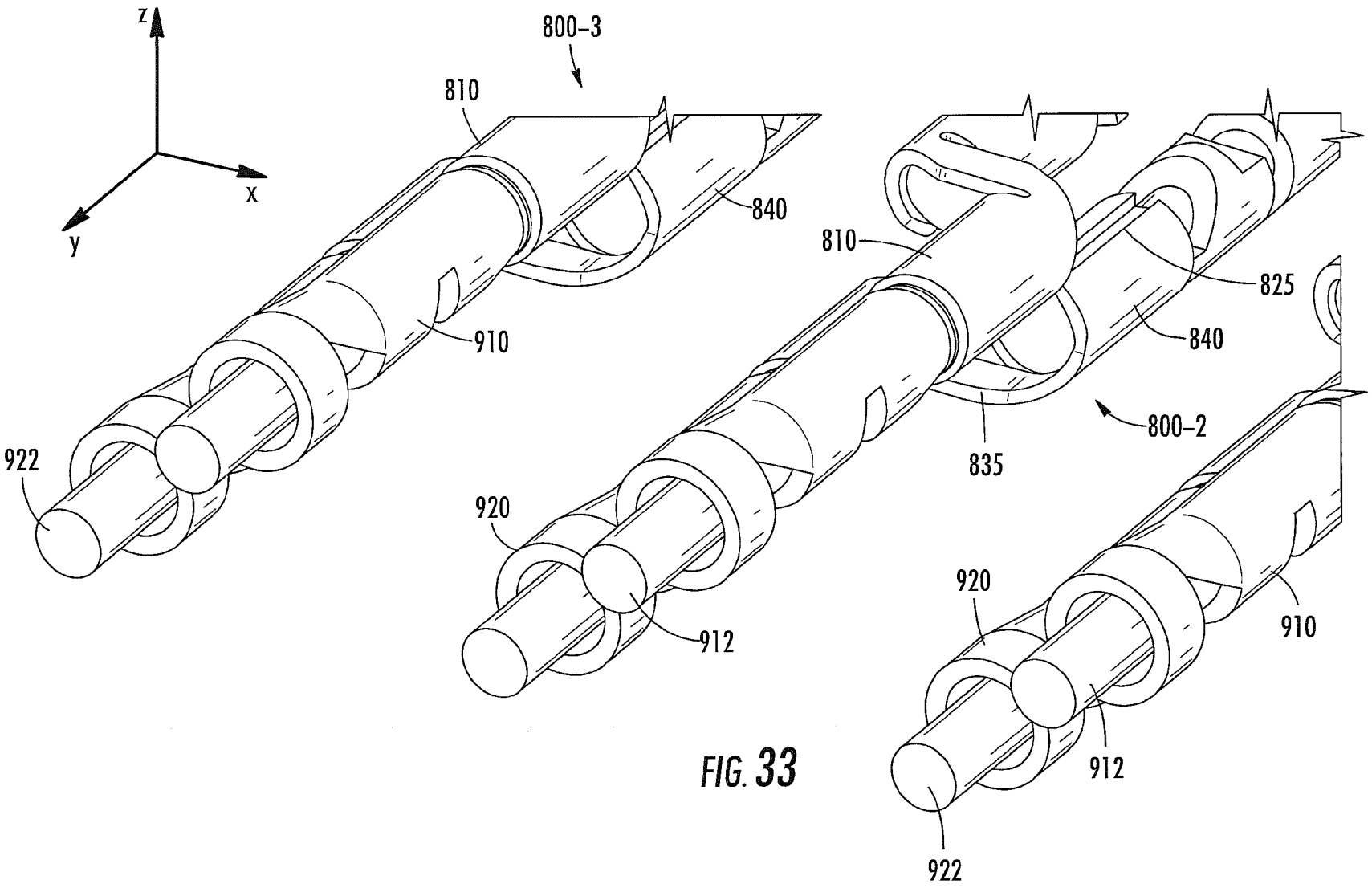
FIG. 33 is an enlarged view of a portion of the contact structures of the inline connectors and corresponding cable connectors of FIGS. 30-32.

FIGS. 31 and 32 are schematic perspective views of the three inline connectors 800 and the six mating cable connectors 900 of FIG. 30 with the connector housings 802 and 802 omitted to more clearly illustrate the pin and socket connections. FIG. 33 is an enlarged view of a portion of the pin and socket connections of FIGS. 31 and 32.

As shown in FIGS. 31-33, each of the inline connectors 800 includes four socket contacts 810, 820, 830, 840. On each connector 800, socket contacts 810 and 820 are connected by a connection section 815, and may be formed from a unitary piece of metal to provide a contact that includes an input socket contact 810 and an output socket contact 820. Likewise, socket contacts 830 and 840 are connected by a connection section 835, and may be formed from a unitary piece of metal to provide a contact that includes an input socket contact 830 and an output socket contact 840. Each of the socket contacts 810, 820, 830, 840 is configured to receive a respective pin contact 910 or 920 of a mating cable connector 900. For example, with respect to inline connector 800-1, socket contact 810 receives pin contact 910 of cable connector 900-1, socket contact 820 receives pin contact 910 of cable connector 900-4, socket contact 830 receives pin contact 920 of cable connector 900-1, and socket contact 840 receives pin contact 920 of cable connector 900-4. In the depicted embodiment, socket contacts 810 and 820 receive tip pin contacts 910 while socket contacts 830 and 840 receive ring pin contacts 920. However, it will be appreciated that the tip and ring contact positions may be reversed.

Socket contacts 810 and 820 may each reside in a first horizontally-oriented plane (i.e. a plane that is parallel to the plane defined by the x and y axes in FIGS. 31-33), and socket contacts 830 and 840 may each reside in a second horizontally-oriented plane that is beneath the first horizontally-oriented plane and parallel thereto. Socket contacts 810 and 820 are each tip socket contacts that form a tip conductive path through the inline connector 800. Socket contacts 830 and 840 are each ring socket contacts that form a ring conductive path through the inline connector 800. Accordingly, each inline connector 800 may be used to electrically connect tip pin contact 910 of one of the cable connectors 900 to the tip pin contact 910 of another of the cable connectors 900, and to electrically connect the ring pin contact 920 of one of the cable connectors 900 to the ring pin contact 920 of another of the cable connectors 900.

As shown in FIGS. 30-33, the inline connectors 800 may be very small, and may be positioned very close to each other. This may be advantageous in, for example, automotive and other applications where there may be space constraints, weight constraints and the like. However, the close spacing of the inline connectors 800 may also increase crosstalk between neighboring communications channels. In order to reduce the effects of such crosstalk, the inline connectors 800 may be designed to have both differential and common mode crosstalk compensation.

Figure 34:
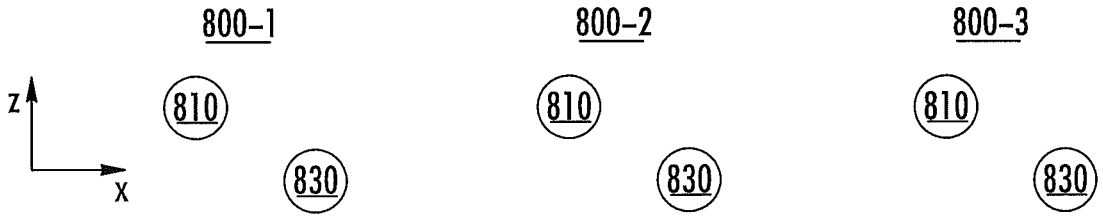
FIG. 34 is a schematic cross-sectional view of the sockets on one end of the inline connector of FIGS. 30-33 that is taken along the line 34-34 of FIG. 32.

As is discussed above, differential crosstalk occurs when a conductor of a first, disturbing pair couples more heavily onto a first conductor of a second, victim pair than onto the other conductor of the victim pair. Here, in the connector system of FIGS. 30-33, the pins 910, 920, sockets 810, 830 and sockets 820, 840 of adjacent pairs are staggered with respect to each other in order to reduce the differential crosstalk. For example, FIG. 34 is a schematic cross-sectional view taken along the line 34-34 of FIG. 32 that illustrates the relative positions of the ends of each socket 810, 830 on the left-hand side of FIG. 32.

Figure 77:
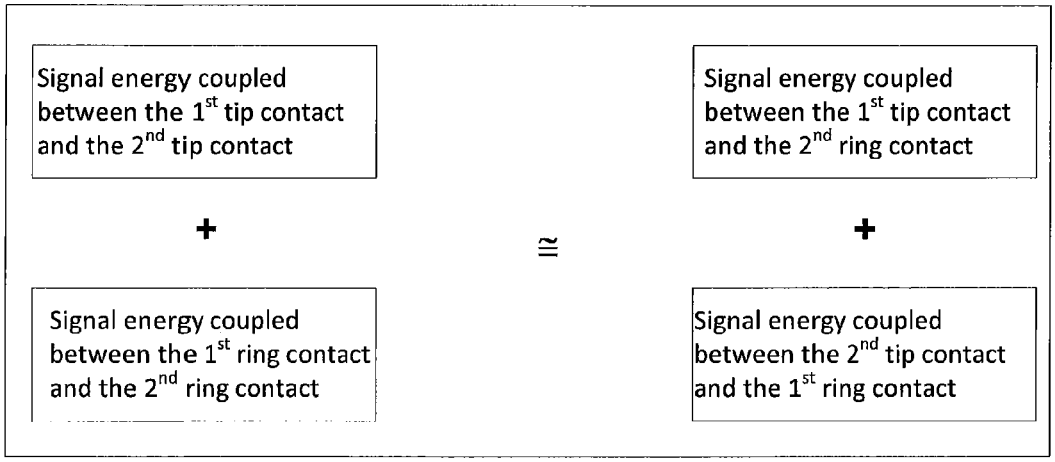
FIG. 77 is a schematic diagram illustrating signal energy coupling between contacts according to embodiments of the present invention.

As shown in FIGS. 31-34, the tip sockets 810 of each inline connector 800-1, 800-2, 800-3 are positioned farther to the left (in the view of FIG. 34) than are the ring sockets 830 of each inline connector 800. Additionally, the tip sockets 810 are positioned in a first, upper row, while the ring sockets 830 are positioned in a second, lower row. Various parameters such as, for example, the center-to-center distance between the upper and lower rows of sockets (the z-direction distance in FIG. 34), the amount of stagger between the sockets of each inline connector 800 (i.e., the x-direction center-to-center distance between the tip and ring sockets of the same inline connector 800), the distance between adjacent inline connectors 800 (i.e., the x-direction center-to-center distance between inline connectors 800-1 and 800-2), the radius of the pins and sockets, and the electrical characteristics (e.g., dielectric constant) of the media between the sockets may be selected so that little or no net coupling of signal energy may occur between the contact structures of adjacent inline connectors 800. For example, the above parameters may be selected so that the sum of (1) the coupling between tip socket 810 of inline connector 800-1 and tip socket 810 of inline connector 800-2 and (2) the coupling between ring socket 830 of inline connector 800-1 and ring socket 830 of inline connector 800-2 is approximately equal to the sum of (1) the coupling between tip socket 810 of inline connector 800-1 and ring socket 830 of inline connector 800-2 and (2) the coupling between tip socket 810 of inline connector 800-2 and ring socket 830 of inline connector 800-1 (see FIG. 77). Thus, the sockets 810, 830 of adjacent inline connectors 800-1, 800-2 (and the mating pins 910, 920 of connectors 900-1, 900-2) may be staggered in a fashion that significantly reduces the differential crosstalk between inline connectors 800-1, 800-2.

The above-described staggered arrangement of the tip sockets 810 and the ring sockets 830 of inline connectors 800-1 and 800-2 may be viewed either as providing a connector design that is generally neutral with respect to differential crosstalk between adjacent inline connectors 800 (and the cable connectors 900 that inline connectors 800 are mated with), or as a connector design that simultaneously injects compensating crosstalk that cancels out the offending crosstalk. The inline connectors 800 may be designed so that substantially equal amounts of offending crosstalk and compensating crosstalk are being injected at the same time along the length of the inline connector 800, as opposed to numerous prior art connector designs in which the offending crosstalk is injected at one location in the connector and the compensating location is injected at another location. As in this later case the delay between the point in time where the offending crosstalk is injected and the point in time where the compensating crosstalk is injected will result in a phase shift that will degrade the effectiveness of the crosstalk cancellation, it will be appreciated that the connector designs according to embodiments of the present invention may provide very high levels of cancellation, even when adjacent inline connectors 800 are located very close together.

The tip sockets 810 and the ring sockets 830 of connectors 800-2 and 800-3 are likewise staggered to provide the same or similar same differential crosstalk cancellation as is provided between inline connectors 800-1 and 800-2. Likewise, the same stagger may be provided between the tip sockets 820 and the ring sockets 840 of each of the inline connectors 800-1 through 800-3. Thus, in some embodiments, each of the inline connectors 800 may be designed to be substantially neutral in terms of the differential crosstalk that they inject onto an adjacent inline connector 800. Consequently, by staggering each socket contact 810 with respect to the nearest socket contacts 830, and by staggering each socket contact 820 with respect to the nearest socket contacts 840, it is possible to substantially reduce the amount of differential crosstalk that is generated between adjacent inline connectors 800.

The inline connectors 800 are also designed to exhibit reduced mode conversion. This is accomplished in the connector system of FIGS. 30-34 by including a "crossover" along each communications path through the inline connectors 800. In particular, for each of the inline connectors 800, the tip conductive path (which is comprised of tip socket 810, crossover segment 815 and tip socket 820) crosses over the ring conductive path (which is comprised of ring socket 830, crossover segment 835 and ring socket 840) when viewed from above. This crossover occurs in the middle of each inline connector 800 where crossover segment 815 crosses over crossover segment 835. As a result of this crossover, the tip conductive path and the ring conductive path of each inline connector 800 will inject approximately equal amounts of signal energy onto the conductive paths of each adjacent inline connector 800 (viewing the conductive paths of the adjacent inline connector as a single conductor).

Referring now to FIG. 32, an example will be provided to illustrate how the design of the inline connectors 800 may result in very low levels of mode conversion. Due to the close spacing of inline connectors 800-1 and 800-2, when an information signal is transmitted over inline connector 800-1, signal energy will be coupled, for example, from ring socket 830 of inline connector 800-1 onto both conductive paths of inline connector 800-2 as the signal passes through ring socket 830 of connector 800-1. While some of this signal energy from ring socket 830 will be cancelled out by the signal energy that is coupled from tip socket 810 of connector 800-1 onto both conductive paths of inline connector 800-2, the cancellation will be far from complete since ring socket 830 of connector 800-1 is closer to the conductive paths of connector 800-2 than is tip socket 810 of connector 800-1. Thus, a common mode signal will be injected from ring socket 830 of connector 800-1 onto the conductive paths of connector 800-2 along the left hand side of connector 800-2 (in the view of FIG. 32) when an information signal is transmitted over connector 800-1.

However, when the information signal that is transmitted over inline connector 800-1 passes to the right hand side of connector 800-1 (in the view of FIG. 32), then signal energy will be coupled from tip socket 820 of inline connector 800-1 onto both conductive paths of inline connector 800-2.

While some of this signal energy from tip socket 820 will be cancelled out by the signal energy that is coupled from ring socket 840 of connector 800-1 onto both conductive paths of inline connector 800-2, the cancellation will be far from complete since tip socket 820 of connector 800-1 is closer to the conductive paths of connector 800-2 than is ring socket 840 of connector 800-1. Thus, a common mode signal will be injected from tip socket 820 of connector 800-1 onto the conductive paths of connector 800-2 along the right hand side of connector 800-2 (in the view of FIG. 32) when an information signal is transmitted over connector 800-1.

In light of the symmetrical design of inline connectors 800-1 and 800-2, the signal energy that is coupled from ring socket 830 of inline connector 800-1 onto the conductive paths of inline connector 800-2 may have substantially the same magnitude as the signal energy that is coupled from tip socket 820 of inline connector 800-1 onto the conductive paths of inline connector 800-2. The coupling from the ring socket 830 of connector 800-1 onto the conductive paths of inline connector 800-2 may be viewed as "offending common mode crosstalk" while the coupling from the tip socket 820 of connector 800-1 onto the conductive paths of inline connector 800-2 may be viewed as "compensating common mode crosstalk" (or vice versa) since these two common mode couplings have opposite polarities (since the signals carried by the tip and ring conductive paths of the transmission line are offset in phase by 180 degrees). Moreover, since the "compensating common mode crosstalk" may have the same magnitude (and the opposite polarity) as the "offending common mode crosstalk," it will substantially cancel the offending common mode crosstalk so that very little mode conversion may occur, for example, in inline connector 800-2. Thus, the inline connector designs according to embodiments of the present invention may exhibit very low levels of mode conversion, which may reduce alien crosstalk in the communications system.

As discussed above, with respect to differential crosstalk, the inline connectors according to certain embodiments of the present invention may have stagger designs so that the offending crosstalk and the compensating crosstalk are injected at substantially the same locations along the length of the inline connectors 800, which may result in very high levels of crosstalk compensation. In contrast, the offending and compensating common mode crosstalk are injected at different locations along the inline connectors 800. As known to those of skill in the art, when this occurs the delay associated with the time it takes a signal from travel from the offending crosstalk injection point to the compensating crosstalk injection point will result in a phase shift in the compensating crosstalk signal. Because of this phase shift, the offending and compensating crosstalk signals will generally not be exactly 180 degrees offset in phase, which reduces the ability of the compensating crosstalk signal to completely cancel out the offending crosstalk signal. The higher the frequency of the information signal transmitted over inline connector 800-1, the greater the phase shift. However, in addition to the frequency of the transmitted information signal, the phase shift is also a function of the distance between the locations where the offending and compensating crosstalk are injected. Here, the inline connector designs according to embodiments of the present invention may have very small form factors so that the weighted midpoints of the locations where the offending and compensating crosstalk are injected may be very close to each other, and hence it may still be possible to achieve very high levels of common mode crosstalk cancellation even at high frequencies (e.g., frequencies up to 500 MHz or more).

The inline connectors according to embodiments of the present invention may provide improved performance as compared to various prior art connectors, such as the insulation displacement connectors ("IDCs") disclosed in U.S. Pat. No. 7,223,115 ("the '115 patent"). In particular, while the IDCs of the '115 patent may exhibit low levels of coupling with respect to adjacent IDCs, the insulated conductors that are terminated into the IDCs of the '115 patent must each go through a bend of approximately ninety degrees and also may not all be terminated into the IDCs at the exact same distance from the end of the conductors. As a result, there may be unequal coupling between the end portions of the insulated conductors that are terminated into the IDC connecting blocks of the '115 patent, and this unequal coupling may give rise to differential and/or common mode crosstalk. Thus, even though the sockets of the inline connectors according to embodiments of the present invention may have larger facing surfaces and hence larger amounts of coupling, they may exhibit improved crosstalk performance as compared to, for example, the IDC connecting blocks of the '115 patent due to fact that the connectors may be designed to carefully control the crosstalk between the socket contacts of the inline connectors as well as the crosstalk between the cable connectors.

The inline connectors 800 may have a very small form factor. For example, with reference to FIGS. 31-32, in some embodiments, each socket 810, 820, 830, 840 may have a length of less than 0.1 inches, and each pin 910, 920 may have a length of less than 0.2 inches. For example, in one specific embodiment, each socket 810, 820, 830, 840 may have a length of about 0.075 inches and each pin 910, 920 may have a length of about 0.018 inches. In such an embodiment, the center-to-center vertical spacing (z-direction) between the socket contacts of an inline connector 800 (e.g., between tip contact 810/820 and ring contact 830/840) may be less than 0.025 inches. In one specific embodiment, this center-to-center vertical spacing may be about 0.0195 inches. Likewise, the center-to-center horizontal spacing (x-direction) between the tip and ring sockets of the same pair (e.g., between tip socket 810 and tip socket 820 or, equivalently, between tip socket 810 and ring socket 830) may be less than 0.05 inches. In one specific embodiment, this center-to-center horizontal spacing of the sockets within a pair may be about 0.042 inches. The center-to-center horizontal spacing (x-direction) between two adjacent pairs (e.g., between the center of inline connector 800-1 and the center of inline connector 800-2) may be less than 0.3 inches. In one specific embodiment, this center-to-center horizontal spacing between adjacent pairs may be about 0.18 inches. With these dimensions, the inline connectors 800 may easily meet the NEXT, FEXT, alien NEXT, alien FEXT and return loss connector requirements of the above-referenced Category 6a standard.

Figure 35:
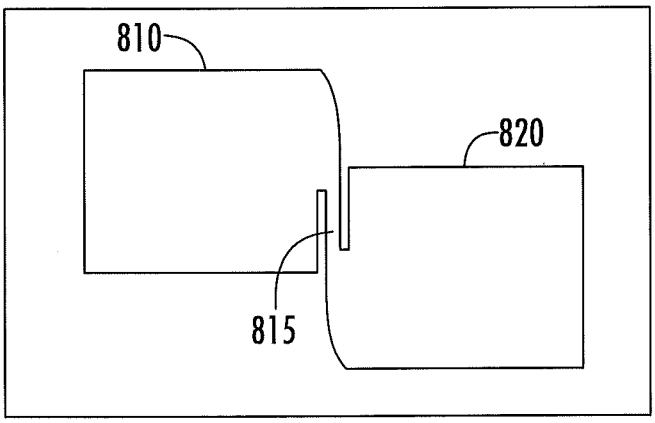
FIG. 35 is a plan view of a blank of sheet metal that illustrates how the metal may be stamped (and subsequently rolled) to form a pair of socket contacts that may be used in connectors according to embodiments of the present invention.

In some embodiments, the sockets 810, 820 and the connection section 815 of the tip conductive path (or, alternatively, the sockets 830, 840 and the connection section 835 of the ring conductive path) may be stamped and formed very inexpensively from sheet metal. In particular, as is shown in FIG. 35, a blank of metal can be stamped along the lines drawn in the box of FIG. 35 and then the stamped piece of metal may be rolled to form a pair of socket contacts (e.g., sockets 810, 820) that may be used in the inline connectors 800. Moreover, while not shown in the figures, the sockets 810, 820, 830, 840 may have internal indents that may be compliant when a pin is received within the socket, thereby maintaining a good mechanical and electrical connection, even in harsh operating environments. When the sockets 810, 820, 830, 840 are stamped and rolled from sheet metal, each socket 810, 820, 830, 840 may have a longitudinal slit 825.

While the inline connectors 800 and the cable connectors 900 are illustrated as having sockets and pins with round cross-sections in the drawings, respectively, it will be appreciated that other socket and pin designs may be used (e.g., square cross-sections, rectangular cross-sections, etc.).

Figure 36:
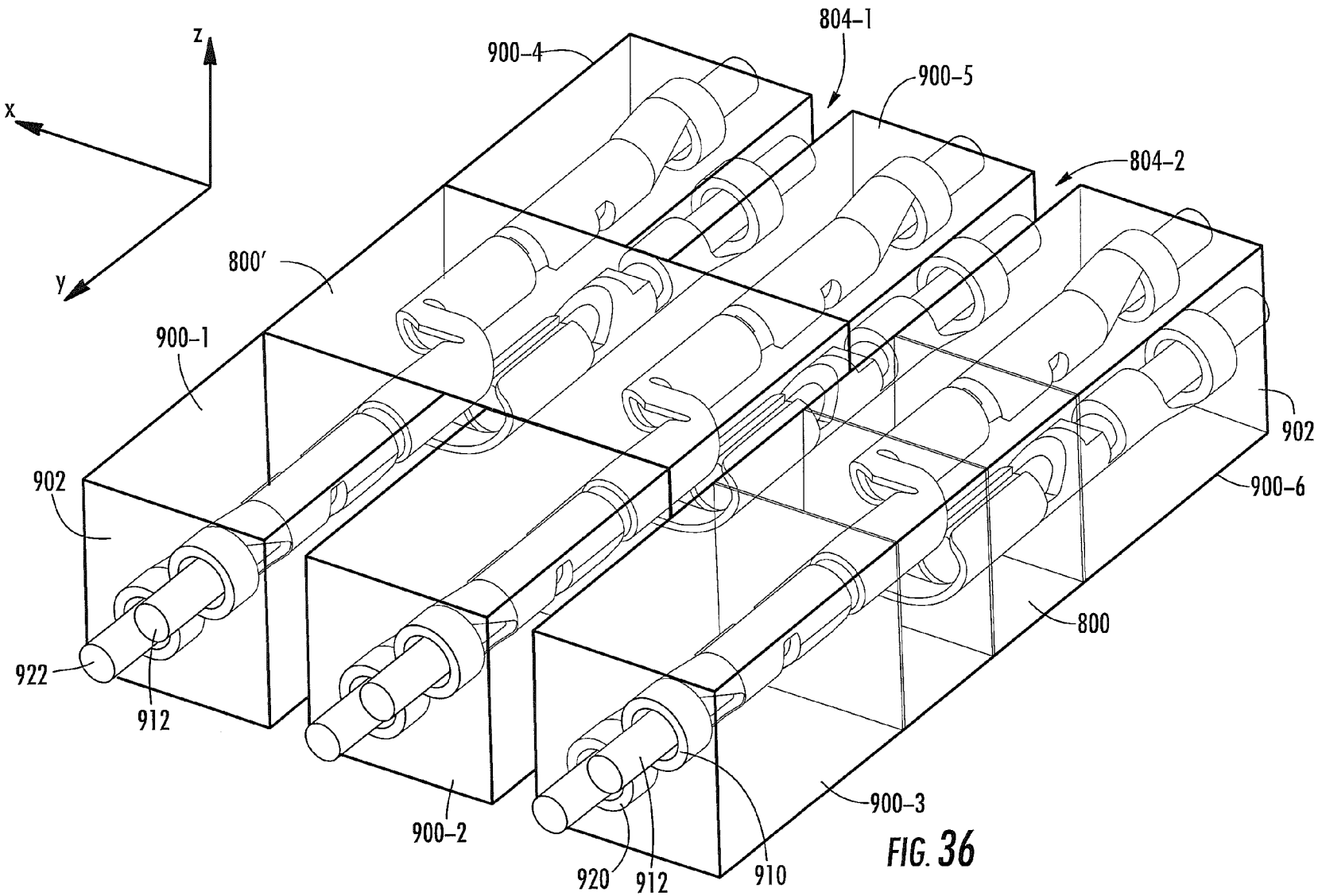
FIG. 36 is a schematic perspective view of two inline connectors according to embodiments of the present invention in which one of the inline connectors includes two pairs of contacts.

FIG. 36 is a schematic perspective view of an inline connectors 800 positioned adjacent to an inline connector 800' according to further embodiments of the present invention that each include two pairs of conductive paths. As is readily apparent, the inline connectors 800' may be almost identical to the inline connectors 800 which are discussed in detail above, with the one difference being that the inline connectors 800 each include a single communications channel, while inline connector 800' of FIG. 36 includes two communications channels within a common housing. In some embodiments, when multiple communications channels are included within a single inline connector (e.g., connector 800'), the separation between the socket contacts of different communications channels may be reduced further (as compared to the separation between the communications channels of different inline connectors). This may be possible because typically the internal near-end crosstalk specifications may allow for higher levels of crosstalk than the alien near-end crosstalk specifications, as the network computer chips may compensate for some degree of internal crosstalk, but typically cannot compensate for alien crosstalk. This may allow the conductive paths of a pair within an inline connector to be spaced more closely together than the conductive paths of a pair in an adjacent inline connector.

Figure 37:
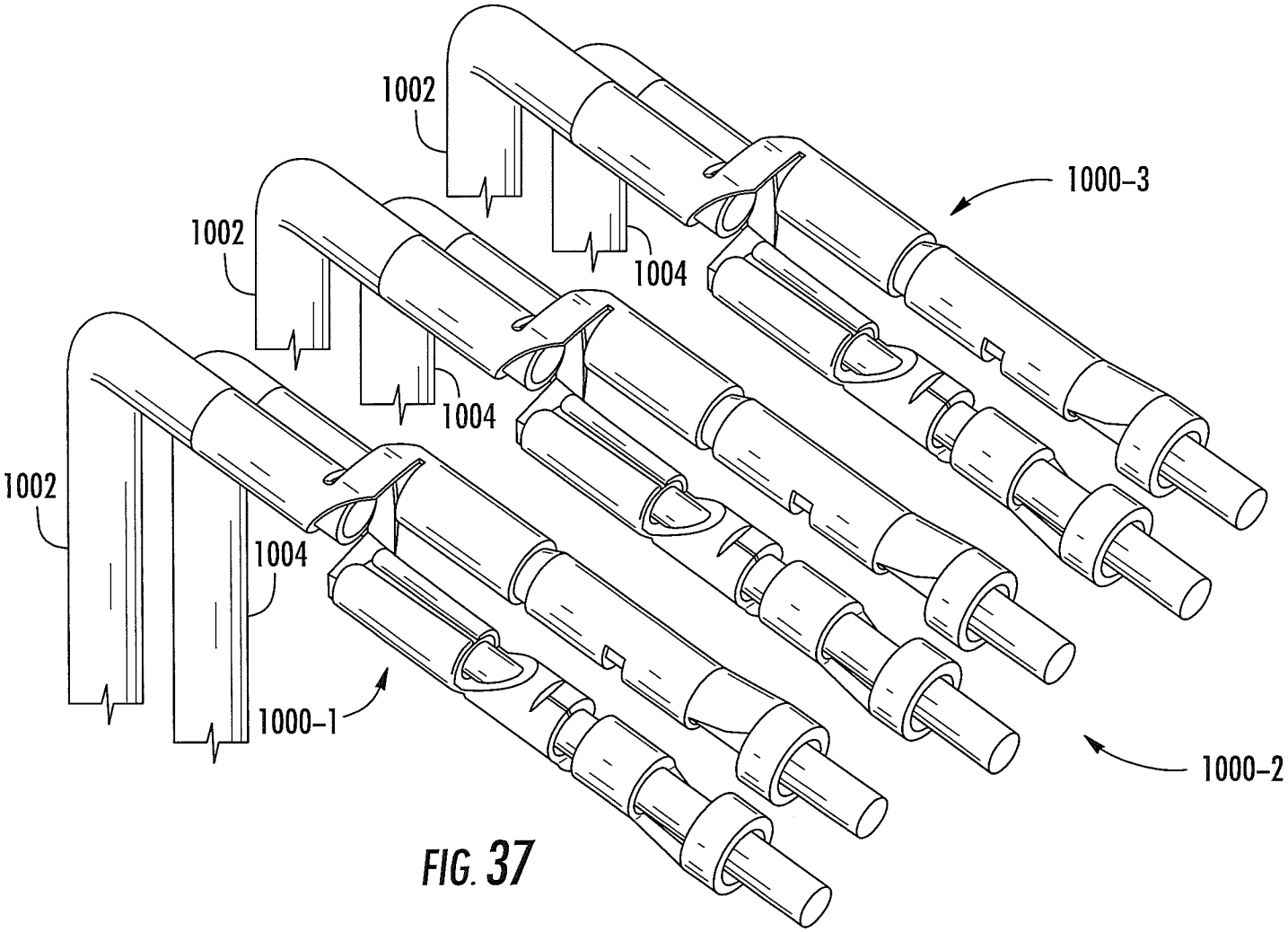
FIG. 37 is a schematic perspective view of the contact structures of a printed circuit board mounted connector according to embodiments of the present invention.

While embodiments of the present invention may provide inline connectors, it will be appreciated that the same concepts discussed above may also be used to provide printed circuit board mounted connectors that exhibit excellent crosstalk and return loss performance. FIG. 37 illustrates an example of such a printed circuit board connector.

In particular, FIG. 37 is a schematic perspective view of the three printed circuit board mounted connectors 1000-1, 1000-2, 1000-3 according to still further embodiments of the present invention. In FIG. 37, the housings of the connectors 1000 have been omitted to more clearly illustrate the pin and socket connections. As shown in FIG. 37, the right half of each connector 1000 may be identical the right half of the inline connectors 800 discussed above with respect to FIG. 32. However, the socket contacts 810, 830 that form the left hand side of the inline connectors 800 of FIG. 32 are replaced with right-angled conductive pins 1002, 1004 that are suitable for mounting in a printed circuit board (not shown).

While the above-described inline connectors and printed circuit board mounted connectors include socket contacts and cable connectors (e.g., plug connectors) that include pin contacts, it will be appreciated that other contact structures may be used. For example, in other embodiments, the pin contacts could be replaced with blade contacts, and the socket contacts could be replaced with a wide-variety of spring contacts that each exert a contact force against a mating blade. Alternatively, the pin contacts could be replaced with spring contacts and the socket contacts could be replaced with any suitable contact pad or surface. In still other embodiments, both the pin and socket contacts could be replaced with insulation displacement contacts. Thus, it will be appreciated that embodiments of the present invention are not limited to connectors that include pin contacts or socket contacts.

Figure 38A:
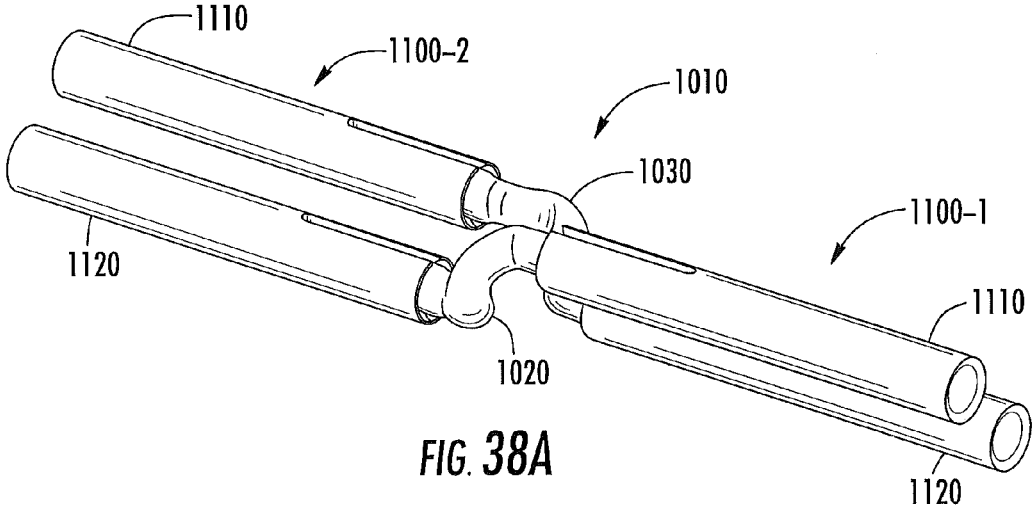
FIG. 38A is a schematic perspective view of the contact structures of an inline connector according to embodiments of the present invention mated with the contact structures of two cable connectors.
Figure 38B:
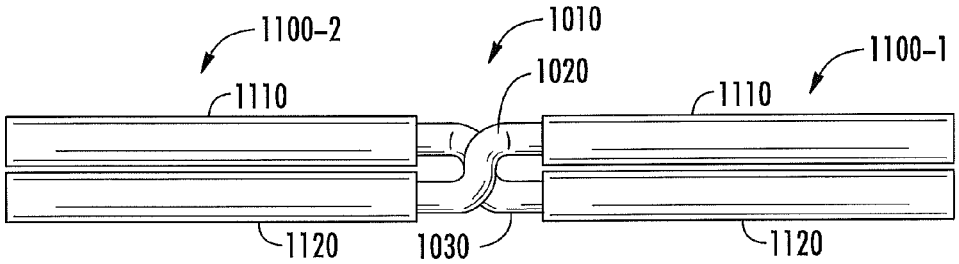
FIG. 38B is a top view of the contact structures depicted in FIG. 38A.
Figure 38C:
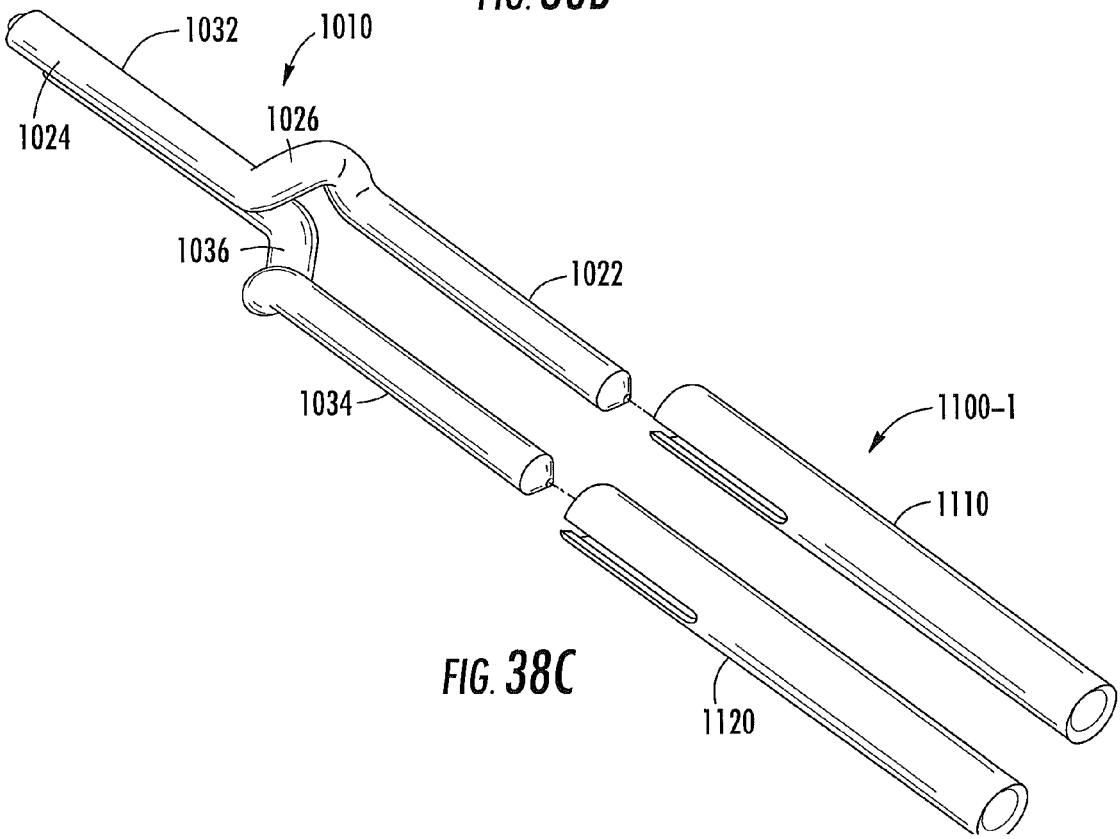
FIG. 38C is an exploded perspective view of the contact structures of the inline connector and one of the cable connectors of FIG. 38A.

It will likewise be appreciated that in other embodiments the inline connectors and printed circuit board mounted connectors may have pin contacts and the cable connectors may have socket contacts. For example, FIGS. 38A-38C schematically illustrate the contact structures of an inline connector 1010 and two cable connectors 1100-1, 1100-2 according to embodiments of the present invention in which the cable connectors 1100 are implemented using socket contacts and the inline connector 1010 is implemented using pin contacts. The housings for the inline connector 1010 and the two cable connectors 1100-1, 1100-2 are not illustrated in FIGS. 38A-38C to more clearly depict the contact structures of these connectors.

In particular, as shown in FIGS. 38A-38C, the inline connector 1010 includes a tip contact 1020 and a ring contact 1030. The tip contact 1020 includes a first pin 1022, a second pin 1024 and a crossover segment 1026 that connects the first pin 1022 to the second pin 1024. The ring contact 1030 includes a first pin 1032, a second pin 1034 and crossover segment 1036 that connects the first pin 1032 to the second pin 1034. The cable connectors 1100-1, 1100-2 each include a pair of sockets 1110, 1120. A first communications cable (not shown) may be attached to cable connector 1100-1, and a second communications cable (not shown) may be attached to cable connector 1100-2. These communications cables may each include a twisted pair of insulated conductors (not shown). An exposed end of each insulated conductor may be inserted into a first end of a respective socket contact 1110, 1120. The insulated conductors may be permanently attached to their respective socket contacts 1110, 1120 by crimping, soldering, press fitting or other techniques known to those of skill in the art. The second end of each socket contact 1110, 1120 may be configured to mate with a respective one of the pins 1022, 1024, 1032, 1034 of the inline connector 1010, as is shown in the figures. Thus, FIGS. 38A-38C graphically illustrate how the locations of the pins and sockets may be reversed so that the cable connectors 1100 include socket contacts and the inline connectors 1010 (or printed circuit board mounted connectors) include pin contacts. It will be appreciated that any of the connectors discussed herein may be modified in this manner.

Figure 39:
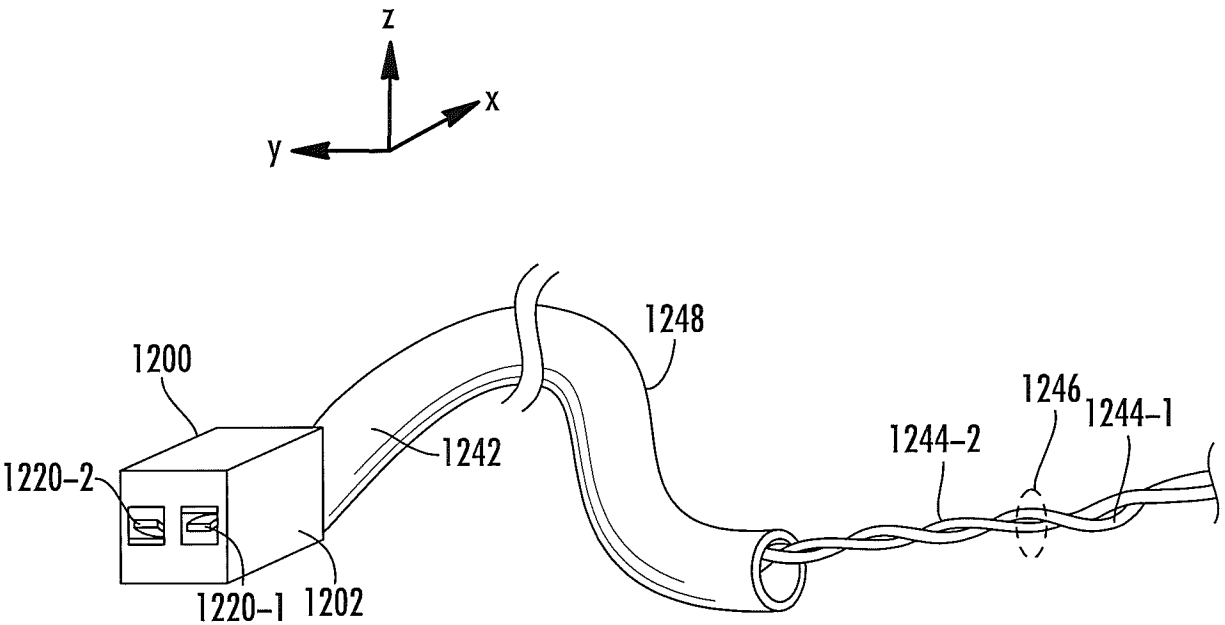
FIG. 39 is a perspective, cut-away view of a connectorized cable according to additional embodiments of the present invention.
Figure 40:
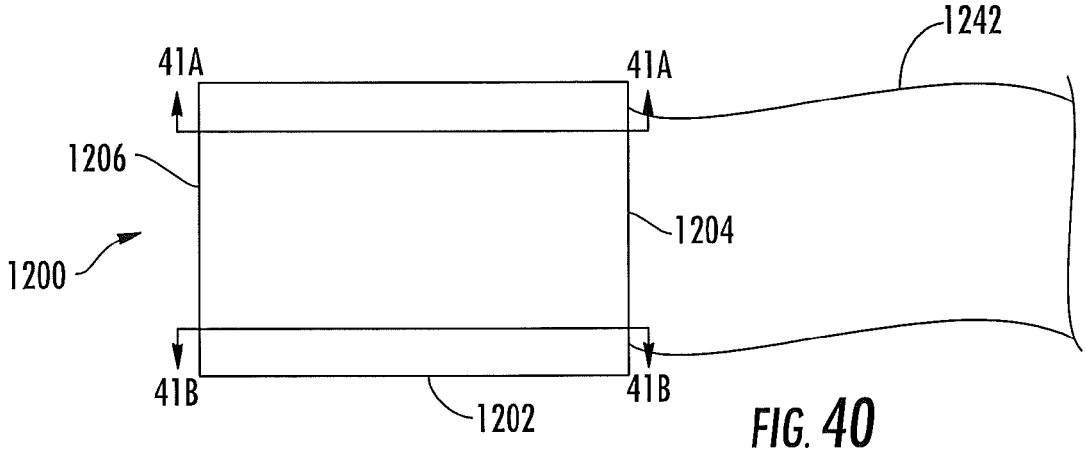
FIG. 40 is a top schematic view of an end portion of the connectorized cable of FIG. 39.

FIGS. 39-42 illustrate an embodiment of a cable connector 1200 according to further embodiments of the present invention. In particular, FIG. 39 is a schematic perspective view of a cable connector 1200 which may be used, for example, on the connectorized cable 340-2 of FIG. 15. FIG. 40 is a schematic top view of the cable connector 1200, FIGS. 41A-41B are schematic cross-sectional views of the cable connector 1200 taken along the lines 41A-41A and 41B-41B of FIG. 40, respectively, and FIGS. 42A-42B are a side view and a bottom view, respectively, of one of the contacts 1220 of the cable connector 1200.

As shown in FIG. 39, the cable connector 1200 may be used to connectorize a communications cable 1242. The cable 1242 may comprise, for example, an unshielded twisted pair Ethernet-style cable that includes two insulated conductors 1244-1, 1244-2 that are arranged as a twisted pair 1246 of conductors. The twisted pair 1246 may be enclosed in a cable jacket 1248. The cable connector 1200 is illustrated as being implemented as a plug connector, but it will be appreciated that it could alternatively be implemented as, for example, a jack connector. Each cable connector 1200 may include a housing 1202 and two contacts 1220-1, 1220-2 that form a pair of contacts. Each contact 1220-1, 1220-2 is electrically connected to a respective one of the insulated conductors 1244-1, 1244-2. In the embodiment of FIG. 39, each contact 1220 comprises a cantilevered spring contact.

As shown in FIGS. 40-41, the housing 1202 has a first end 1204 and a second end 1206. The housing 1202 may define a longitudinal axis, a transverse axis and a vertical axis. These three axes are shown in the perspective view of FIG. 39, where the x-axis is the longitudinal axis, the y-axis is the transverse axis, and the z-axis is the vertical axis. The first end 1204 of housing 1202 may have an aperture that receives the conductors of a communications cable such as conductors 1244-1, 1244-2 of communications cable 1242 of FIG. 39. The second end includes an aperture 1208 that is configured to receive a printed circuit board ("PCB") of a mating connector along the longitudinal axis of housing 1202. Herein, the aperture 1208 is referred to as a "PCB aperture." In the embodiment depicted in FIGS. 40-41, the housing 1202 may be a plug housing that is received within a plug aperture of a mating jack connector. However, it will be appreciated that in other embodiments the housing of cable connector 1200 may be configured as a jack housing.

Figure 41A:
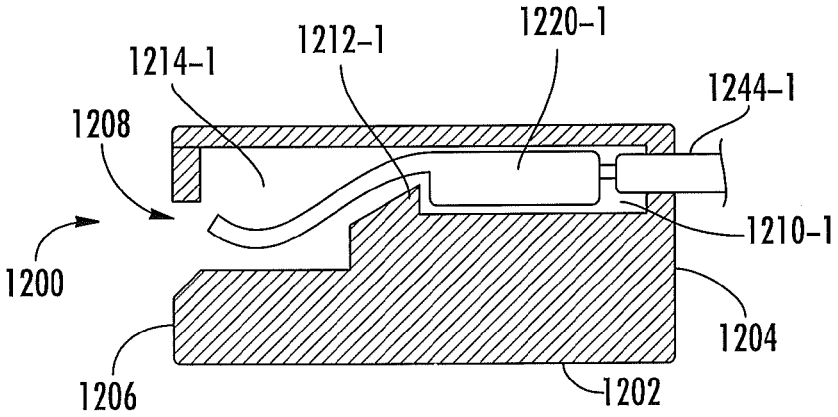
FIGS. 41A-41B are schematic cross-sectional views of the cable connector of FIGS. 39-40 taken along the lines 41A-41A and 41B-41B of FIG. 40, respectively.
Figure 41B:
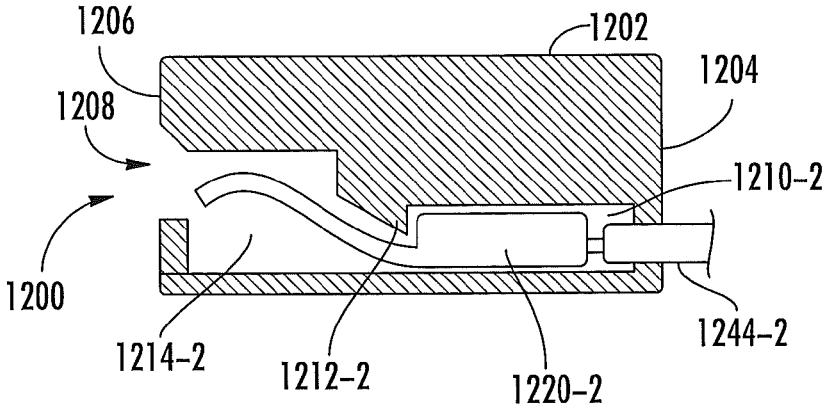

FIGS. 41A and 41B are cross-sectional views taken along contacts 1220-1 and 1220-2, respectively. As shown in FIGS. 41A-41B, the contacts 1220-1, 1220-2 are mounted within the interior of the housing 1202. The first contact 1220-1 is mounted in an upper portion of the housing 1202 on the left-hand side of cable connector 1200 (from a viewpoint looking into the PCB aperture 1208), while the second contact 1220-2 is mounted in a lower portion of the housing 1202 on the right-hand side of cable connector 1200 (from a viewpoint looking into the PCB aperture 1208). The first contact 1220-1 is offset both transversely and vertically from the second contact 1220-2 (i.e., the contacts 1220-1 and 1220-2 are offset from each other along both the y-axis of FIG. 39 and the z-axis of FIG. 39). The first insulated conductor 1244-1 of cable 1242 has an exposed end portion that is electrically connected to contact 1220-1. In the depicted embodiment, the exposed end portion of conductor 1244-1 is received within a rear cavity of the contact 1220-1 and this rear cavity is then crimped onto the conductor 1244-1 to provide a good mechanical and electrical connection between the contact 1220-1 and the conductor 1244-1. Likewise, the exposed end portion of conductor 1244-2 is received within a rear cavity of the contact 1220-2 and this rear cavity is then crimped onto the conductor 1244-2 to provide a good mechanical and electrical connection between the contact 1220-2 and the conductor 1244-2. In other embodiments, the contacts 1220 could be soldered to the respective conductors 1244, connected by insulation piercing or insulation displacement contacts or by other suitable means. Contact 1220-1 may be a tip contact, and contact 1220-2 may be a ring contact, or vice versa.

As is further shown in FIG. 41A, contact 1220-1 may be received within a cavity 1210-1 in the rear portion of housing 1202. A stop 1212-1 may be provided that helps maintain contact 1220-1 in a desired position. A cantilevered spring portion 1224 of contact 1220-1 (namely the distal portion 1224 discussed below with reference to FIGS. 42A-42B) extends into the PCB aperture 1208. An open space 1214-1 is provided above the distal portion 1224 of contact 1220-1 to allow the distal portion 1224 to deflect upwardly when a printed circuit board of a mating connector is received within the PCB aperture 1208, as will be discussed below with respect to FIGS. 46A and 46B. As shown in FIG. 41B, contact 1220-2 is similarly received within a cavity 1210-2, and a stop 1212-2 and an open space 1214-2 are provided that allow contact 1220-2 to operate in the same manner as contact 1220-1, except that contact 1220-2 deflects downwardly instead of upwardly in response to the insertion of the printed circuit board of the mating connector into the PCB aperture 1208.

Figure 42A:
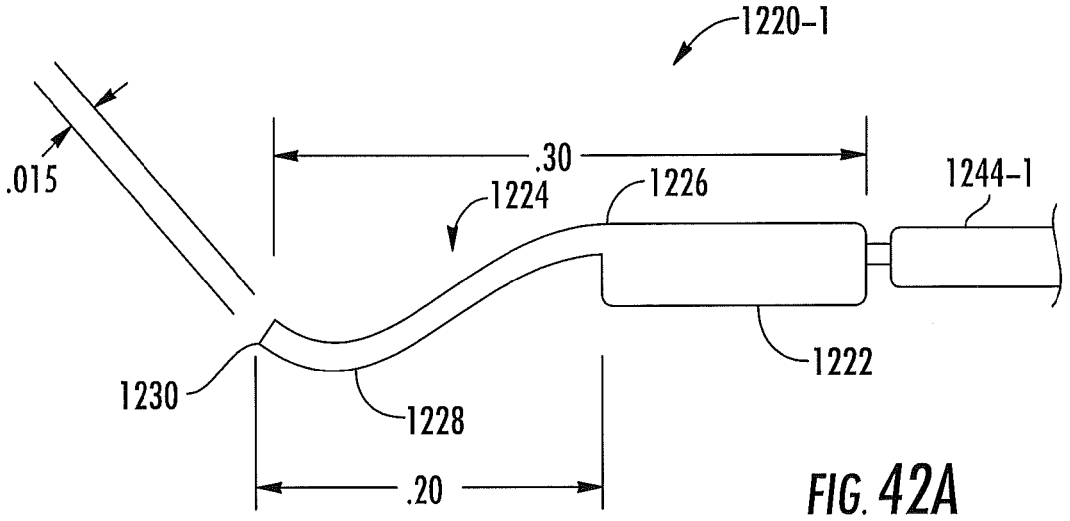
FIGS. 42A-42B are a side view and a bottom view, respectively, of one of the contacts of the cable connector of FIGS. 40-41.
Figure 42B:
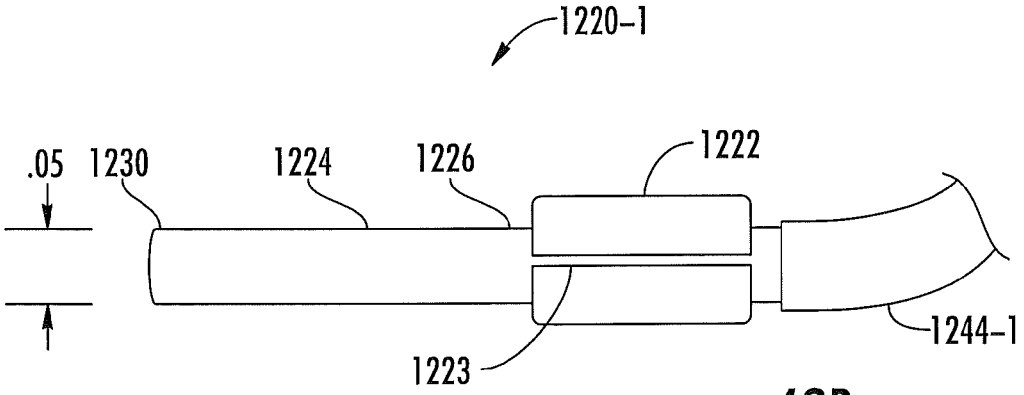

FIGS. 42A and 42B illustrate the configuration of contact 1220-1 in greater detail. Contact 1220-2 may be identical to contact 1220-1. As shown in FIGS. 42A-42B, contact 1220-1 includes a base 1222 and a distal portion 1224. The base 1222 may be in the form of a hollow cylinder, while the distal portion 1224 may comprise a cantilevered arm. In the depicted embodiment, the distal portion 1224 includes a connecting portion 1226 that connects to the base 1222, a free end 1230 and a contact region 1228 that is positioned between the connecting portion 1226 and the free end 1230.

The contact 1220-1 may be formed of a resilient metal such as, for example, beryllium-copper or phosphor-bronze. The distal portion 1224 may be configured to act as a spring, as will be discussed in more detail with reference to FIGS. 46A and 46B below. The contact portion 1228 may be configured to engage a contact structure of a mating connector. The free end 1230 may be bent upwardly (in the case of contact 1220-1) or downwardly (in the case of contact 1220-2 with respect to the contact portion 1228. This may facilitate ensuring that the contact portion 1228 exerts a good contact force against a contact of a mating connector, as will be explained in more detail below with reference to FIGS. 46A-46B.

In some embodiments, the contacts 1220 may be formed from sheet metal using stamping and rolling operations. This may provide for low-cost contacts 1220. As shown in FIGS. 42A-42B, in one specific embodiment, the contact may be about 0.30 inches long and 0.05 inches wide (the base portion 1222 may be slightly wider). The base portion 1222 may be about 0.1 inches long, the distal portion 1224 may be about 0.2 inches long, and the contact may be formed from a sheet of 0.015 inch sheet metal. As shown in FIG. 42B, in such embodiments the base 1222 may include a longitudinal slit 1223 that results from the rolling operation.

Figure 43:
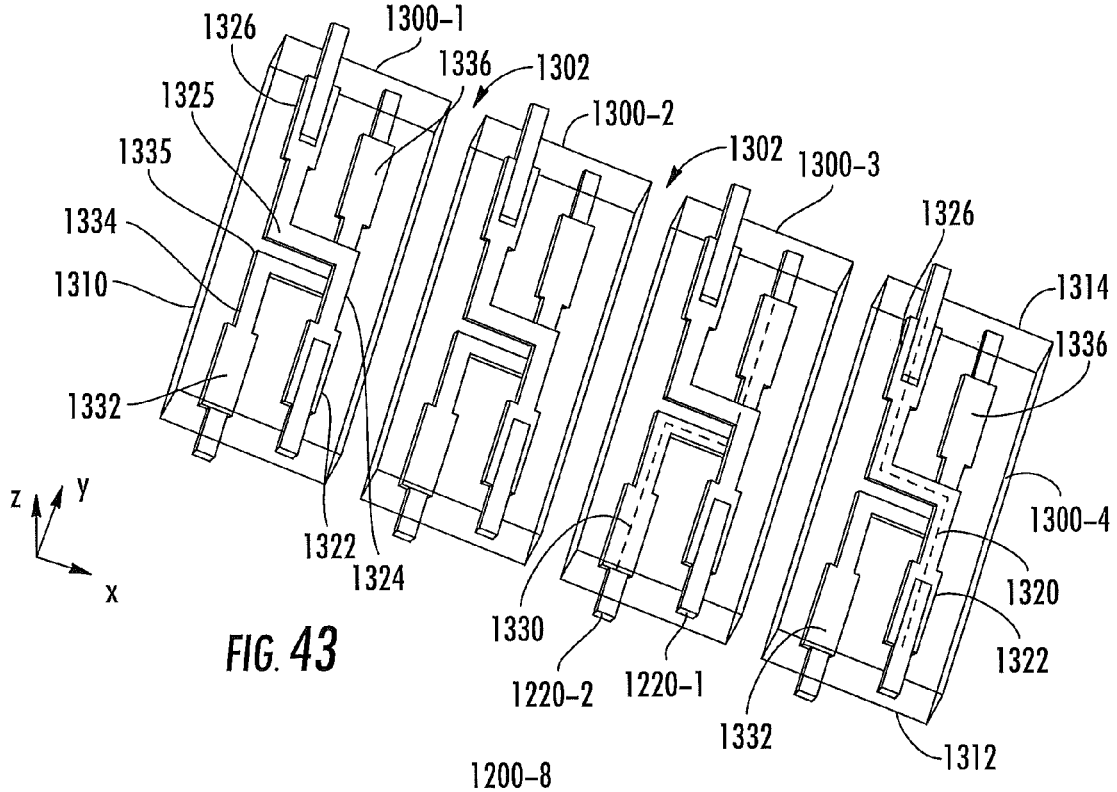
FIG. 43 is a schematic top perspective view of four inline connectors according to embodiments of the present invention with the housings thereof removed to clearly illustrate the conductive paths and contact structures of each inline connector.
Figure 44:
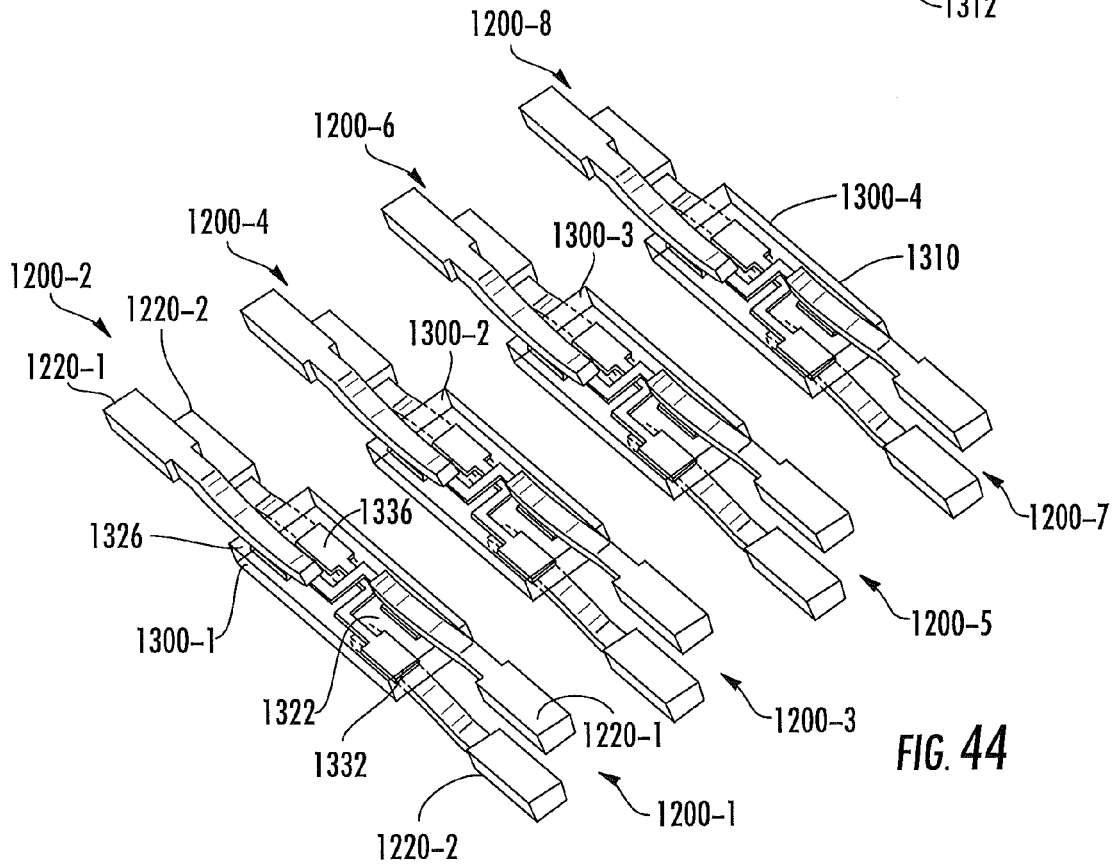
FIG. 44 is a schematic top perspective view of the four inline connectors of FIG. 43 with the contacts of eight mating cable connectors included to illustrate the communications paths through each mated set of an inline connector and two cable connectors.
Figure 45:
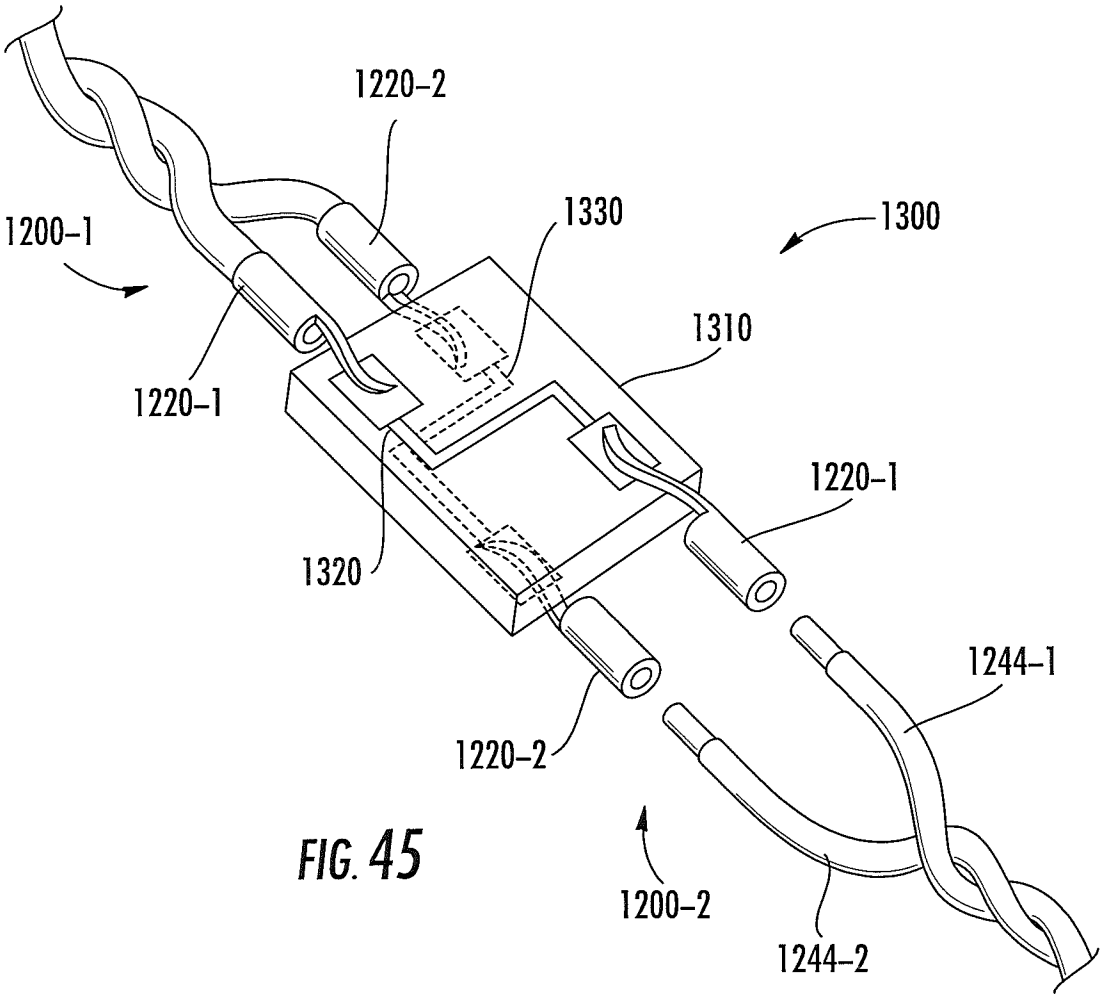
FIG. 45 is a schematic, partially exploded, perspective view of one of the inline connectors of FIGS. 43-45 mated with two cable connectors with the housings of each connector omitted to more clearly illustrate the conductive paths through the mated connectors.

FIG. 43 is a schematic perspective view of four inline connectors 1300-1, 1300-2, 1300-3, 1300-4 according to further embodiments of the present invention. A cable connector such as the cable connector 1200 discussed above with respect to FIGS. 40-42 may be mated to each side of each of the inline connectors 1300 so that the four inline connectors 1300-1, 1300-2, 1300-3, 1300-4 connect first through fourth connectorized cables (not shown) to respective fifth through eighth connectorized cables (not shown). FIG. 44 is a schematic perspective view of the four inline connectors 1300 of FIG. 43 with the contacts of eight mating cable connectors included to illustrate the communications paths through each mated set of an inline connector and two cable connectors. FIG. 45 is a schematic partially exploded, perspective view of one of the inline connectors 1300 of FIG. 43 mated with two cable connectors 1200. In FIGS. 43-45, the housings of the inline connectors 1300 (and of the cable connectors 1200 in FIGS. 44-45) have been omitted to more clearly illustrate the communications paths through each connector. The inline connectors 1300 of FIGS. 43 and 44 may be used to implement the inline connectors 360 of FIG. 15.

As shown in FIGS. 43 and 44, the four inline connectors 1300-1, 1300-2, 1300-3, 1300-4 may be aligned in a row adjacent to each other. This may, for example, facilitate mating the inline connectors 1300 with the cable connectors 1200 of a bundle of cables. In some embodiments, features such as, for example, snap clips, mating protrusions and recesses or other connector mechanisms (not shown) may be provided on exterior surfaces of the housings (not shown) of the inline connectors 1300 that allow the housings to be connected together into a single unit. In other embodiments, a common housing (not shown) may be provided and the individual housings of each inline connector 1300 may be mounted in this common housing. The use of external features on the individual housings, a second common housing or other mechanisms may be employed in some embodiments in order to maintain the inline connectors 1300 at predetermined separations that facilitate controlling crosstalk coupling between the inline connectors 1300.

In some embodiments, air gaps 1302 may be provided between adjacent ones of the inline connectors 1300. These air gaps 1302 may help reduce capacitive coupling between the contact structures of the adjacent inline connectors 1300 and the contacts 1220 of the cable connectors 1200 that are mated to the inline connectors 1300. The tightly packed connector arrangement of FIGS. 43-44 may minimize space requirements and provide a convenient connector interface, but may also increase coupling between the communications channels through adjacent cable connectors 1200 and inline connectors 1300.

In the embodiment of FIGS. 43-44, the inline connectors 1300 are implemented as four separate inline connectors that each include one communications channel. However, it will be appreciated that in other embodiments inline connectors may be used that include more than one communications channel.

It will be appreciated that the cable connectors 1200 may be implemented as either plug connectors, jack connectors or some other type of connector. Likewise, the inline connectors 1300 may also be implemented as either plug connectors, jack connectors or some other type of connector. Typically, if the cable connectors 1200 are implemented as plug connectors, then the inline connectors 1300 will be implemented as jack connectors (and, in particular, as a double-sided jack). If, instead, the cable connectors 1200 are implemented as jack connectors, then the inline connectors 1300 will be implemented as plug connectors (and, in particular, as a double-sided plug). In still other embodiments, one side of the inline connector 1300 may be implemented as a plug connector and the other side may be implemented as a jack connector.

As shown in FIGS. 43-45, each of the inline connectors 1300 includes a printed circuit board 1310 that has a tip conductive path 1320 (shown via a dotted line on inline connector 1300-4 in FIG. 43) and a ring conductive path 1330 (shown via a dotted line on inline connector 1300-3 in FIG. 43) therethrough. The tip conductive path 1320 includes a first tip contact pad 1322, a second tip contact pad 1326 and a tip trace 1324 that connects the first tip contact pad 1322 to the second tip contact pad 1326. The ring conductive path 1330 includes a first ring contact pad 1332, a second ring contact pad 1336 and a ring trace 1334 that connects the first ring contact pad 1332 to the second ring contact pad 1336. As shown in FIGS. 43-45, in the depicted embodiment, the tip conductive path 1320 is on the top side of the printed circuit board 1310, and extends longitudinally from a front end 1312 of the printed circuit board 1310 to a rear end 1314 of the printed circuit board 1310. The ring conductive path 1330 is on the bottom side of the printed circuit board 1310, and extends longitudinally from the front end 1312 of the printed circuit board 1310 to the rear end 1314 of the printed circuit board 1310. The first tip contact pad 1322 and the second ring contact pad 1336 may be longitudinally aligned, and the first ring contact pad 1332 and the second tip contact pad 1326 may be longitudinally aligned.

Each of the contact pads 1322, 1326, 1332, 1336 is configured to mate with a respective contact of a mating cable connector. In FIG. 43, only the end portions of these contacts are depicted, while in FIGS. 44-45 the entire contact structure is shown. For example, as shown in FIG. 44, the tip and ring contact pads 1322, 1332 of inline connector 1300-1 mate with the respective tip and ring contacts 1220-1, 1220-2 of cable connector 1200-1 of a first connectorized cable (not shown), while the tip and ring contact pads 1326, 1336 of inline connector 1300-1 mate with the respective tip and ring contacts 1220-1, 1220-2 of cable connector 1200-2 of a second connectorized cable (not shown). Thus, each inline connector 1300 may be used to electrically connect tip contact 1220-1 of one of the cable connectors 1200 to the tip contact 1220-1 of another of the cable connectors 1200, and to electrically connect the ring contact 1220-2 of one of the cable connectors 1200 to the ring contact 1220-2 of another of the cable connectors 1200.

Tip contact pads 1322, 1326 may each reside in a first horizontally-oriented plane that is defined by the top surface of the printed circuit board 1310, and ring contact pads 1332, 1336 may each reside in a second horizontally-oriented plane that is defined by the bottom surface of the printed circuit board 1310 and that is parallel to the first horizontally-oriented plane. The tip trace 1324 and the ring trace 1334 each include a respective crossover segment 1325, 1335 that cause the tip conductive path 1320 to cross over the ring conductive path when viewed from above (or below) the printed circuit board 1310. This crossover may reduce the crosstalk between adjacent inline connectors 1300 (and between the cable connectors 1200 that mate with the inline connectors 1300), as will be discussed in further detail below.

As shown in FIGS. 43-45, the inline connectors 1300 may be very small, and may be positioned very close to each other. In some embodiments, the inline connectors 1300 may be less than 0.5 inches in length. For example, in the depicted embodiment, each inline connector 1300 may be about 0.3 inches in length. However, the close spacing of the inline connectors 1300 may also increase crosstalk between neighboring communications channels. In order to reduce the effects of such crosstalk, the inline connectors 1300 may be designed to have both differential and common mode crosstalk compensation.

When the inline connectors 1300 are mated with the cable connectors 1200 as shown in FIG. 44, the tip and ring contact pads 1322, 1332 of inline connector 1300-1 (as well as the tip and ring contacts 1220-1, 1220-2 of the cable connector 1200 that mate with contact pads 1322, 1332 of inline connector 1300-1) are staggered with respect to the tip and ring contact pads 1322, 1332 of inline connector 1300-2 (and tip and ring contacts 1220-1, 1220-2 of the cable connector 1200 that mate with contact pads 1322, 1332 of inline connector 1300-2). This staggered arrangement reduces the crosstalk between inline connectors 1300-1 and 1300-2.

In particular, as shown in FIG. 44, the tip contact pads 1322 of each inline connector 1300-1, 1300-2, 1300-3, 1300-4 are positioned farther to the right (in the view of FIGS. 43-44) than are the ring contact pads 1332 of each inline connector 1300. Additionally, the tip contact pads 1322 are positioned in a first, upper row, while the ring contact pads 1332 are positioned in a second, lower row. Various parameters such as, for example, the thickness of the printed circuit board 1310 (which may determine the vertical or z-direction distance between the tip contact pads 1322 and the ring contact pads 1332), the amount of transverse stagger between the contact pads 1322, 1332 (i.e., the x-direction distance between the tip and ring contact pads 1322, 1332), the distance between adjacent inline connectors 1300 (i.e., the x-direction center-to-center distance between inline connectors 1300-1 and 1300-2), the size and shape of the contact pads 1322, 1332, and the electrical characteristics (e.g., dielectric constant) of the printed circuit board 1310 and the media between the inline connectors 1300-1, 1300-2 may be selected so that little or no net coupling of signal energy may occur between the contact structures of adjacent inline connectors 1300. The contacts 1220-1, 1220-2 of the cable connectors 1200 may include a similar stagger so that there is little or no net coupling of signal energy between the contacts 1220-1, 1220-2 of adjacent cable connectors 1200.

For example, with reference to the right hand side of FIG. 44, the above parameters may be selected so that the sum of (1) the coupling from tip contact 1220-1 of cable connector 1200-1, tip contact pad 1322 of inline connector 1300-1 and tip trace 1324 (the portion from contact pad 1322 up to the crossover segment 1325) of inline connector 1300-1 onto tip contact 1220-1 of cable connector 1200-3, tip contact pad 1322 of inline connector 1300-2 and tip trace 1324 (the portion from contact pad 1322 up to the crossover segment 1325) of inline connector 1300-2 and (2) the coupling from ring contact 1220-2 of cable connector 1200-1, ring contact pad 1332 of inline connector 1300-1 and ring trace 1334 (the portion from contact pad 1332 up to the crossover segment 1335) of inline connector 1300-1 onto ring contact 1220-2 of cable connector 1200-3, ring contact pad 1332 of inline connector 1300-2 and ring trace 1334 (the portion from contact pad 1332 up to the crossover segment 1335) of inline connector 1300-2 is approximately equal to the sum of (1) the coupling from tip contact 1220-1 of cable connector 1200-1, tip contact pad 1322 of inline connector 1300-1 and tip trace 1324 (the portion from contact pad 1322 up to the crossover segment 1325) of inline connector 1300-1 onto ring contact 1220-2 of cable connector 1200-3, ring contact pad 1332 of inline connector 1300-2 and ring trace 1334 (the portion from contact pad 1332 up to the crossover segment 1335) of inline connector 1300-2 and (2) the coupling from tip contact 1220-1 of cable connector 1200-3, tip contact pad 1322 of inline connector 1300-2 and tip trace 1324 (the portion from contact pad 1322 up to the crossover segment 1325) of inline connector 1300-2 onto ring contact 1220-2 of cable connector 1200-1, ring contact pad 1336 of inline connector 1300-1 and ring trace 1334 (the portion from contact pad 1332 up to the crossover segment 1335) of inline connector 1300-1. Such a stagger may significantly reduce the differential crosstalk from cable connector 1200-1 and inline connector 1300-1 onto cable connector 1200-3 and inline connector 1300-2. As shown in FIG. 44, the same staggered arrangement may be provided on the left-hand side of inline connectors 1300-1 and 1300-2 which may significantly reduce the differential crosstalk from cable connector 1200-2 and inline connector 1300-1 onto cable connector 1200-4 and inline connector 1300-2 in the same fashion. The inline connectors 1300 may be designed so that substantially equal amounts of offending crosstalk and compensating crosstalk are injected at the same time along the length of the inline connector 1300

The same staggered arrangement may be provided between all of the inline connectors 1300-1, 1300-2, 1300-3, 1300-4 to provide the same or similar differential crosstalk cancellation as is provided between inline connectors 1300-1 and 1300-2 and their mating cable connectors 1200. Consequently, by arranging the tip and ring contact pads 1322, 1332 (and 1326, 1336) of adjacent inline connectors 1300 in a staggered pattern it is possible to substantially reduce the amount of differential crosstalk that is generated between adjacent inline connectors 1300.

The inline connectors 1300 are also designed to exhibit reduced mode conversion. This is accomplished by including a "crossover" along each tip and ring communications channel through the inline connectors 1300. In particular, for each of the inline connectors 1300, the tip conductive path 1320 crosses over the ring conductive path 1330 when viewed from above. This crossover occurs in the middle of each inline connector 1300 where crossover segment 1325 crosses over crossover segment 1335. As a result of this crossover, the tip conductive path 1320 and the ring conductive path 1330 of each inline connector 1300 will inject approximately equal amounts of signal energy onto the conductive paths of each adjacent inline connector 1300 (viewing the conductive paths of the adjacent inline connector as a single conductor).

Referring now to the right hand side of FIG. 44, an example will be provided to illustrate how the design of the cable connectors 1200 and the inline connectors 1300 may result in very low levels of mode conversion. Due to the close spacing of inline connectors 1300-1 and 1300-2, when an information signal is transmitted over cable connector 1200-1, signal energy will be coupled, for example, from tip contact 1220-1 of cable connector 1200-1 and from tip contact pad 1322 of inline connector 1300-1 onto both conductive paths of cable connector 1200-3 and both conductive pads 1322, 1332 of inline connector 1300-2. While some of this signal energy from tip contact 1220-1 of cable connector 1200-1 and from tip contact pad 1322 of inline connector 1300-1 will be cancelled out by the signal energy that is coupled from ring contact 1220-2 of cable connector 1200-1 and from ring contact pad 1332 of inline connector 1300-1 onto both conductive paths of cable connector 1200-3 and both conductive paths of inline connector 1300-2, the cancellation will be far from complete since tip contact 1220-1 of cable connector 1200-1 and tip contact pad 1322 of inline connector 1300-1 are closer to the conductive paths of cable connector 1200-3 and inline connector 1300-2 than are ring contact 1220-2 of cable connector 1200-1 and ring contact pad 1332 of inline connector 1300-1. Thus, a slightly reduced amount of common mode signal will be injected from tip contact 1220-1 of cable connector 1200-1 and from tip contact pad 1322 of inline connector 1300-1 onto the conductive paths of cable connector 1200-3 along the right hand side of inline connector 1300-2 (in the view of FIG. 44) when an information signal is transmitted over inline connector 1300-1.

However, when the transmitted information signal passes to the left hand side of inline connector 1300-1 (in the view of FIG. 44), then signal energy will be coupled from ring contact pad 1336 of inline connector 1300-1 and from ring contact 1220-2 of cable connector 1200-2 onto both conductive paths of inline connector 1300-2 and onto both conductive paths of cable connector 1200-4. While some of this signal energy from ring contact pad 1336 of inline connector 1300-1 and from ring contact 1220-2 of cable connector 1200-2 will be cancelled out by the signal energy that is coupled from tip contact pad 1326 of inline connector 1300-1 and from tip contact 1220-1 of cable connector 1200-2, the cancellation will be far from complete since ring contact pad 1336 of inline connector 1300-1 and ring contact

1220-2 of cable connector 1200-2 are closer to the conductive paths of inline connector 1300-2 and cable connector 1200-4 than are tip contact pad 1326 of inline connector 1300-1 and tip contact 1220-1 of cable connector 1200-2. Thus, a slightly reduced amount of common mode signal will be injected from ring contact pad 1336 of inline connector 1300-1 and ring contact 1220-2 of cable connector 1200-2 onto the conductive paths along the left hand side of inline connector 1300-2 and the conductive paths of cable connector 1200-4 (in the view of FIG. 44) when an information signal is transmitted over inline connector 1300-1.

In light of the symmetrical design of inline connectors 1300-1 and 1300-2, the two above-referenced common mode signals that are coupled from cable connectors 1200-1 and 1200-2 and inline connector 1300-1 onto the conductive paths of cable connectors 1200-3 and 1200-4 and inline connector 1300-2 may have substantially the same magnitude. Moreover, these two common mode couplings have opposite polarities (since the signals carried by the tip and ring conductive paths of a transmission line may be offset in phase by 180 degrees), and hence may substantially cancel each other. Thus, the cable connector and inline connector designs according to embodiments of the present invention may exhibit very low levels of mode conversion, which may reduce alien crosstalk in the communications system.

Figure 46A:
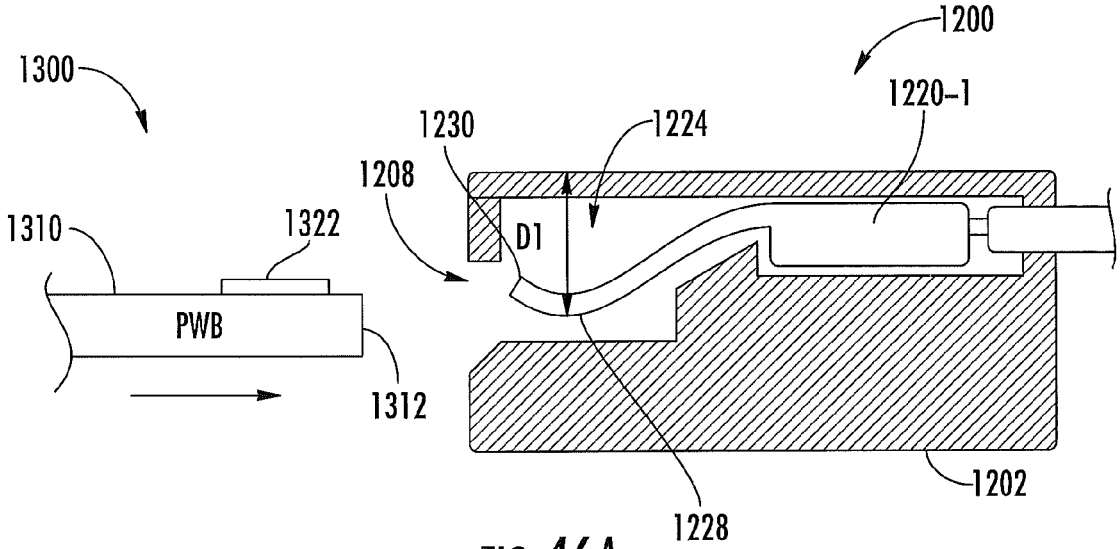
FIGS. 46A-46B are schematic cross-sectional views taken along the line 41A-41A of FIG. 40 that illustrate how the cable connector mates with the printed circuit board of one of the inline connectors of FIG. 43.
Figure 46B:
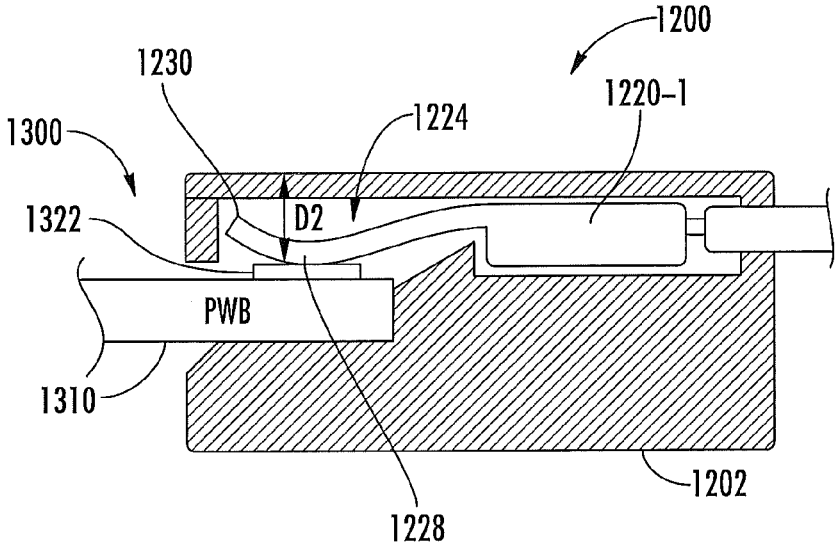

FIGS. 46A-46B are cross-sectional views taken along the line 41A-41A of FIG. 40 that illustrate how the cable connector 1200 mates with the printed circuit board of one of the inline connectors of FIG. 43. In particular, as shown in FIG. 46A, in its normal resting position, the contact region 1228 of tip contact 1220-1 of cable connector 1200 extends a distance D1 from the top of housing 1202. The printed circuit board 1310 of inline connector 1300 is inserted within the PCB aperture 1208 of connector 1200 (by moving the inline connector 1300 toward the cable connector 1200 and/or by moving the cable connector 1200 toward the inline connector 1300). As shown in FIG. 46B, as the printed circuit board 1310 moves into the PCB aperture 1208 of cable connector 1200, the front edge 1312 of printed circuit board 1310 engages the free end 1230 of contact 1220-1 forcing the distal portion 1224 of contact 1220-1 upwardly while the printed circuit board 1310 slides under the contact 1220-1. Once the inline connector 1300 is fully inserted within the PCB aperture 1208, the contact region 1228 of contact 1220-1 rests on top of the tip contact pad 1322 of inline connector 1300. While not shown in FIG. 46B, as the printed circuit board 1310 moves into the PCB aperture 1208 of cable connector 1200, the front edge 1312 of printed circuit board 1310 also engages the free end 1230 of contact 1220-2 forcing the distal portion 1224 of contact 1220-2 downwardly while the printed circuit board 1310 slides over contact 1220-2 so that the contact region 1228 of contact 1220-2 rests directly below the ring contact pad 1332 of inline connector 1300. As the distal portion 1224 of contacts 1220-1, 1220-2 are resilient, the contacts 1220-1, 1220-2 will physically engage their respective contact pads 1322, 1332 to provide a good electrical connection between the contacts 1220 and their respective contact pads 1322, 1332.

Figure 47:
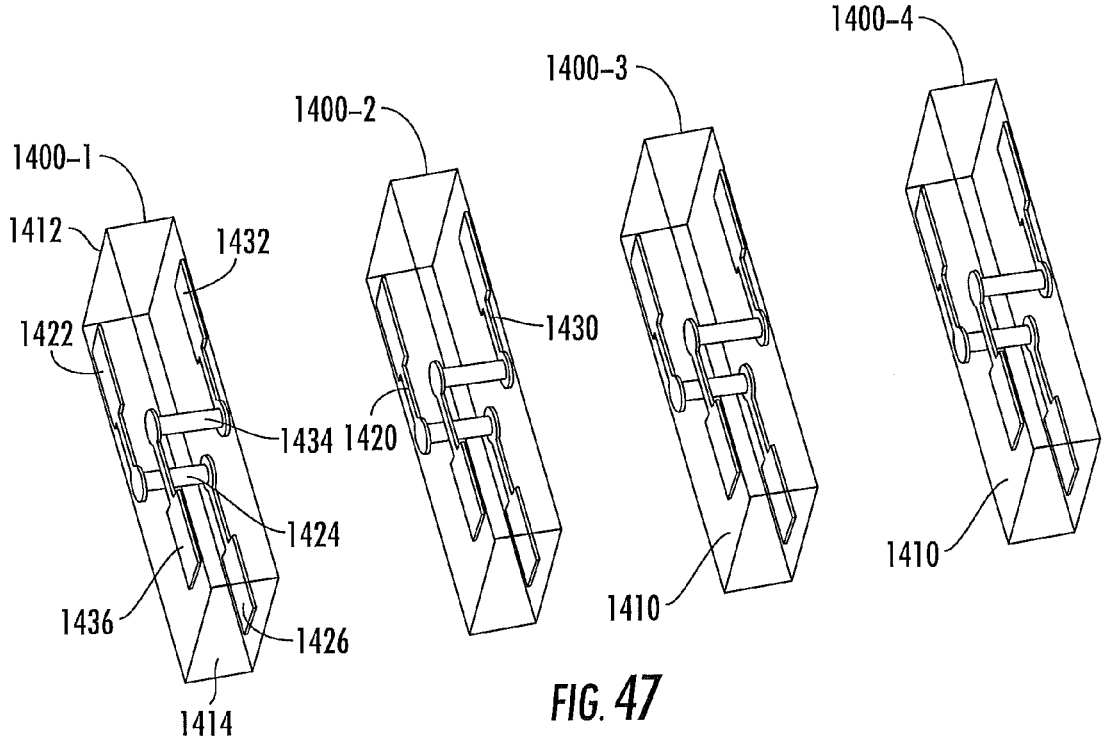
FIG. 47 is a schematic perspective view of four inline connectors according to further embodiments of the present invention with the housings thereof removed to clearly illustrate the conductive paths and contact structures of each inline connector.

FIG. 47 is a schematic perspective view of four inline connectors 1400 according to further embodiments of the present invention. The housings of the connectors 1400 have been omitted to more clearly show the conductive paths through the inline connectors 1400. The inline connectors 1400 of FIG. 47 may be similar to the inline connectors 1300 of FIGS. 43-45. In particular, the inline connectors 1400 include a printed circuit board 1410 that has a tip conductive path 1420 and a ring conductive path 1430 therethrough. The printed circuit boards 1410 of the inline connectors 1400 are rotated ninety degrees with respect to the printed circuit boards 1310 of connectors 1300 so that the top surface of the printed circuit board 1410 of each inline connector 1400 faces the bottom surface of printed circuit board 1410 of an adjacent inline connector 1400.

The tip conductive path 1420 includes a first tip contact pad 1422 that is on the top surface of the printed circuit board 1410, a second tip contact pad 1426 that is on the bottom surface of the printed circuit board 1410 and a tip trace 1424 that connects the first tip contact pad 1422 to the second tip contact pad 1426. The tip conductive path 1420 runs longitudinally from the front end 1412 to the rear end 1414 of the printed circuit board 1410. The tip trace 1424 includes a first segment on the top surface of the printed circuit board 1410, a second segment that is on the bottom surface of the printed circuit board 1410, and a conductive via that physically and electrically connects the first segment to the second segment.

The ring conductive path 1430 includes a first ring contact pad 1432 that is on the bottom surface of the printed circuit board 1410, a second ring contact pad 1436 that is on the top surface of the printed circuit board 1410 and a ring trace 1434 that connects the first ring contact pad 1432 to the second ring contact pad 1436. The ring conductive path 1430 also runs longitudinally from the front end 1412 to the rear end 1414 of the printed circuit board 1410. The ring trace 1434 includes a first segment on the bottom surface of the printed circuit board 1410, a second segment that is on the top surface of the printed circuit board 1410, and a conductive via that physically and electrically connects the first segment to the second segment.

The first tip contact pad 1422 and the second tip contact pad 1426 are not collinear since the tip trace 1424 includes the conductive via through the printed circuit board 1410. However, the first tip contact pad 1422, the second tip contact pad 1426 and the tip trace 1424 may be generally coplanar (i.e., a plane may be drawn that will intersect all three of the first tip contact pad 1422, the second tip contact pad 1426 and the tip trace 1424). Similarly, the first ring contact pad 1432 and the second ring contact pad 1436 are not collinear since the ring trace 1434 includes the conductive via through the printed circuit board 1410. However, the first ring contact pad 1432, the second ring contact pad 1436 and the ring trace 1434 may be generally coplanar (i.e., a plane may be drawn that will intersect all three of the first ring contact pad 1432, the second ring contact pad 1436 and the ring trace 1434).

Additionally, it can also be seen that the conductive vias that are included on the tip trace 1424 and on the ring trace 1434 of each printed circuit board 1410 are coplanar (i.e., all eight conductive vias in FIG. 47 may lie in a common plane). Additionally, the conductive vias on the tip traces 1424 on each of the printed circuit boards 1410 may be collinear (i.e., all four conductive vias on the four tip traces 1424 depicted in FIG. 47 are linearly aligned), and the conductive vias on the ring traces 1434 on each of the printed circuit boards 1410 may also be collinear.

As is readily apparent from a comparison of FIGS. 43 and 47, the tip and ring conductive paths 1320/1330; 1420/1430 of inline connectors 1300 and 1400 have the same general shape which includes a stagger between the tip and ring contact pads of adjacent inline connectors and a crossover of the tip and ring conductive paths of each inline connector 1300, 1400 when viewed from above. Consequently, the inline connectors 1400 will also exhibit low levels of differential and common mode crosstalk for the same reasons, discussed above, that the inline connectors 1300 exhibit low levels of differential and common mode crosstalk.

Figure 48:
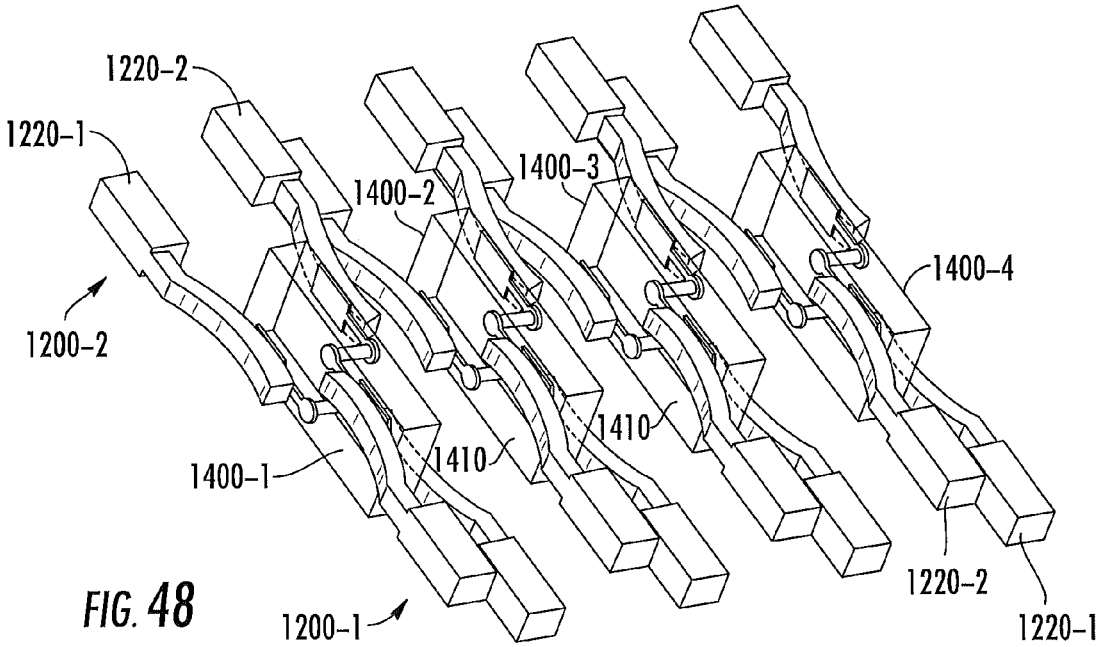
FIG. 48 is a schematic perspective view of the four inline connectors of FIG. 47 with the contacts of eight mating cable connectors included to illustrate the communications paths through each mated set of an inline connector and two cable connectors.

FIG. 48 is a schematic perspective view of the four inline connectors 1400 of FIG. 47 with the contacts 1220 of eight mating cable connectors 1200 also depicted to illustrate the communications paths through each mated set of an inline connector and two cable connectors. As shown in FIG. 48, a contact 1220 mates with each of the contact pads 1422, 1426, 1432, 1436. As with the embodiment of FIGS. 43-45, the inline connectors 1400 are designed so that the contacts 1220 of the mating cable connectors 1200 are generally longitudinally aligned with the tip and ring contact pads of the inline connectors 1400. As such, the contacts 1220 of adjacent cable connectors 1200 (when the cable connectors are mated with the inline connectors 1400) maintain the same general staggered arrangement that compensates for differential crosstalk between adjacent cable connectors 1200.

Figure 49:
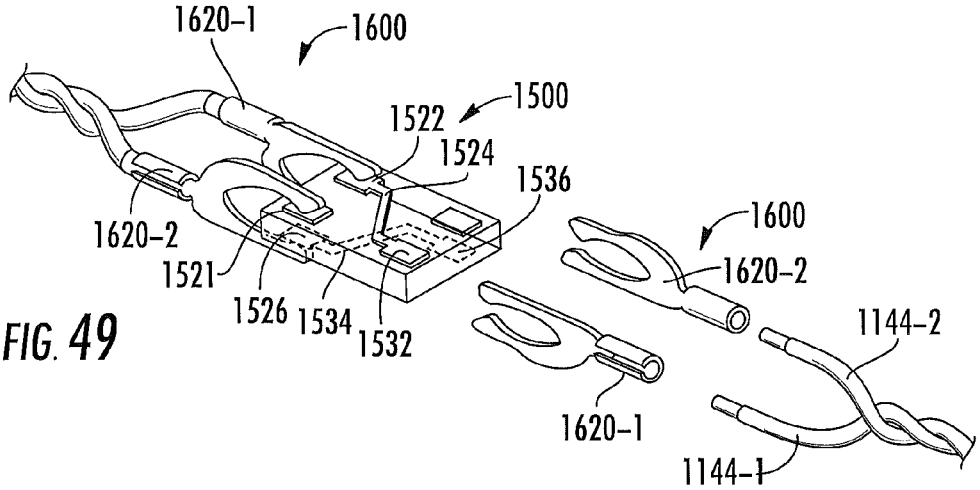
FIG. 49 is a schematic, partially exploded, perspective view of an inline connector according to still further embodiments of the present invention mated with two cable connectors according to further embodiments of the present invention with the housings of each connector omitted.
Figure 50A:
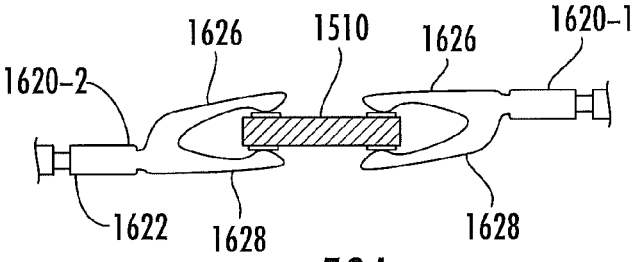
FIG. 50A is a schematic side view of the mated connectors of FIG. 49.
Figure 50B:
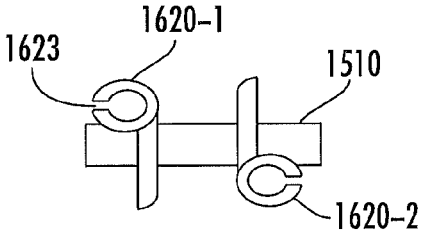
FIG. 50B is a schematic end view of the contacts of one of the cable connectors of FIG. 49 engaging a printed circuit board of the inline connector of FIG. 49.
Figure 51A:
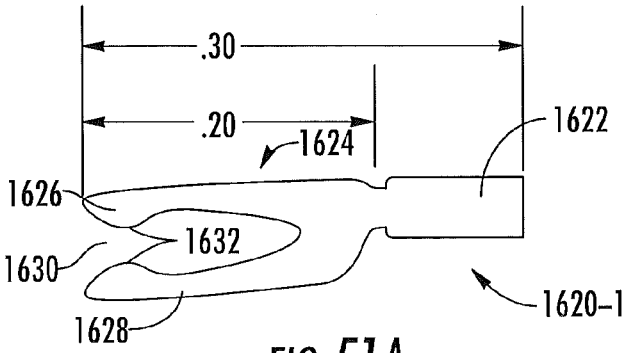
FIGS. 51A-51B are a side view and an end view, respectively, of one of the contacts of the cable connector of FIG. 49.
Figure 51B:
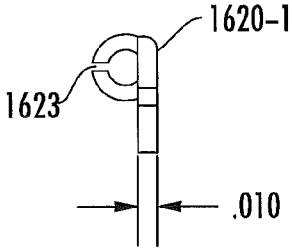

FIGS. 49, 50A-50B and 51A-51B illustrate an inline connector 1500 and a cable connector 1600 according to further embodiments of the present invention. In particular, FIG. 49 is a schematic, partially exploded, perspective view of the inline connector 1500 mated with two of the cable connectors 1600 with the housings of each connector 1500, 1600 omitted. FIG. 50A is a schematic side view of the mated connectors 1500, 1600 of FIG. 49, and FIG. 50B is a schematic end view of the contacts of one of the cable connectors 1600 engaging the printed circuit board of the inline connector 1500. FIGS. 51A-51B are a side view and an end view, respectively, of one of the contacts of one of the cable connectors 1600.

As shown in FIG. 49, the inline connector 1500 may be almost identical to the inline connector 1300 discussed above with reference to FIGS. 43-45, with the only exception being that the jogs on the tip trace 1524 and the ring trace 1534 of connector 1500 are at about a forty-five degree angle with respect to a longitudinal axis of the printed circuit board 1510 of connector 1500, whereas the jogs on the tip trace 1324 and the ring trace 1334 of connector 1300 are at about a ninety degree angle with respect to a longitudinal axis of the printed circuit board 1310 of connector 1300. Accordingly, further discussion of the inline connector 1500 will be omitted.

The cable connector 1600 may be similar to the cable connector 1200 that is described above with reference to FIGS. 39-42. However, the cable connector 1600 includes a pair of contacts 1620-1, 1620-2 that each grasp both the top and bottom surfaces of the printed circuit board 1510 of inline connector 1500, as is shown best in FIGS. 49 and 50A. The contacts 1620 may be somewhat larger than the contacts 1220 of cable connector 1200, and hence higher amounts of coupling may occur between the contacts of adjacent cable connectors 1600 as compared to the cable connectors 1200 discussed above. However, the contacts 1620 may be more robust and less susceptible to damage during use.

The contacts 1620 may comprise a tip contact 1620-1 and a ring contact 1620-2, which may be identical to each other. As shown in FIGS. 49-51, each contact 1620 includes a base 1622 and a distal portion 1624. The base 1622 may be in the form of a hollow cylinder, while the distal portion 1624 may comprise a pair of cantilevered arms 1626, 1628, one signal carrying and one non-signal carrying that define an opening 1630 therebetween. The minimum distance between the arms 1626, 1628 (i.e., the narrowest gap width at the contact region 1632 of the opening 1630) may be less than the thickness of the printed circuit board 1510 of inline connector 1500. End portions of the arms 1626, 1628 are configured to engage a front (or rear) edge of printed circuit board 1510 when the contact 1620 mates with the inline connector 1500. The front edge of printed circuit board 1510 forces the arms 1626, 1628 to separate farther apart by forcing arm 1626 to move upwardly so as to engage the top surface of printed circuit board 1510 and to force arm 1628 to move downwardly to engage the bottom surface of printed circuit board 1510. Once the connectors 1500 and 1600 are fully mated, a contact region 1632 of arm 1626 of contact 1620-1 and a contact region 1632 on arm 1628 of contact 1620-2 will contact the respective tip and ring contact pads 1522, 1526 of inline connector 1500. An additional isolated pad such as 1521 may be provided to provide a smooth surface for the non-signal carrying cantilevered arm, whether 1626 or 1628, to slide on when it engages a respective surface of the printed circuit board 1510.

Each contact 1620 may be formed of a resilient metal such as, for example, beryllium-copper or phosphor-bronze. This resiliency allows the arms 1626, 1628 to be spread apart when the contact 1620 mates with printed circuit board 1510 but then return to their normal resting position when the cable connector 1600 is detached from inline connector 1500. The resiliency also ensures that each contact 1620 make a good mechanical and electrical connection with its mating tip or ring contact pad 1522, 1526, 1532, 1536.

In some embodiments, the contacts 1620 may be formed from sheet metal using stamping and rolling operations. This may provide for low-cost contacts 1620. As shown in FIGS. 51A-51B, in one specific embodiment, the contact 1620 may be about 0.30 inches long, with the base portion 1622 being about 0.1 inches long, the distal portion 1624 being about 0.2 inches long, and the contact 1620 being formed from a sheet of 0.01 inch sheet metal. As shown in FIGS. 49, 50B and 51B, in such embodiments the base 1622 may include a longitudinal slit 1623 that results from the rolling operation.

The housing (not shown) for cable connector 1600 may be similar to the housing 1202 of cable connector 1200, except that the PCB aperture included in the housing for cable connector 1600 may extend further in the vertical direction since each contact 1620 is designed to engage both the top and bottom surfaces of the printed circuit board 1510 of inline connector 1500.

While the cable connectors 1200, 1600 and the inline connectors 1300, 1400, 1500 that are discussed above and depicted in the figures each include a single tip and ring communications channel per connector, it will be appreciated that according to further embodiments of the present invention, cable connectors and inline connectors may be provided that include two, three or more tip and ring communications channels.

Figure 52:
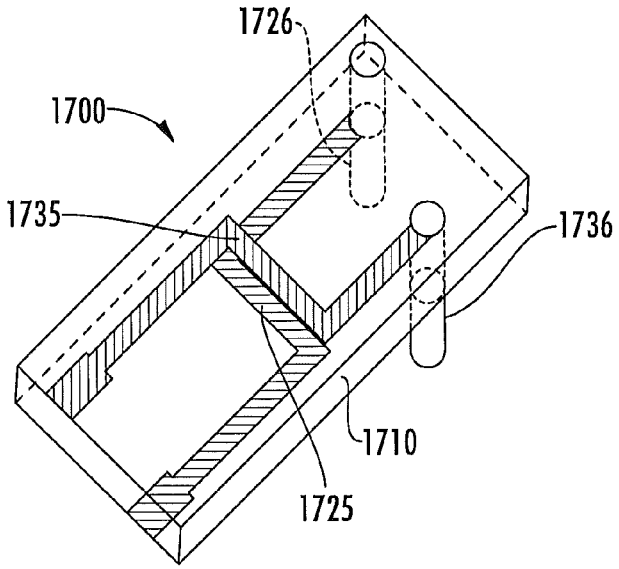
FIG. 52 is a schematic perspective view of a printed circuit board mounted connector according to embodiments of the present invention.
Figure 53:
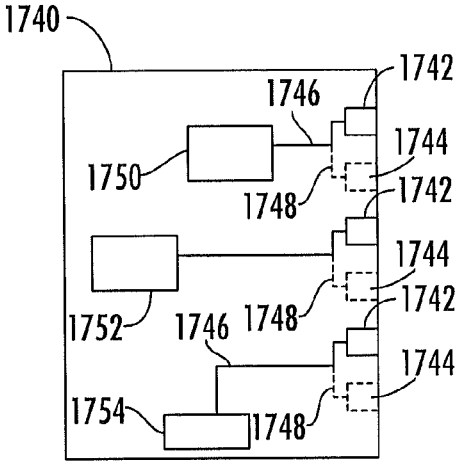
FIG. 53 is a schematic perspective view of a portion of a printed circuit board of an electronic device that includes contact pads for electrically connecting to a connectorized cable according to embodiments of the present invention.

While embodiments of the present invention may provide inline connectors, it will be appreciated that the same concepts discussed above may also be used to provide printed circuit board connectors (e.g., connectors 330 and 390 of FIG. 15). FIGS. 52 and 53 illustrate two examples of such a printed circuit board connectors.

In particular, FIG. 52 is a schematic perspective view of a printed circuit board mounted connector 1700 according to further embodiments of the present invention. In FIG. 52, the housing of the connector 1700 has been omitted to more clearly illustrate the tip and ring conductive paths through the connector 1700.

As shown in FIG. 52, the left hand side of connector 1700 may be similar to the lower portion of one of the inline connectors 1300 that is discussed above with respect to FIGS. 43-44. However, the contact pads 1326, 1336 that are included on the upper portion of the inline connector 1300 are replaced with right-angled conductive pins 1726, 1736 that are suitable for mounting in a printed circuit board of an electronic device (not shown). Typically, a plurality of the connectors 1700 would be mounted in a row on the printed circuit board of the electronic device just like a plurality of the inline connectors 1300 are mounted in a row. In order to control differential crosstalk between adjacent printed circuit board connectors 1700, the pins 1726, 1736 are staggered in the longitudinal direction. As illustrated in FIG. 52, and to control common mode conversion, the stagger should be configured such that pin 1726, which intercepts the conductive trace on the bottom surface of printed circuit board 1710, may be closer to the rear edge of the printed circuit board 1710 than is pin 1736, which intercepts the conductive trace on the top of printed circuit board 1710. Doing so tends to reduce mode conversion by equalizing the tip conductive path and the ring conductive path signal travel lengths between the crossover segments 1725 and 1735 and the top surface of the printed circuit board of the electronic device.

Pursuant to still further embodiments of the present invention, the printed circuit board of an electronic device may be designed so that cable connectors according to embodiments of the present invention may be directly connected to, or integrated within, the printed circuit board. FIG. 53 is a schematic perspective view of a portion of a printed circuit board 1740 of an electronic device that includes contact pads for electrically connecting to a connectorized cable according to embodiments of the present invention.

As shown in FIG. 53, the printed circuit board 1740 may include a plurality of tip contact pads 1742 on a top surface thereof and a plurality of ring contact pads 1744 on a bottom surface thereof. The tip and ring contact pads 1742, 1744 may be arranged in a staggered pattern that is similar or identical to the staggered pattern of the tip and ring contact pads 1322, 1332 of inline connector 1300. Conductive traces 1746, 1748 may connect the contact pads 1742, 1744, respectively to a plurality of integrated circuit chips 1750, 1752, 1754 that are mounted on printed circuit board 1740. These traces 1746, 1748 may be arranged to have low coupling with adjacent conductive traces 1746, 1748, as is shown in FIG. 53. While not shown in FIG. 53, suitable features such a plastic housing structure or grooves, notches or the like in printed circuit board 1740 may be provided so that cable connectors such as cable connectors 1200 or 1600 may mate with the printed circuit board 1740 and be latched into place so that the cable connectors will not come loose during ordinary use.

Pursuant to still further embodiments of the present invention, cable connectors are provided that may directly mate with each other, thereby removing any need for inline connectors. A communications system that includes such cable connectors will now be discussed with reference to FIGS. 54 and 55.

Figure 54:
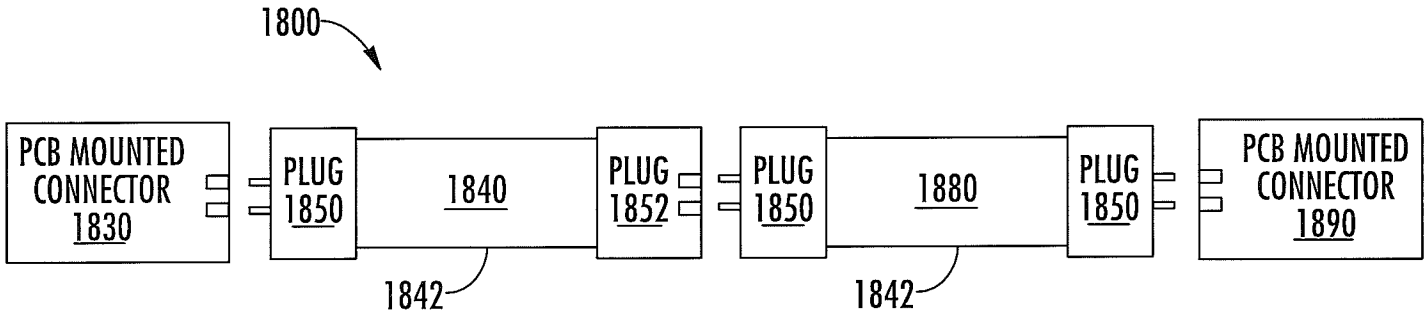
FIG. 54 is a schematic block diagram of another communications system in which connectors according to embodiments of the present invention may be used.

In particular, FIG. 54 is a schematic block diagram of a communications channel 1800 which includes at least two connectorized cable assemblies 1840, 1880 that does not require the use of an inline connector. The communications channel 1800 may extend from a first electronic device to a second electronic device. It will be appreciated that a plurality of communications channels 1800 will typically be provided as shown above with respect to FIG. 15, but only a single communications channel is shown in FIG. 54 in order to simplify the description.

As shown in FIG. 54, a printed circuit board connector 1830 may be mounted on a printed circuit board of the first electronic device, and a second printed circuit board connector 1890 may be mounted on a printed circuit board of the second electronic device. In some embodiments, the printed circuit board connectors 1830, 1890 may be identical to the printed circuit board connectors 330, 390 that are discussed above with reference to FIG. 15. A pair of connectorized cables 1840, 1880 may extend between the first and second printed circuit board connectors 1830, 1890.

Figure 55:
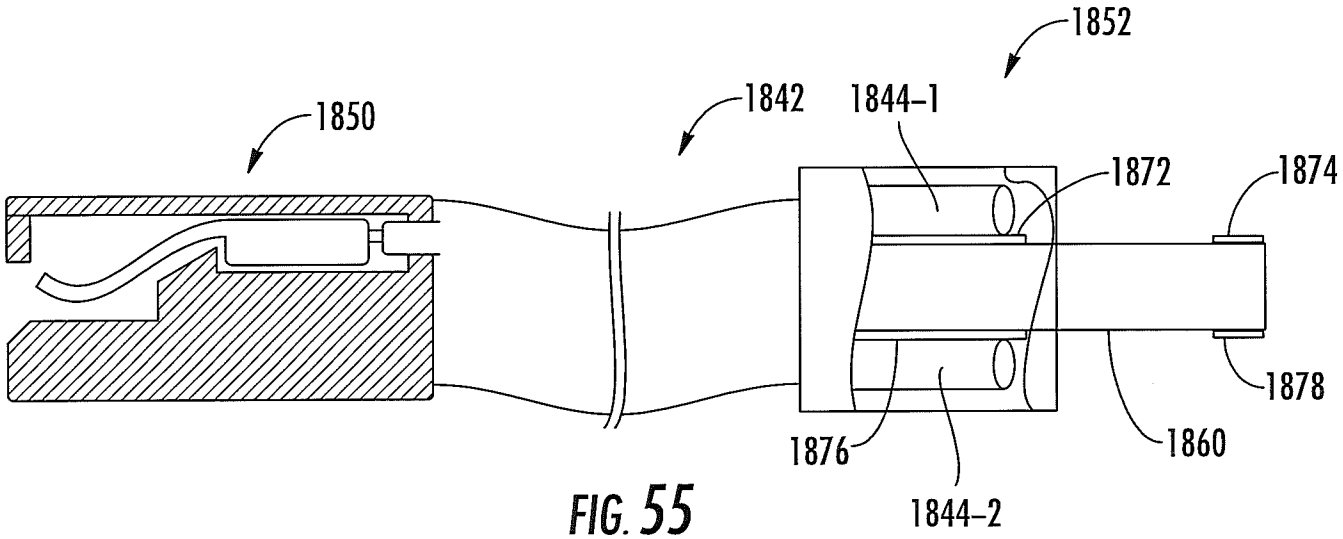
FIG. 55 is a schematic side view of a connectorized cable according to further embodiments of the present invention.

As is further shown in FIG. 54, the connectorized cable 1840 may include a communications cable 1842 that has cable connectors 1850, 1852 mounted on the respective ends thereof. The communications cable 1842 may be identical to the communications cable 122 depicted in FIG. 39 above, and hence further description thereof will be omitted. FIG. 55 is a schematic side view of connectorized cable 1840 that illustrates the cable connectors 1850, 1852 in further detail.

As shown in FIG. 55, the cable connector 1850 may be a plug connector that is similar or identical to plug connector 1200 that is discussed above with reference to FIG. 39. Accordingly, further description of cable connector 1850 will be omitted. In contrast, cable connector 1852 may comprise a jack connector that is designed to mate with a cable connector 1850. Cable connector 1852 includes a printed circuit board 1860 that has a tip conductive path on a top surface thereof and a ring conductive path on a bottom surface thereof. The printed circuit board 1860 may be similar or identical to the printed circuit board 1310 of inline connector 1300 that is discussed above with reference to FIGS. 43-45. Accordingly, the tip conductive path includes a first tip contact pad 1872, a second tip contact pad 1874 and a tip trace (not visible) that connects the first tip contact pad 1872 to the second tip contact pad 1874. The ring conductive path includes a first ring contact pad 1876, a second ring contact pad 1878 and a ring trace (not visible) that connects the first ring contact pad 1876 to the second ring contact pad 1878. The first tip contact pad 1872 and the second ring contact pad 1878 may be longitudinally aligned, and the first ring contact pad 1876 and the second tip contact pad 1874 may be longitudinally aligned.

The tip and ring contact pads 1872, 1876 may comprise solder pads. An end portion of the insulation of the insulated tip conductor of cable 1842 may be removed and the exposed end portion of the tip conductor 1844-1 may, for example, be soldered to the tip solder pad 1872. Similarly, an end portion of the insulation of the insulated ring conductor 1844-2 of cable 1842 may be removed and the exposed end portion of the ring conductor may, for example, be soldered to the ring solder pad 1876. In contrast, each of the tip and ring contact pads 1874 and 1878 is configured to mate with a respective contact of a mating plug connector 1850. While in the depicted embodiment the tip and ring conductors 1844-1, 1844-2 of cable 1842 are soldered to respective tip and ring solder pads 1872, 1876 on printed circuit board 1860, it will be appreciated that in other embodiments other mechanisms may be used to electrically connect the conductors 1844-1, 1844-2 of cable 1842 to the printed circuit board 1860 including, for example, insulation piercing contacts, welding operations, direct interference fit, etc.

Referring again to FIG. 54, it can be seen that the cable connector 1852 of connectorized cable 1840 is mated with cable connector 1850 of connectorized cable 1880. As discussed above, connectors 1850 and 1852 may comprise plug and jack connectors, respectively, that are designed to mate with each other and which have staggered contacts and crossovers that may provide the same type of differential and common mode crosstalk cancellation as a connection between a cable connector 1200 and an inline connector 1300. Note that connectorized cable 1880 includes plug connectors 1850 on both ends thereof (which is different than connectorized cable 1840) so that connectorized cable 1880 may mate with printed circuit board connector 1890.

The communications channel 1800 does not include any inline connector, and therefore may represent a reduced cost solution. The communications channel 1800 also has one less connection point as compared to, for example, communications channel 320-1 of FIG. 15, which may also reduce the amount of crosstalk introduced between communications channel 1800 and a neighboring communications channel.

While in the embodiment of FIG. 55 cable connector 1850 comprises a plug connector and cable connector 1852 comprises a jack connector, it will be appreciated that in other embodiments the housing structures may be appropriately modified so that cable connector 1850 comprises a jack connector and cable connector 1852 comprises a plug connector.

While the inline connectors 1300, 1400, 1500 and other similarly designed connectors (e.g., connector 1700) that are discussed above use contact pads, it will be appreciated that other contact structures may be used. For example, in further embodiments, the contact pads could be replaced with printed circuit board mounted pins. In such an embodiment, the contacts 1220 of plug connectors 1200 could be replaced with socket contacts that receive the pin such as, for example, the socket contacts 910, 920 depicted in FIGS. 30-34 above.

Figure 56:
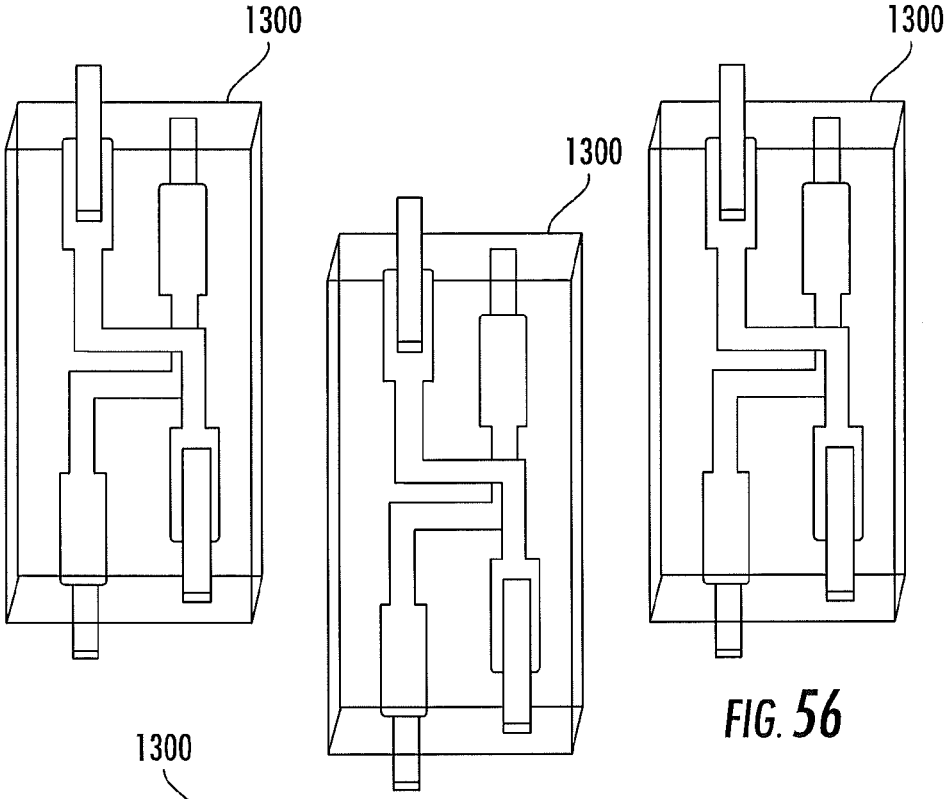
FIGS. 56-59 are schematic views illustrating how the inline connectors of FIG. 43 may be arranged in different orientations according to further embodiments of the present invention.
Figure 57:
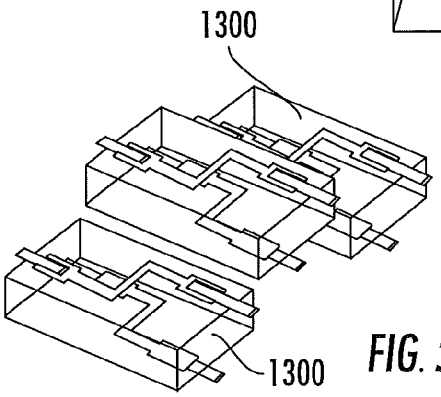
Figure 58:
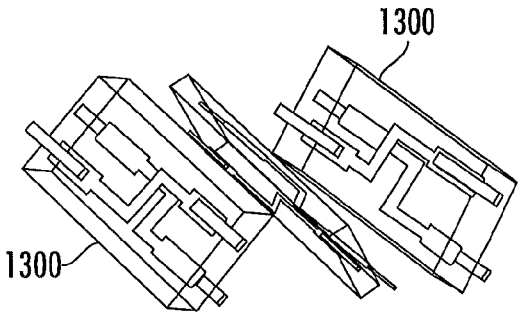

FIGS. 56-59 are schematic views illustrating how the inline connectors 1300 of FIG. 43 may be arranged in different orientations according to further embodiments of the present invention. In particular, as shown in FIG. 56, in some embodiments, the inline connectors 1300 may not be perfectly aligned side-by-side in a row as is shown in the embodiment of FIG. 43. This may negatively impact the common mode crosstalk compensation between adjacent inline connectors 1300, but the offset may be small and/or other changes may be made to the connector design to ensure that sufficient common mode crosstalk compensation is provided. As shown in FIG. 57, in other embodiments, the inline connectors 1300 may not be perfectly coplanar as is shown in the embodiment of FIG. 43. The non-coplanar configuration of FIG. 57 may negatively impact the differential crosstalk compensation between adjacent inline connectors 1300, but again the vertical the offset may be made small and/or other changes may be made to the connector design to ensure that sufficient differential crosstalk compensation is provided. As shown in FIG. 58, in still further embodiments, the inline connectors 1300 may be angled with respect to adjacent of the inline connectors 1300. As with the embodiment of FIG. 57, this angling of adjacent inline connectors 1300 may negatively impact the differential-to-differential crosstalk compensation between adjacent inline connectors 1300.

Figure 59:
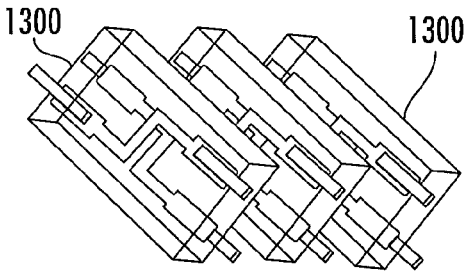

Finally, as shown in FIG. 59, in still other embodiments, each of the inline connectors 1300 may be rotated by the same angle. This technique may provide a convenient way to tune the performance of a connector system that includes multiple of the connectors 1300.

While the above-described inline connectors include printed circuit boards with contact pads thereon and cable connectors (e.g., plug connectors) that include spring contacts that mate with the contact pads, it will be appreciated that in other embodiments the contact structures may be reversed so that the inline connectors have spring contacts and the cable connectors have printed circuit boards with contact pads thereon. It will be appreciated that in further embodiments a single, larger printed circuit board encompassing more than one inline connector may be used. Thus, references to a "first printed circuit board" and a "second printed circuit board" can be referring to either two separate printed circuit boards or to two regions of a common printed circuit board, unless indicated otherwise.

As discussed above, pursuant to embodiments of the present invention, connectors that have contacts with crossovers may be used to implement communications channels that connect end devices in vehicles, industrial applications and other harsh environments. FIGS. 60-68 below illustrate various contact crossover configurations that may be used to implement these connectors and additional connector embodiments.

Figure 60A:
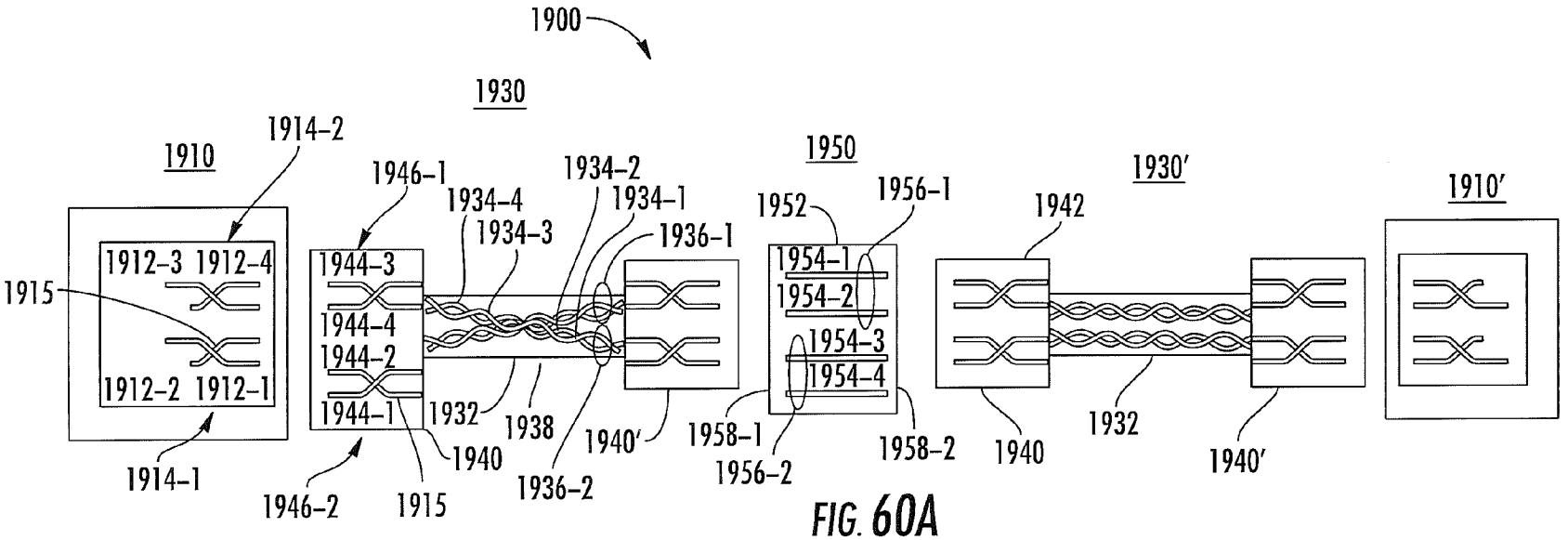
FIGS. 60A and 60B are top and side schematic views of a communications channel according to certain embodiments of the present invention.
Figure 60B:
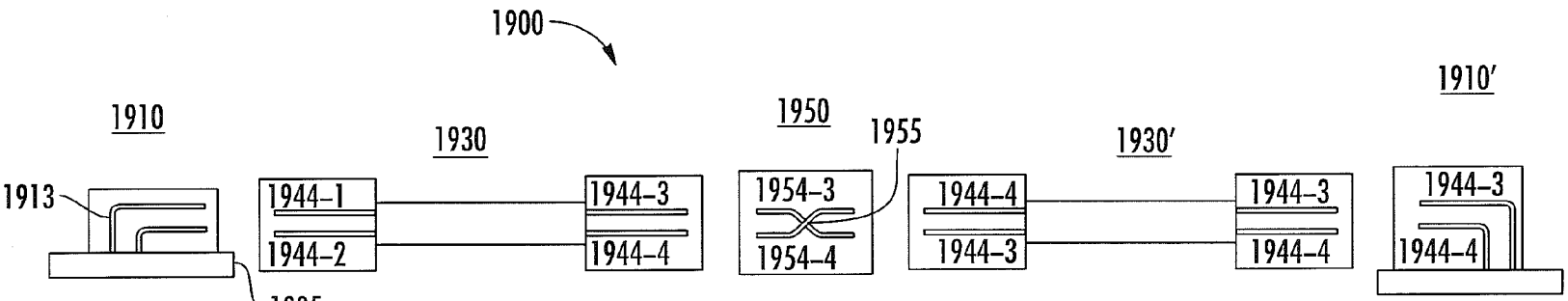

Referring first to FIGS. 60A and 60B, a communications channel 1900 according to certain embodiments of the present invention is schematically illustrated. FIG. 60A is a schematic top view of the connectors and cable assemblies that are used to implement the communications channel 1900, while FIG. 60B is a schematic side view of the connectors and patch cords that are used to implement the communications channel 1900.

As shown in FIGS. 60A and 60B, the communications channel includes a first end connector 1910, a cable assembly 1930, an inline connector 1950, a second cable assembly 1930' and a second end connector 1910'. The end connector 1910 may comprise, for example, a pin connector, although, as discussed below, a variety of different types of contact structures could be used. In the depicted embodiment, the end connector 1910 is mounted on a printed circuit board 1905. The end connector 1910 may include a plurality of contacts 1912. In the depicted embodiment, the end connector 1910 includes a total of four contacts 1912-1 through 1912-4 that are arranged as a first pair of contacts 1914-1 (consisting of contacts 1912-1 and 1912-2) for carrying a first information signal and as a second pair of contacts 1914-2 (consisting of contacts 1912-3 and 1912-4) for carrying a second information signal. The contacts 1912 of each connector 1910 include a right angle portion 1913 that is commonly provided on printed circuit board mounted connectors so that the contacts 1912 may be inserted directly into corresponding conductive apertures (not shown) in the printed circuit board 1905 while the plug aperture of the end connector 1910 may have an insertion axis that is parallel to the top surface of the printed circuit board 1905.

As shown in FIG. 60A, each of the pairs of contacts 1914-1, 1914-2 includes a crossover 1915 when viewed from above (i.e., in the top view). These crossovers 1915 may reduce the amount of crosstalk that is generated between the pairs 1914-1, 1914-2 in the end connector 1910. As shown in FIG. 60B, the pairs of contacts 1914-1, 1914-2 do not include a crossover when viewed from the side.

The end connector 1910 may be implemented, for example, as a pin connector (i.e., the connector has pin contacts). In the particular embodiment depicted in FIGS. 60A and 60B, the pairs of contacts 1914-1 and 1914-2 are laterally spaced apart from each other, and the connector only includes two pairs of contacts.

The second end connector 1910' may be identical to the first end connector 1910. Accordingly, further description of the connector 1910' will be omitted.

The first cable assembly 1930 may include a cable portion 1932 that has a first plug 1940 mounted on one end thereof and a second plug 1940' that is mounted on the other end thereof. The cable portion 1932 may include four insulated communications conductors 1934-1 through 1934-4 that are arranged as two twisted pairs of insulated conductors 1936-1 (comprising conductors 1934-1 and 1934-2) and 1936-2 (comprising conductors 1934-3 and 1934-4). The twisted pairs 1936-1, 1936-2 may be enclosed in a cable jacket 1938, and additional structures such as, for example, a tape separator (not shown) may be included in the cable portion 1932 to separate the twisted pairs 1936-1, 1936-2 from each other. The twisted pairs 1936-1, 1936-2 and any separator may be twisted together in a so-called core twist. Each twisted pair 1936-1, 1936-2 may be implemented, for example, in the same manner as a twisted pair of an Ethernet communications cable that is compliant with the above-referenced Category 6a standard.

The plugs 1940, 1940' may be identical. Each plug 1940, 1940' may include a plug housing 1942 and a plurality of plug contacts 1944-1 through 1944-4 (arranged as two pairs of plug contacts 1946-1, 1946-2) that are electrically connected to the respective insulated conductors 1934-1 through 1934-4. The plug contacts 1944-1 through 1944-4 may include any appropriate wire termination that provides the mechanical and electrical connection to its respective insulated conductor 1934-1-1934-4. Such wire connections include IDCs, crimp connections, soldered connections, resistance welds or other known terminations. Moreover, the connections can be direct connections or through intermediate structures such as, for example, a printed circuit board (i.e., an IDC that receives an insulated conductor 1934 may be mounted on a back end of a printed circuit board and the plug contact 1944 may be mounted on the front end of the printed circuit board, and a conductive trace may electrically connect the IDC to the plug contact 1944). As shown in FIG. 60A, each of the pairs of contacts 1946-1, 1946-2 includes a crossover 1915 when viewed from above (i.e., in the top view). As shown in FIG. 60B, the pairs of plug contacts 1946-1, 1946-2 do not include a crossover when viewed from the side. As is discussed in greater detail below, a wide variety of different types of contacts may be used to implement the plug contacts 1944-1 through 1944-4.

The second cable assembly 1930' may be identical to the first cable assembly 1930. Accordingly, further description of the cable assembly 1930' and the plugs 1940, 1940' mounted thereon will be omitted.

The inline connector 1950 may include a housing 1952 and first and second plug apertures 1958-1, 1958-2. The first plug aperture 1958-1 may receive the plug 1940' of the first cable assembly 1930 and the second plug aperture 1958-2 may receive the plug 1940 of the second cable assembly 1930'. A plurality of inline contacts 1954-1 through 1954-4 are provided which are arranged as two pairs of contacts 1956-1, 1956-2. In the depicted embodiment, the inline contacts 1954-1 through 1954-4 are configured to mate with the respective contacts 1944-1 through 1944-4 of the plugs 1940 and 1940' and hence are implemented as jack contacts that are designed to mate with the plug contacts 1944-1 through 1944-4 As is discussed in greater detail below, a wide variety of different types of contacts may be used to implement the plug contacts 1944-1 through 1944-4. It will also be appreciated that in other embodiments the inline connector 1950 may be a double-sided plug connector and the cable assemblies 1930, 1930' may have jack connectors mounted on the ends thereof instead of plugs 1940, 1940'. In such embodiments, the inline contacts 1954-1 through 1954-4 would be implemented as plug contacts.

As shown in FIG. 60B, each of the pairs of jack contacts 1956-1, 1956-2 includes a crossover 1955 when viewed from the side. However, as shown in FIG. 60A, the pairs of jack contacts 1956-1, 1956-2 do not include a crossover when viewed from above. Thus, each of the pairs of plug contacts 1946-1, 1946-2 in plugs 1940 and 1940' includes a crossover (i.e., the contacts of the pair cross over each other) when viewed from a first direction, while the pairs of jack contacts 1956-1, 1956-2 in inline connector 1950 each include a crossover when viewed from a second direction that is normal to the first direction. This arrangement provides an inline connector 1950 having high crosstalk performance that can receive the same type of plug in each plug aperture thereof.

The communications channel 1900 depicted in FIGS. 60A and 60B may be well-suited for automotive applications. It will be appreciated that while FIGS. 60A and 60B illustrate a communications channel that includes two cable assemblies 1930, 1930' and one inline connector 1950, in some cases the communications channel may include additional or fewer elements (e.g., additional cable assemblies and inline connectors).

As noted above, in some embodiments, the end connectors 1910, 1910' may comprise pin (or blade) connectors and the plugs 1940, 1940' may comprise socket connectors so that each mated plug-jack connection is formed using pin- and socket connections. However, it will be appreciated that a wide variety of different plug and jack contacts may be used. For example, in other embodiments, the plugs 1940, 1940' may comprise pin connectors and the end connectors 1940, 1940' may comprise socket connectors. In still further embodiments, the contacts in both the end connectors 1910, 1910' and the plugs 1940, 1940' may comprise insulation displacement contacts (IDCs). In still other embodiments, the contacts in one of the connectors (e.g., the jack) may comprise IDCs and the contacts in the mating connector (e.g., the plug) may comprise blade contacts. In yet other embodiments, the contacts in one of the connectors (e.g., the jack) may comprise cantilevered beams and the contacts in the mating connector (e.g., the plug) may comprise blade contacts. Thus, it will be appreciated that a wide variety of different contacts may be used that are formed with the crossover configurations illustrated in FIGS. 60A and 60B and in the figures of other embodiments of the present invention which are discussed herein.

Likewise, it will be appreciated that the end connectors 1910 and/or the inline connector 1950 could be implemented as plug connectors and that in such embodiments the corresponding plug connectors on the cable assemblies 1930, 1930' would be replaced with jack connectors.

The communications channel 1900 of FIGS. 60A and 60B may be implemented using two different connector designs (namely an end connector 1910 and an inline connector 1950) and a single cable assembly design. This may advantageously reduce the amount of different parts that are required to implement the channel 1900. Moreover, as each mated plug-jack connection includes a plurality of crossovers on each pair of conductive paths through the mated connector, it is anticipated that the communications channel can be designed to have relatively low levels of crosstalk and that the channel will support high data rate communications.

Figure 61A:
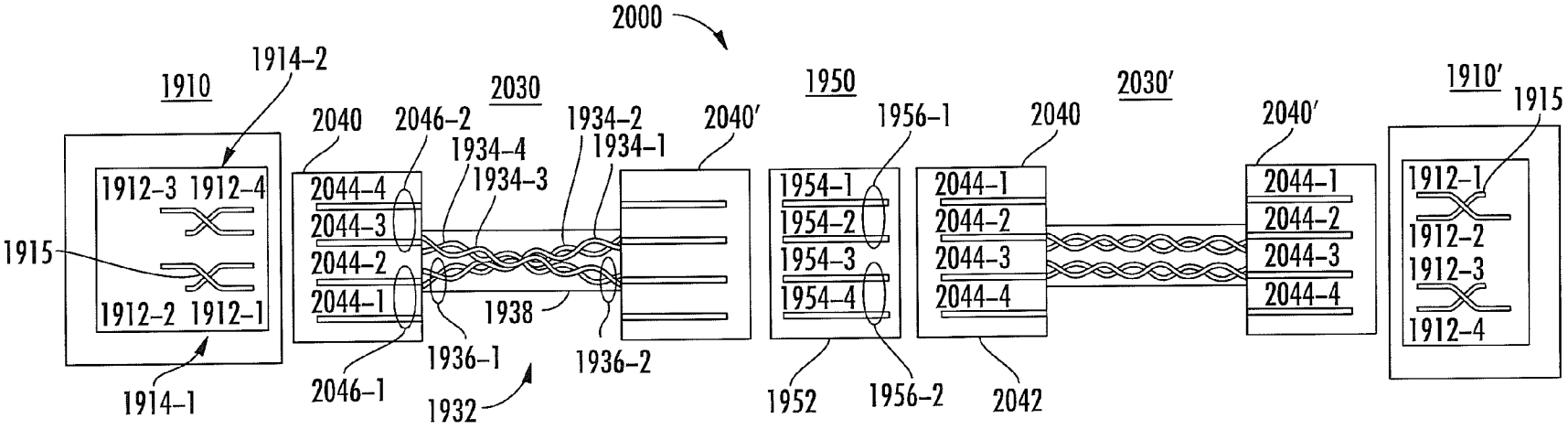
FIGS. 61A and 61B are top and side schematic views of a communications channel according to further embodiments of the present invention.
Figure 61B:
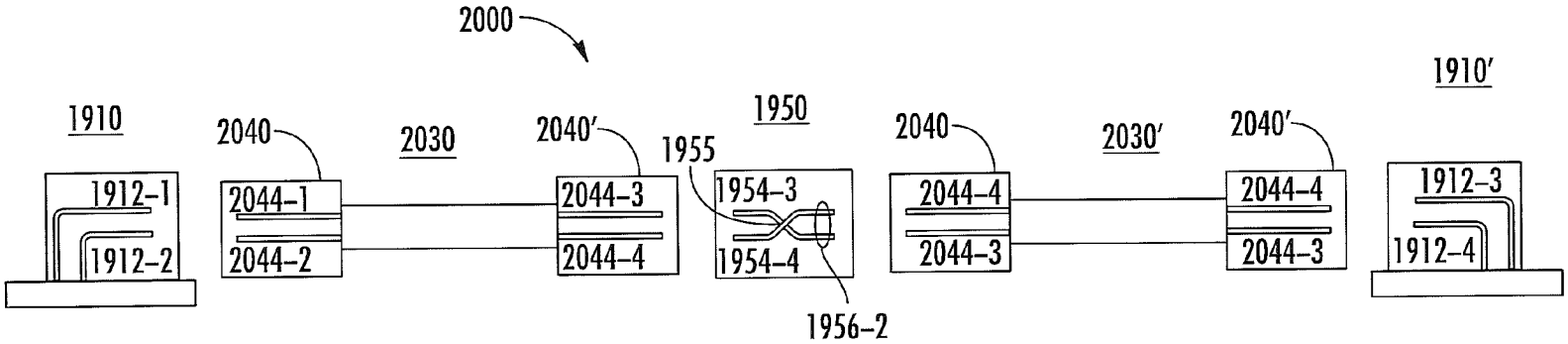

FIGS. 61A and 61B schematically illustrate a communications channel 2000 according to further embodiments of the present invention. In particular, FIG. 61A is a schematic top view of the connectors and cable assemblies that are used to implement the communications channel 2000, while FIG. 61B is a schematic side view of the connectors and cable assemblies that are used to implement the communications channel 2000.

As shown in FIGS. 61A and 61B, the communications channel 2000 includes a first end connector 1910, a first cable assembly 2030, an inline connector 1950, a second cable assembly 2030' and a second end connector 1910'. The end connectors 1910, 1910' and the inline connector 1950 may be identical to the corresponding components, discussed above, that are included in the communications channel 1900 and hence will not be discussed further here. Note that once again each of the pairs of contacts 1914-1, 1914-2 in the end connectors 1910, 1910' includes a crossover 1915 when viewed from above (i.e., in the top view), but does not include a crossover when viewed from the side, while each of the pairs of jack contacts 1956-1, 1956-2 in the inline connector 1950 includes a crossover 1955 when viewed from the side but does not include a crossover when viewed from above.

The first cable assembly 2030 may include a cable portion 1932 that has a first plug 2040 mounted on one end thereof and a second plug 2040' that is mounted on the other end thereof. The cable portion 1932 may be identical to the cable portion of cable assembly 1930, which is discussed above, and hence further discussion thereof will be omitted here. The plugs 2040, 2040' may be identical. Each plug 2040, 2040' may include a plug housing 2042 and a plurality of plug contacts 2044-1 through 2044-4 (arranged as pairs of plug contacts 2046-1, 2046-2) that are electrically connected to the respective insulated conductors 1934-1 through 1934-4 of the cable portion 1932. As shown in FIG. 61A, the plug contacts 2044-1 through 2044-4 differ from the plug contacts 1944-1 through 1944-4 that are included in the plug 1940 in that they do not include any crossover (instead, the plug contacts 2044-1 through 2044-4 are aligned in a row when viewed from above as shown in FIG. 61A). It will be appreciated that a wide variety of different types of contacts may be used to implement the plug contacts 2044-1 through 2044-4.

The second cable assembly 2030' may be identical to the first cable assembly 2030. Accordingly, further description of the cable assembly 2030' and the plugs 2040, 2040' mounted thereon will be omitted.

The communications channel 2000 of FIGS. 61A and 61B may be implemented using two different connector designs (namely an end connector 1910 and an inline connector 1950) and a single cable assembly design. This may advantageously reduce the amount of different parts that are required to implement the channel 2000.

The primary difference between the communications channel 1900 and the communications channel 2000 is that the plug contacts 2044-1 through 2044-4 in the plugs 2040, 2040' do not include crossovers. As a result, at each plug-jack connection point (e.g., the connection between end connector 1910 and plug 2040 of cable assembly 2030 or the connection between plug 2040' of cable assembly 2030 and inline connector 1950) the contacts have a single crossover instead of multiple crossovers.

Pursuant to further embodiments of the present invention, plug and jack contacts are provided that comprise "coplanar crossover contacts." Herein, a pair of contacts are considered to be "coplanar crossover contacts" if the two contacts cross over each other and the four ends of the two contacts lie substantially in the same plane (even though crossover portions of one or both contacts may fall outside of that plane).

Figure 62A:
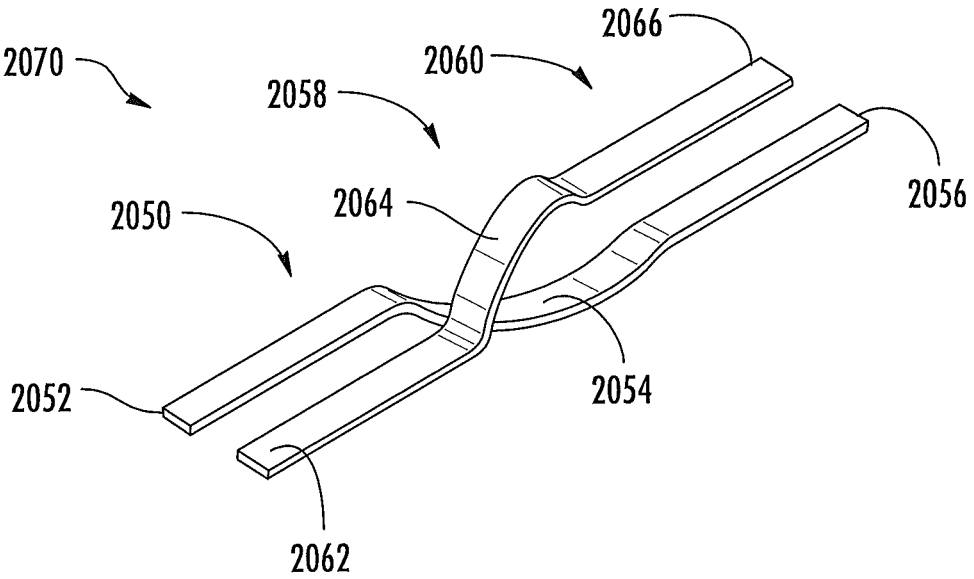
FIGS. 62A and 62B are perspective views illustrating a pair of coplanar crossover contacts according to certain embodiments of the present invention.
Figure 62B:
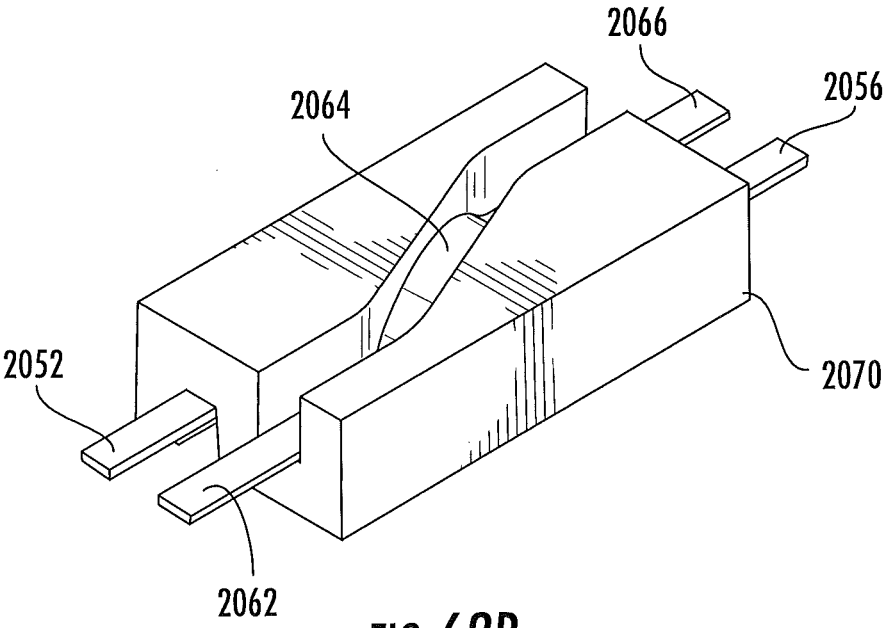

FIGS. 62A and 62B illustrate a pair of coplanar crossover contacts 2050, 2060 according to certain embodiments of the present invention. In particular, FIG. 62A is a schematic perspective view of the coplanar crossover contacts 2050, 2060, while FIG. 62B illustrates how the coplanar crossover contacts 2050, 2060 may be mounted in a dielectric support that ensures that the contacts are not inadvertently electrically shorted together. The coplanar crossover contacts 2050, 2060 comprise a pair of contacts 2070 that may be used to carry a signal information signal such as, for example, a differential signal.

As shown in FIG. 62A, the first contact 2050 includes a first end 2052, a second end 2056 and a central crossover section 2054. The second contact 2060 includes a first end 2062, a second end 2066 and a central crossover section 2064. The first ends 2052, 2062 and the second ends 2056, 2066 of contacts 2050, 2060 reside in substantially the same plane (i.e., they are coplanar). The crossover section 2054 may be implemented as one or more angled and/or curved segments that connect the first end 2052 of contact 2050 to the second end 2056. In the depicted embodiments, the crossover section 2054 is implemented as a gentle curve that extends above the plane defined by the first and second ends 2052, 2062, 2056, 2066. The crossover section 2064 may likewise be implemented as one or more angled and/or curved segments that connect the first end 2062 of contact 2060 to the second end 2066. The crossover section 2064 is implemented as a gentle curve that extends below the plane defined by the first and second ends 2052, 2062, 2056, 2066. As the crossover sections 2054, 2064 extend on opposite sides of the plane defined by the first and second ends 2052, 2062, 2056, 2066 they create a crossover 2058 such that the second ends 2056, 2066 of the contacts 2050, 2060 trade positions with respect to the first ends 2052, 2062 without electrically shorting the contacts 2050, 2060 together. The first end 2052 of contact 2050 and the second end 2066 of contact 2060 may be collinear. Likewise, the second end 2056 of contact 2050 and the first end 2062 of contact 2060 may be collinear.

The crossover 2058 that is implemented in the pair of contacts of FIG. 62A may have a reduced footprint as compared to more conventional crossovers such as those illustrated in FIGS. 60A-61B. It will be appreciated that FIG. 62A is a schematic generic illustration of a pair of coplanar crossover contacts, and does not purport to specify the specific design of the end portions of the contacts 2050, 2060. For example, in some embodiments, the first ends 2052, 2062 of contacts 2050, 2060 could include crimp tabs that may be used to electrically and mechanically connect each contact to a respective insulated conductor of a communications cable. In other embodiments, the first ends 2052, 2062 of contacts 2050, 2060 could instead be formed to have insulation piercing or insulation displacement contacts (IDCs). Other structures could alternatively and/or additionally be included on the first ends 2052, 2062 for connecting those ends (either directly or indirectly) to the respective insulated conductors of a cable. Similarly, in some embodiments, the second ends 2056, 2066 of contacts 2050, 2060 could be rolled to form a pin or implemented as a solid round pin for use with a socket connector, or implemented as an IDC (that would be designed to mate with, for example, another IDC or a blade of a mating connector). In some embodiments, the contacts 2050, 2060 may each be formed from a flat strip of metal that is stamped and/or formed into a desired shape, which may reduce the complexity of the manufacturing and assembly process.

FIG. 62B illustrates how a dielectric block 2070 may be used to ensure that the contacts 2050, 2060 do not become short-circuited while in use.

Figure 63A:
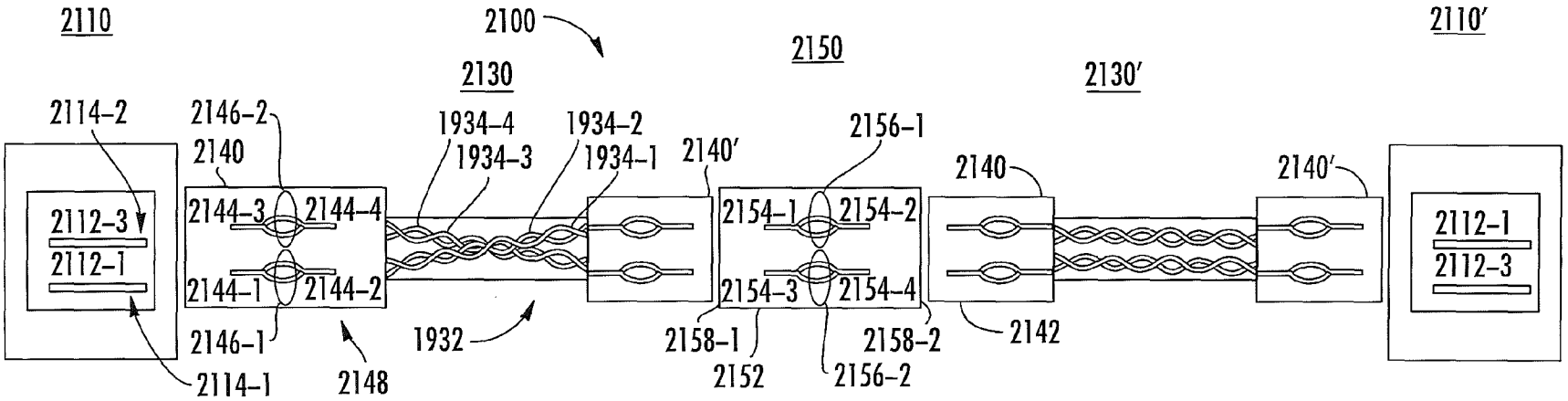
FIGS. 63A and 63B are top and side schematic views of a communications channel according to still further embodiments of the present invention that include pairs of coplanar crossover contacts.
Figure 63B:
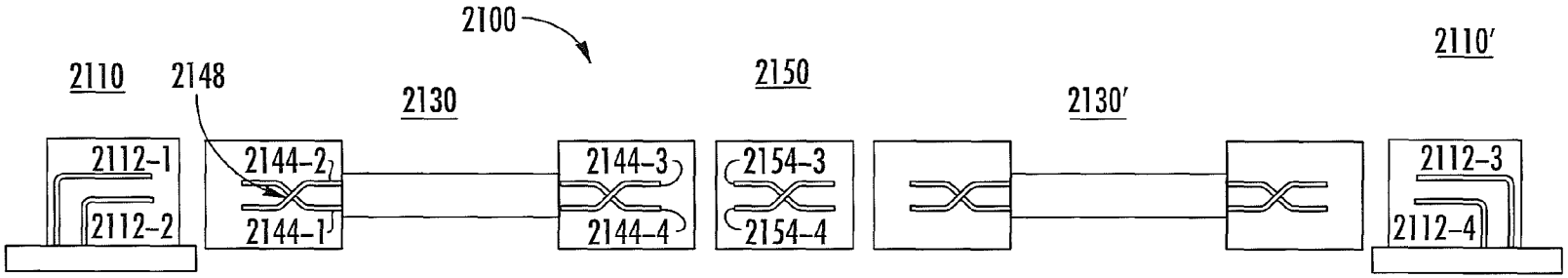

FIGS. 63A and 63B schematically illustrate a communications channel 2100 according to further embodiments of the present invention. In particular, FIG. 63A is a schematic top view of the connectors and cable assemblies that are used to implement the communications channel 2100 and FIG. 63B is a schematic side view of the connectors and cable assemblies that are used to implement the communications channel 2100.

As shown in FIGS. 63A and 63B, the communications channel 2100 includes a first end connector 2110, a first cable assembly 2130, an inline connector 2150, a second cable assembly 2130' and a second end connector 2110'. The end connectors 2110, 2110' may be implemented, for example, as conventional pin connectors. As is apparent from FIGS. 63A and 63B, the pairs of contacts 2114-1, 2114-2 that are included in the end connectors 2110, 2110' do not include crossovers. This may simplify the connector design. The connectors 2110, 2110' may be identical connectors.

The first cable assembly 2130 includes a cable portion 1932 that has a first plug 2140 mounted on one end thereof and a second plug 2140' that is mounted on the other end thereof. The cable portion 1932 may be identical to the cable portion of cable assembly 1930, which is discussed above, and hence further discussion thereof will be omitted here. The plugs 2140, 2140' may be identical. Each plug 2140, 2140' may include a plug housing 2142 and a plurality of plug contacts 2144-1 through 2144-4 (arranged as pairs of plug contacts 2146-1, 2146-2) that are electrically connected to the respective insulated conductors 1934-1 through 1934-4. As shown in FIG. 63A, the pairs of plug contacts 2146-1, 2146-2 differ from the pairs of contacts 1946-1, 1946-2 that are included in the plug 1940 in that they comprise coplanar crossover contacts that include a crossover 2148 as opposed to a more conventional crossover. As shown in FIG. 63B, the crossover 2148 occurs in the side view but is also suggested from the top view.

The second cable assembly 2130' may be identical to the first cable assembly 2130. Accordingly, further description of the cable assembly 2130' will be omitted.

The inline connector 2150 may include a housing 2152 and first and second plug apertures 2158-1, 2158-2. The first plug aperture may receive the plug 2140' of the first cable assembly 2130 and the second plug aperture may receive the plug 2140 of the second cable assembly 2130'. A plurality of jack contacts 2154-1 through 2154-4 are provided that are arranged as two pairs of jack contacts 2156-1, 2156-2. Each pair of contacts 2156-1, 2156-2 comprises a pair of coplanar crossover contacts, which can be seen in the side view of FIG. 63B.

The communications channel 300 of FIGS. 63A and 63B may be implemented using two different connector designs (namely an end connector 2110 and an inline connector 2150) and a single cable assembly design. This may advantageously reduce the amount of different parts that are required to implement the channel 2100.

Figure 64A:
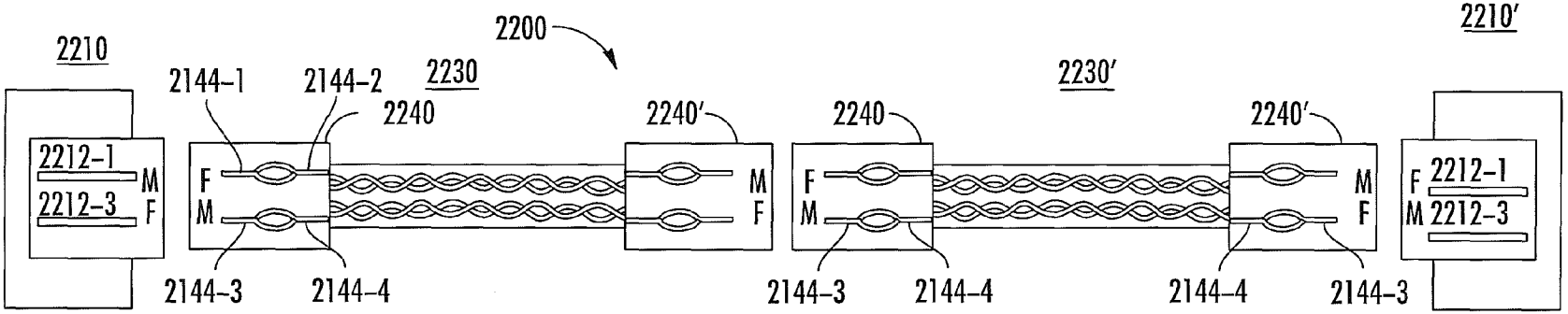
FIGS. 64A and 64B are top and side schematic views of a communications channel according to yet additional embodiments of the present invention that include plugs having both male and female contacts.
Figure 64B:
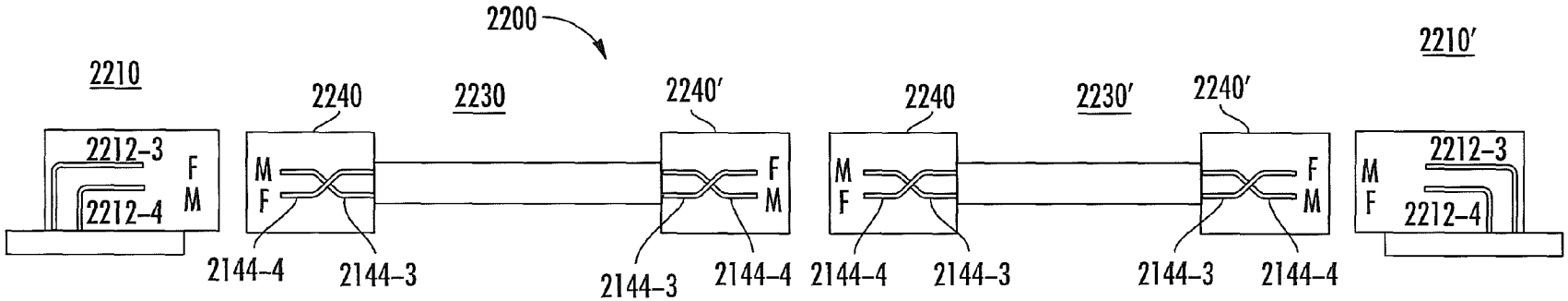

FIGS. 64A and 64B schematically illustrate a communications channel 2200 according to still further embodiments of the present invention. In particular, FIG. 64A is a schematic top view of the connectors and cable assemblies that are used to implement the communications channel 2200 and FIG. 64B is a schematic side view of the connectors and cable assemblies that are used to implement the communications channel 2200.

As shown in FIGS. 64A and 64B, the communications channel 2200 includes a first end connector 2210, a first cable assembly 2230, a second cable assembly 2230' and a second end connector 2210'. The end connector 2210 may be similar to the end connector 2110 that is discussed above. However, in the end connector 2210, half of the pairs of contacts are implemented as male contacts, while the other half are implemented as female contacts. For example, in one embodiment, every other pair of contacts in a row of contacts may be implemented using pin contacts, while the remaining pairs of contacts may be implemented suing socket contacts. Such a design can eliminate the need for any inline connector as it allows plugs from two different cable assemblies to directly mate with each other. While the end connector 2210 includes two pairs of contacts, where the contacts of one pair have male connectors and the contacts of the other pair have female connectors, it will be appreciated that in other embodiments the end connector may have more than two pairs of contacts, and that half of the pairs of contacts will have male contacts while the other half have female contacts. The end connectors 2210, 2210' may be identical to each other except that the positions of the pairs of contacts that are implemented as male contacts and female contacts are reversed.

The first cable assembly 2230 may be similar to the cable assembly 2130 that is discussed above, and may have an identical cable portion 1932. The plugs 2240 and 2240' may also be similar to the plugs 2130, 2130', except that in the plugs 2240, 2240' half of the pairs of contacts are implemented to include male contacts, while the other half include female contacts. Note that the plugs 2240 and 2240' will not be identical, as the positions of the male contact pairs and the female contact pairs will be reversed. This is denoted in FIG. 64A by the references to "M" (for male) and "F" (for female) in the figures. The plugs 2240 and 2240' are designed so that they can be mated together. As noted above, this may eliminate the need for an inline connector, but requires a "directional" cable assembly.

It should be noted that while the end connectors 2210, 2210' do not have pairs of contacts that include crossovers, such crossovers could be included in other embodiments. For example, end connectors that include pairs of coplanar crossover contacts (the crossovers would appear in the side view, just like with the pairs of contacts in the plugs 2240, 2240') could be used instead of the end connectors 2210, 2210'.

Pursuant to still further embodiments of the present invention, ground planes or floating image planes may be provided in one or more of the connectors or cable assemblies of the communications channels according to embodiments of the present invention. For example, FIG. 65, which is a top view of a communications channel, illustrates how the communications channel 2100 of FIGS. 63A and 63B may be modified to include floating image planes to provide a communications channel 2300.

Figure 65:
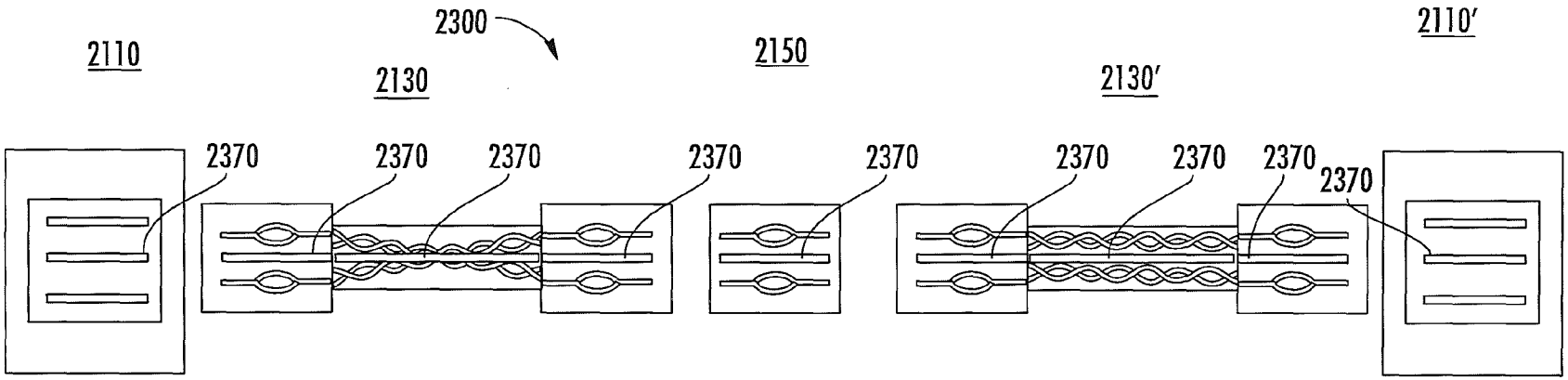
FIG. 65 is a top schematic view of a communications channel according to even further embodiments of the present invention that includes floating image planes in the connectors and cables thereof.

As shown in FIG. 65, the communications channel 2300 may be identical to the communications channel 2100 of FIGS. 63A and 63B, except that the end connectors, the inline connector and the cable assemblies that are used in the communications channel 2300 each include a floating image plane 2370 that is used to provide enhanced isolation between the two adjacent pairs of conductors/contacts. The floating image plane may be implemented in the connectors as, for example, a conductive plate that is disposed between adjacent pairs of contacts (e.g., by plating metal onto a dielectric piece that separates the pairs of contacts). In the cable segments of the cable assemblies, the floating image planes 2370 may be implemented as a metal (or otherwise conductive) tape or separator. Reference numerals have mostly been omitted from FIG. 65 to simplify the drawing, but are provided in corresponding FIG. 63A.

It will be appreciated that the floating image planes 2370 need not be implemented in every connector or cable assembly, but instead may only be implemented in some of the components of the communications channel 2300. It will also be appreciated that the floating image planes 2370 that are included in the communications channel 2300 could also be incorporated into the corresponding elements of the communications channels 1900, 2000 and 2200 that are described above. Moreover, while a floating image plane 2370 is used in the embodiment of FIG. 65, it will be appreciated that in other embodiments a ground plane or ground pins could be used in place of at least some of the floating image planes 2370.

Figure 66A:
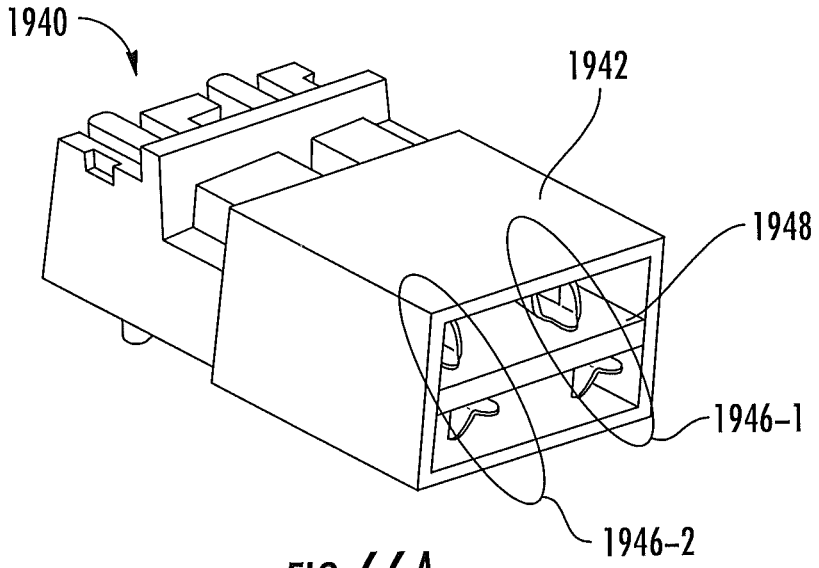
FIGS. 66A and 66B are a perspective view and an exploded perspective view, respectively, of a plug that may be used in the communications channels according to embodiments of the present invention.
Figure 66B:
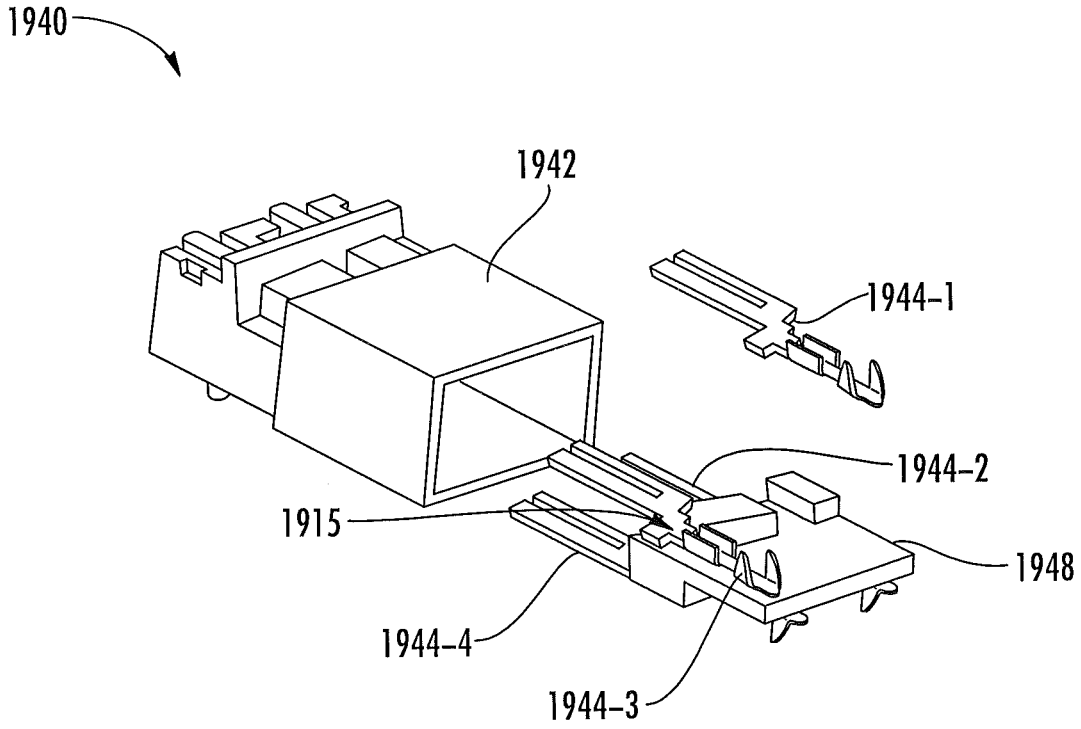

FIGS. 66A and 66B illustrate an example embodiment of the plug 1940 that is depicted in FIGS. 60A and 60B above. In particular, FIG. 66A is a perspective view of the plug 1940 and FIG. 66B is an exploded perspective view of the plug 1940.

As shown in FIGS. 66A and 66B, the plug 1940 includes a plug housing 1942 and plug contacts 1944-1 through 1944-4. Plug contacts 1944-1 and 1944-2 form a first pair of plug contacts 1946-1, and plug contacts 1944-3 and 1944-4 form a second pair of plug contacts 1946-2. Each of the plug contacts 1944-1 through 1944-4 may be electrically connected to the respective insulated conductors 1934-1 through 1934-4 of the cable assembly 1930 (see FIGS. 60A and 60B). A dielectric separator 1948 is provided that holds each of the plug contacts 1944-1 through 1944-4 in its proper position and that electrically isolates the plug contacts 1944-1 through 1944-4 from one another.

Each of the plug contacts 1944-1 through 1944-4 comprises a metal contact that has a first end that is formed in the shape of an IDC and a second end that has a crimp connection for crimping to a bare conductor such as a copper wire. The insulation on the end of each of the insulated conductors 1934-1 through 1934-4 of the cable assembly 1930 may be stripped off, and the bare copper wire inserted between the crimp tabs on the second end of the respective plug contacts 1944-1 through 1944-4. A tool may then be used to force the crimp tabs downwardly onto the respective bare copper wires to mechanically and electrically connect each of the conductors 1934-1 through 1934-4 to its respective plug contact 1944-1 through 1944-4. The IDC end of each plug contact 1944-1 through 1944-4 may be configured to mate with a corresponding blade, IDC or other contact structure of an end connector such as end connector 1910.

As shown in FIG. 66B, each plug contact 1944-1 through 1944-4 includes a lateral jog so that the crimp end of each plug contact is not collinear with the IDC end of the plug contact. As a result, the two contacts that form each pair of contacts 1946-1 and 1946-2 cross over each other at a "crossover" 1915 when viewed from above. The separation between the two contacts of the pair and the distance between adjacent pairs of plug contacts may be adjusted to reduce or minimize crosstalk between adjacent pairs of plug contacts 1946-1, 1946-2.

Figure 67:
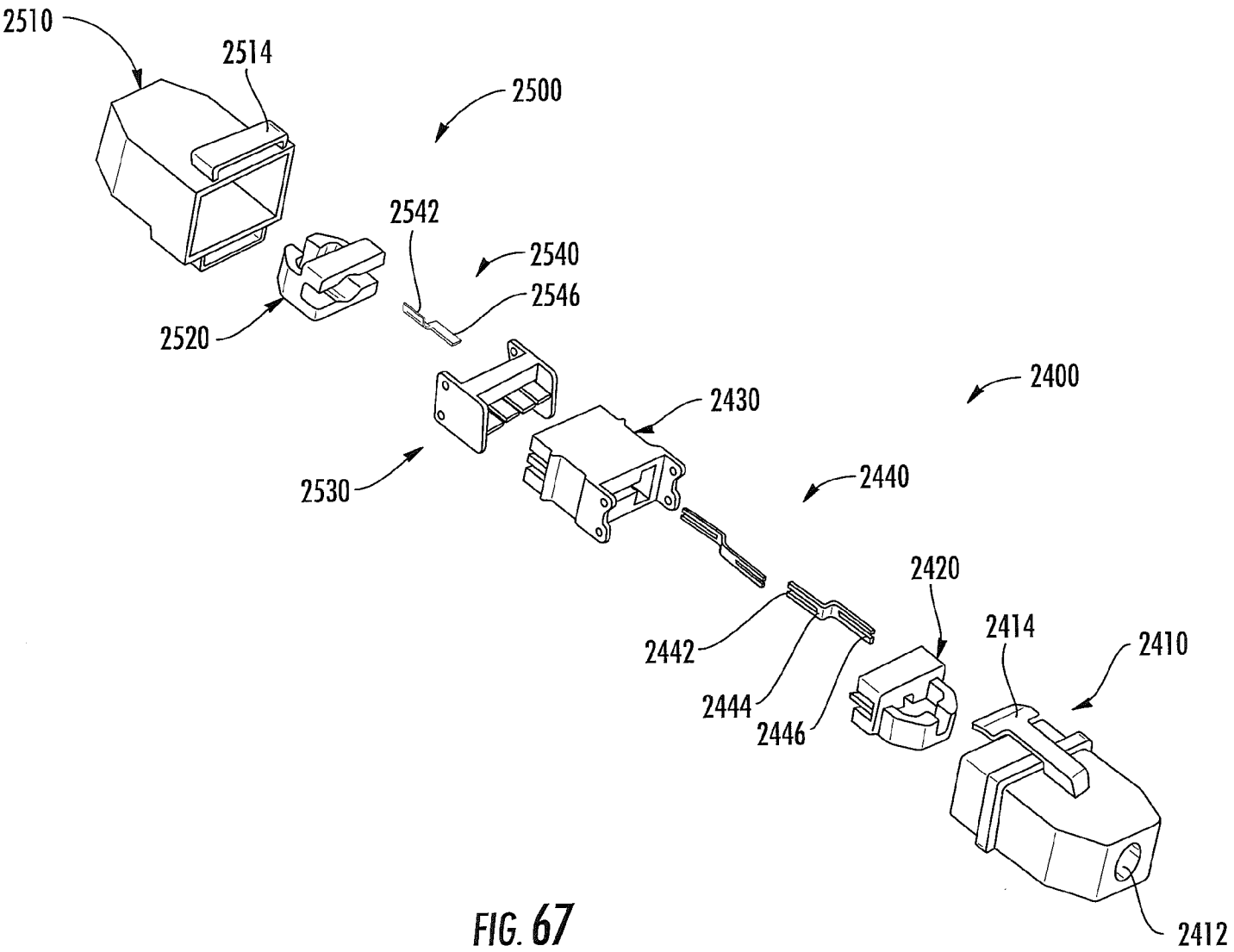
FIG. 67 is an exploded perspective view of two plugs according to further embodiments of the present invention.

FIG. 67 is an exploded perspective view of two plugs according to further embodiments of the present invention. As shown in FIG. 67, a first plug 2400 is provided that includes a plug housing 2410, a strain relief and wire guide insert 2420, a contact holder 2430 and a plurality of plug contacts 2440. The housing 2410 may be a dielectric housing that includes an aperture 2412 that receives a communications cable (not shown). The housing 2410 may also include one or more latches or other attachment/locking mechanisms 2414 that may be used to hold the plug housing 2410 in place in a mated position with a mating connector. The strain relief and wire guide insert 2420 is received within the housing 2410, and may include channels, protrusions or other structures that may be used to route the conductors of the cable that the plug 2400 is used to terminate. The strain relief and wire guide insert 2420 may also include any conventional strain relief mechanism.

The contact holder 2430 is also received within the housing 2410, forward of the strain relief and wire guide insert 2420. The contact holder 2430 may include channels or other structures that are configured to hold the respective plug contacts 2440. In some embodiments, the contact holder 2430 may comprise a connecting block.

The plug contacts 2440 in the depicted embodiment comprise double-ended IDCs. The first end 2442 of each plug contact 2440 is configured to receive a respective conductor of the cable that is terminated by the plug 2400. The second end 2446 of each plug contact 2440 is configured to receive a respective blade of a mating plug. The plug contacts can be arranged as pairs of plug contacts. Only one pair of plug contacts is illustrated in FIG. 67 to simplify the drawing, but it will be appreciated that the plug 2400 can include two or more pairs of plug contacts.

In the depicted embodiment, the pair of plug contacts are implemented as coplanar crossover contacts. In particular, each contact 2440 includes a curved central portion 2444 that crosses over (without touching) the curved central portion of the other contact 2440 of the pair. Thus, the plug contacts 2440 may be used to implement the plugs 2140, 2140' included in the communications channel 2100 of FIGS. 63A and 63B above.

FIG. 67 further illustrates a plug 2500 according to further embodiments of the present invention. As shown in FIG. 67, the plug 2500 includes a plug housing 2510, a strain relief and wire guide insert 2520, a contact holder 2530 and a plurality of plug contacts 2540 (only one plug contact 2540 is illustrated in FIG. 67 to simplify the drawing, but a plurality of these plug contacts 2540 are housed in contact holder 2530). The housing 2510 may be a dielectric housing that includes an aperture (not visible in FIG. 67) that receives a communications cable (not shown). The housing 2510 may also include one or more latches or other attachment/locking mechanisms 2514 that may be used to hold the plug housing 2510 in place in a mated position with a mating connector. The strain relief and wire guide insert 2520 is received within the housing 2510, and may include channels, protrusions or other structures that may be used to route the conductors of the cable that the plug 2500 is used to terminate. The strain relief and wire guide insert 2520 may also include any conventional strain relief mechanism.

The contact holder 2530 is also received within the housing 2510, forward of the strain relief and wire guide insert 2520. The contact holder 2530 may include channels or other structures that are configured to hold the respective plug contacts 2540. In some embodiments, the contact holder 2530 may comprise a connecting block.

The plug contacts 2540 in the depicted embodiment comprise blade contacts that include an IDC. In particular, the first end 2542 of each plug contact is configured to receive a respective conductor of the cable that is terminated by the plug 2500. The second end 2546 of each plug contact 2540 is implemented as a thin blade that may be received within, for example, an IDC contact of a mating connector. The plug contacts 2540 may be arranged as pairs of plug contacts. Only one contact is illustrated in FIG. 67 to simplify the drawing, but it will be appreciated that the plug 2500 will include at least two plug contacts (to form a pair of contacts), and can include two or more pairs of plug contacts. The pair(s) of plug contacts may each be coplanar crossover contacts.

The plugs illustrated in FIG. 67 are similar to the plugs 2240, 2240' that are illustrated in FIGS. 64A and 64B. However, the plugs illustrated in FIG. 67 do not include both male and female contacts. It will be appreciated that a modified plug may be provided that includes a first pair of plug contacts that is formed using two of the plug contacts 2440 from plug 2400 along with a second pair of plug contacts that is formed using two of the plug contacts 2540 of plug 2500 in order to provide an embodiment of the plug 2240 of FIGS. 64A and 64B.

Figure 68A:
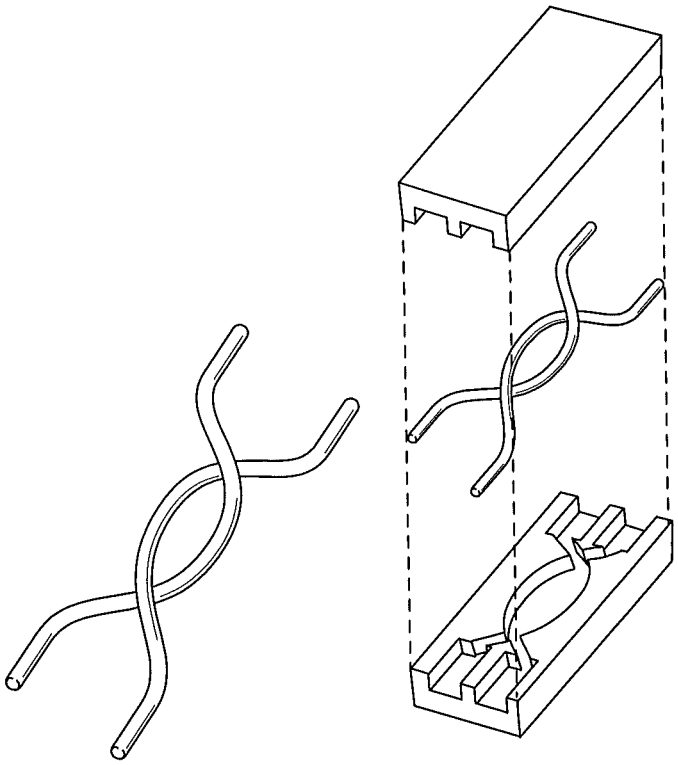
FIG. 68A is a schematic perspective diagram illustrating how a pair of coplanar crossover contacts that include a full twist may be used in connectors according to embodiments of the present invention.
Figure 68B:
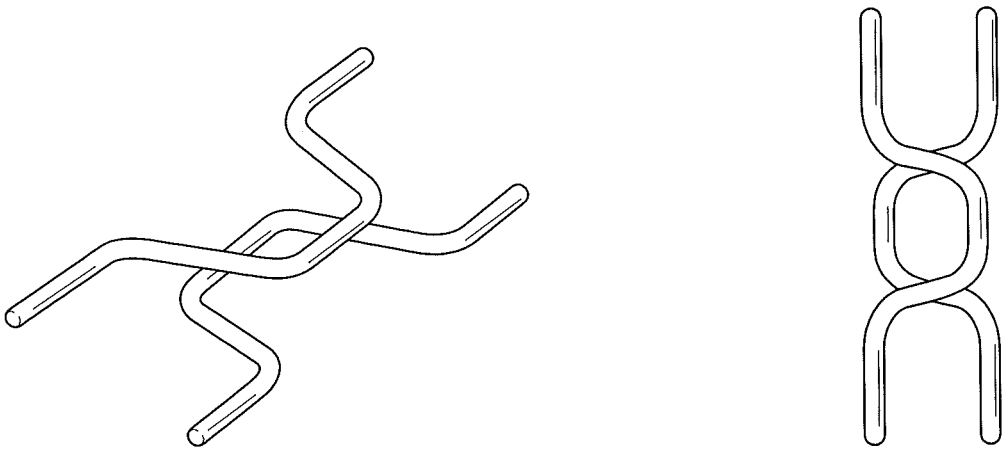
FIG. 68B is a schematic perspective diagram illustrating how a pair of contacts that reside in separate planes may include a full twist.

Pursuant to further embodiments of the present invention, pairs of plug and/or jack contacts may be provided which have more than a single crossover. FIGS. 68A and 68B illustrate example embodiments of such contacts. For instance, as shown in FIG. 68A, in some embodiments the contacts of a pair of contacts may have two crossover points such that the contacts go through a "full twist." In such embodiments, both ends of both contacts may generally reside in a single plane, while the middle portion of each contact may extend outside this plane to effect the crossover. FIG. 68A may be viewed as depicting a coplanar crossover contact arrangement where the crossover is implemented as a full twist. As shown in FIG. 68B, in other embodiments, the pair of plug contacts may reside in separate planes and include a full twist. A full twist may be preferred in some applications as the tip and ring contacts maintain their positions on both sides of the contacts The high-speed connectorized cables that can be used in embodiments of the present invention have various similarities to the cable illustrated in the U.S. Pat. No. 7,999,184 ("the '184 patent"), which is incorporated herein by reference. While the cable illustrated in FIGS. 3, 4, 9 and 10 of the '184 patent includes four twisted pairs of insulated conductors, more or fewer twisted pairs could be used in the connectorized cables described herein. For example, FIG. 69 illustrates a first cable 2600 that includes a single twisted pair 2602 and a second cable 2610 that includes first and second twisted pairs 2612, 2614 that are be divided by a separator 2616.

Figure 69:
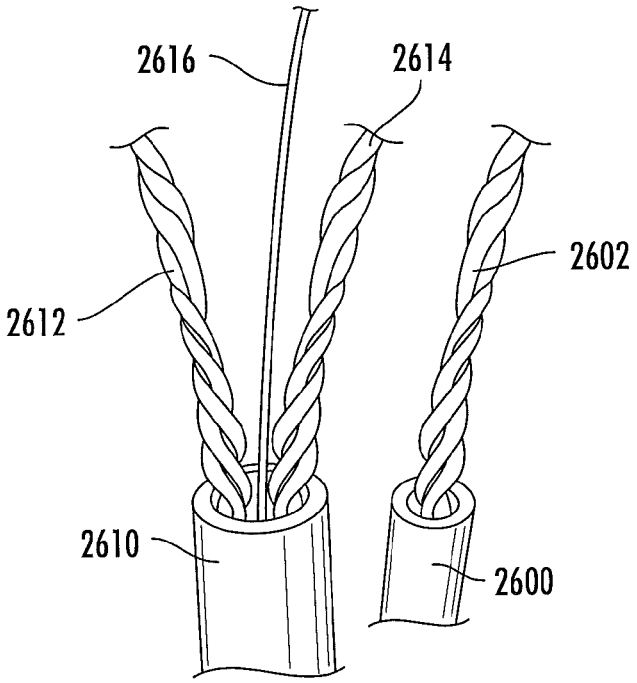
FIG. 69 is a partially cut-away perspective view of a first cable that includes a single twisted pair of insulated conductors and of a second cable that includes two twisted pairs of insulated conductors.
Figure 70:
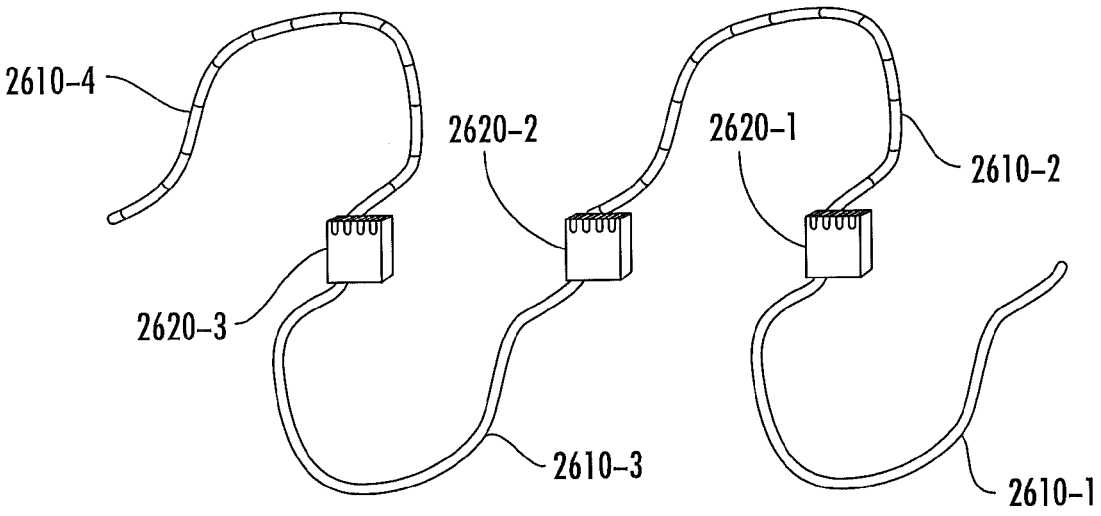
FIG. 70 is schematic block diagram illustrating an example end-to-end communications connection in a vehicle environment.

As noted above, in the vehicle environment, high speed cable such as the cables 2600, 2610 shown in FIG. 69, may need to be terminated and coupled to a further length of high speed cable multiple times within the vehicle. For example, as shown in FIG. 70, a connection hub 2620-1 (e.g., an inline connector) could be located proximate the rear of the vehicle (e.g., behind a rear seat or between a truck compartment and a passenger compartment). A second connection hub 2620-2 could be located in a mid-section of a vehicle (e.g., in a roof liner and/or proximate an overhead entertainment center), and a third connection hub 2620-3 could be located toward a front of the vehicle (e.g., beneath a dash and/or at a firewall of the engine compartment). In the vehicle environment, it is envisioned that the typical length of the cabling system from end to end would be about 15 meters or less for a passenger vehicle (e.g., car, truck or van) and about 40 meters or less for a commercial sized vehicle (e.g., bus, RV, tractor trailer).

The system preferably delivers high speed data, with an acceptably low data error rate, from the first end of the vehicle's cabling system, through the multiple connection hubs 2620 to the second end of the vehicle's cabling system. Although FIG. 70 illustrates three connection hubs 2620, it is envisioned that up to four or five connection hubs 2620 could be present, and as little as one or two connection hubs 2620 could be present.

Figure 71:
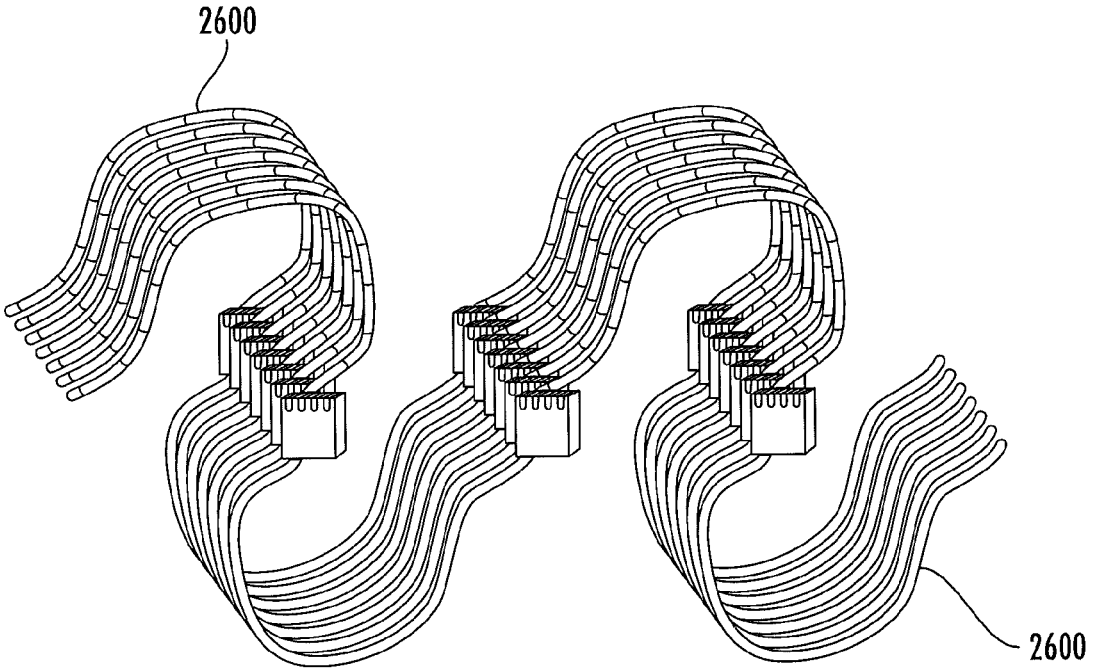
FIG. 71 is schematic block diagram illustrating how a plurality of the end-to-end communications connections of FIG. 70 may be grouped together in the vehicle environment.

As is further shown in FIG. 70, the cable system includes a first cable 2610-1, with a length of about two meters, and that includes two twisted pairs 2612, 2614, which enters connection hub 2620-1 gets connected there to a second cable 2610-2, with a length of about two meters, which also includes two twisted pairs 2612, 2614. The second cable 2610-2 passes to connection hub 2620-2 where it is connected there to a third cable 2610-3, with a length of about two meters, which likewise includes two twisted pairs 2612, 2614. The third cable passes to connection hub 2620-3 where it is connected to a fourth cable 2610-4, with a length of about 2 meters, which also includes two twisted pairs 2612, 2614. In practice, multiple cables would often be routed between the various connection hubs 2620 as shown in FIG. 71, which graphically illustrates seven single-twisted pair cables 2600 being routed together through the vehicle. As shown in FIG. 71, a plurality of connection hubs 2620-1, 2620-2, 2620-3 may be provided at each connection point or, alternatively (as shown in FIG. 72 below), the connection hubs 2620-1, 2620-2, 2620-3 may be replaced with larger connection hubs 2620' that include connection points for multiple cables.

Figure 72:
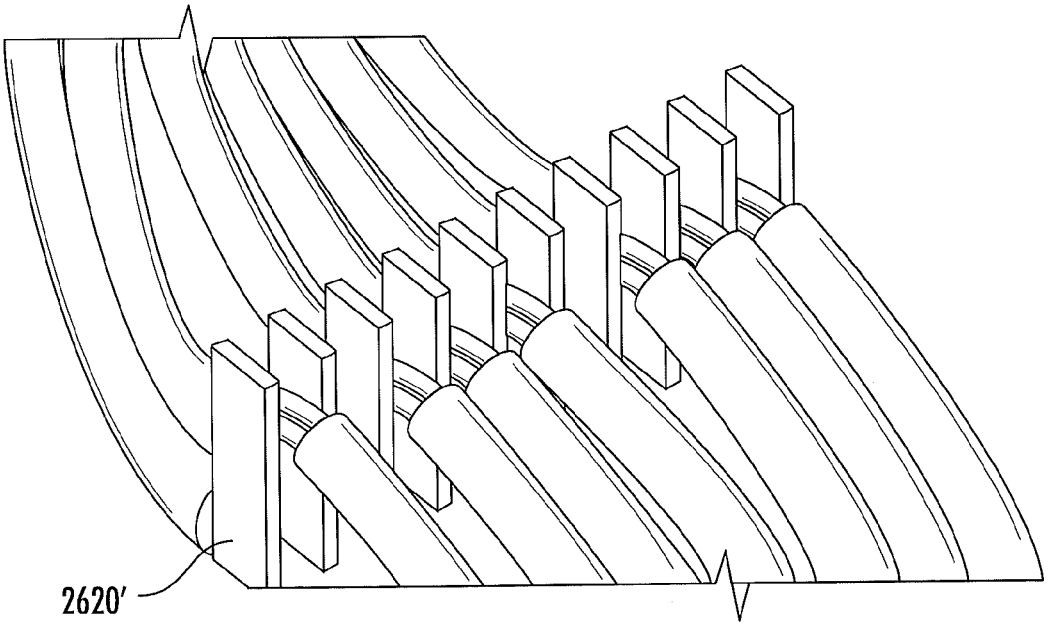
FIG. 72 is perspective view of one of the connection hubs of FIG. 71.

FIG. 72 shows the details of the connection at the middle connection hubs 2620', which may be the same or similar to the connection details at the other connection hubs. In some embodiments, the connection hubs 2620' may be constructed similarly to the terminal blocks described in the U.S. Pat. Nos. 7,223,115; 7,322,847; 7,503,798 and 7,559,789, each of which is herein incorporated by reference. Of course, the terminal blocks of the above-referenced patents can be modified, e.g., shortened if fewer twisted wire pairs are to be employed in the vehicle's cabling system.

As best described in the above-referenced patents, the terminal blocks include insulation displacement contacts (IDCs) that cross over within the plastic housing of the terminal blocks. The cross over points, within the terminal block, help to reduce the introduction of crosstalk to the signals, as the signals traverse through the terminal block.

In the vehicle environment, the external electro-magnetic interference (EMI) is particularly problematic due to the electrical system of the engine, which might include spark plugs, distributors, alternators, rectifiers, etc., which may be prone to producing high levels of EMI. The terminal block performs well to reduce the influence of EMI on the signals passing through the terminal blocks at the connection hubs 2620.

Figure 73:
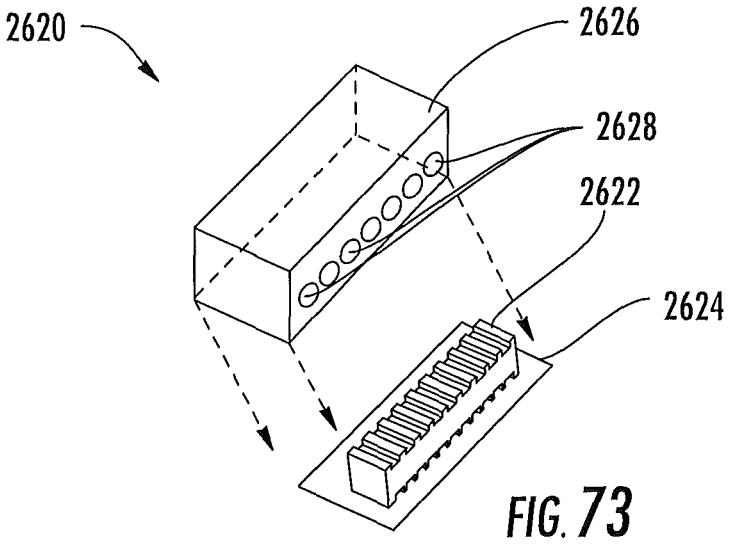
FIG. 73 is schematic exploded perspective view of the connection hub of FIG. 72.

As shown in FIG. 73, in the vehicle embodiment, the connection hubs 2620 could be ruggedized. For example, the terminal block 2622 of the connection hub 2620 could be secured to a plastic base 2624 and a cover 2626 could be placed over the terminal block 2622 and secured/sealed to the base 2624. The cables 2600, 2610 could enter and exit the connection hub 2620 via grommets 2628, such that the terminal block 2622 is substantially sealed from moisture, dust and debris in the vehicle environment. In one embodiment, the cover 2626 could be transparent to allow inspection of the wire connections within the terminal block 2622 without removing the cover 2626.

Figure 74:
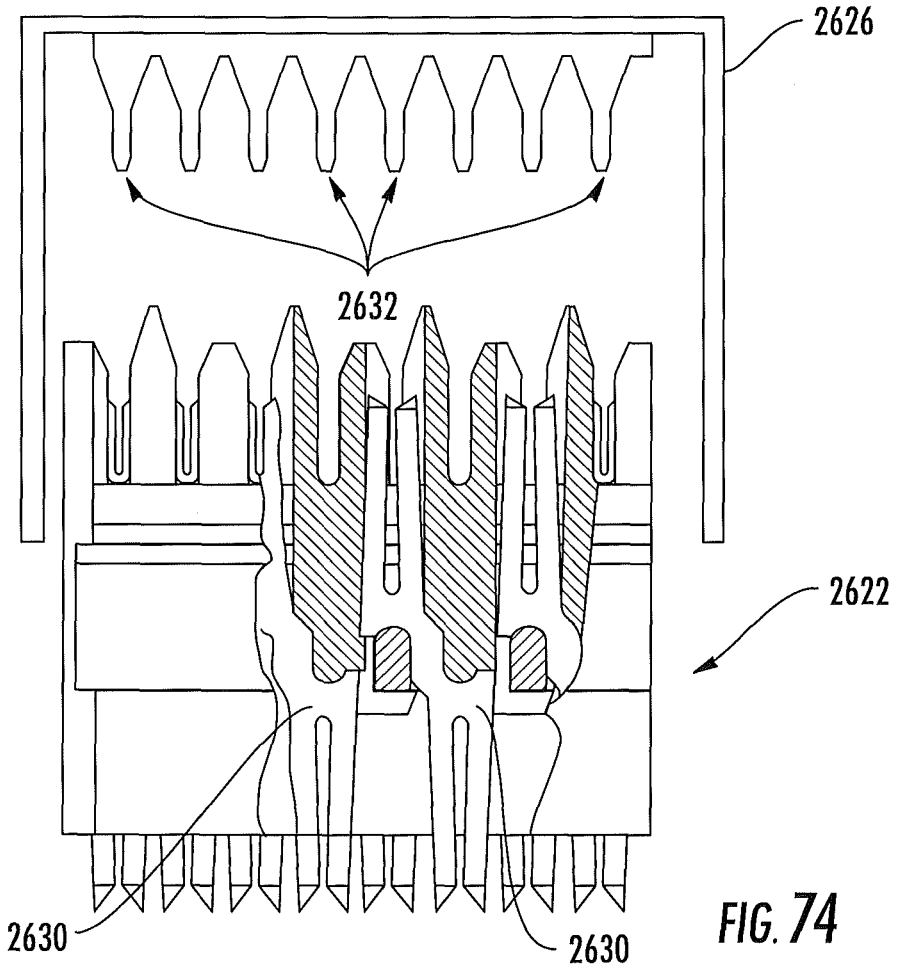
FIG. 74 is a partially cut-away front view of the connection hub of FIG. 73.

FIG. 74 is a partially cut away front view of the connection hub 2620 of FIG. 73. As shown in FIG. 74, stabilizers 2632 may be extend downwardly from the top of the cover 2626. The stabilizers 2632 extend toward the IDCs 2630 of the terminal block 2622, enter into the IDC channels, and may apply pressure to the wires of the twisted pairs of cables 2600, 2610 (not shown in FIG. 74) that are seated in the IDCs 2630. In the vehicle environment, vibration might act to loosen the wires in the IDCs 2630 and allow the wires to work free and break electrical contact with the IDCs 2630. The stabilizers 2632 could engage the wires and hold the wires in good electrical contact within the IDCs 2630, or act as lids or stops to prevent the wires from leaving the IDCs 2630. Thus, the stabilizers 2632 may improve the vibration performance of the connection hub 2620 and make it more rugged for the vehicle environment.

Figure 75:
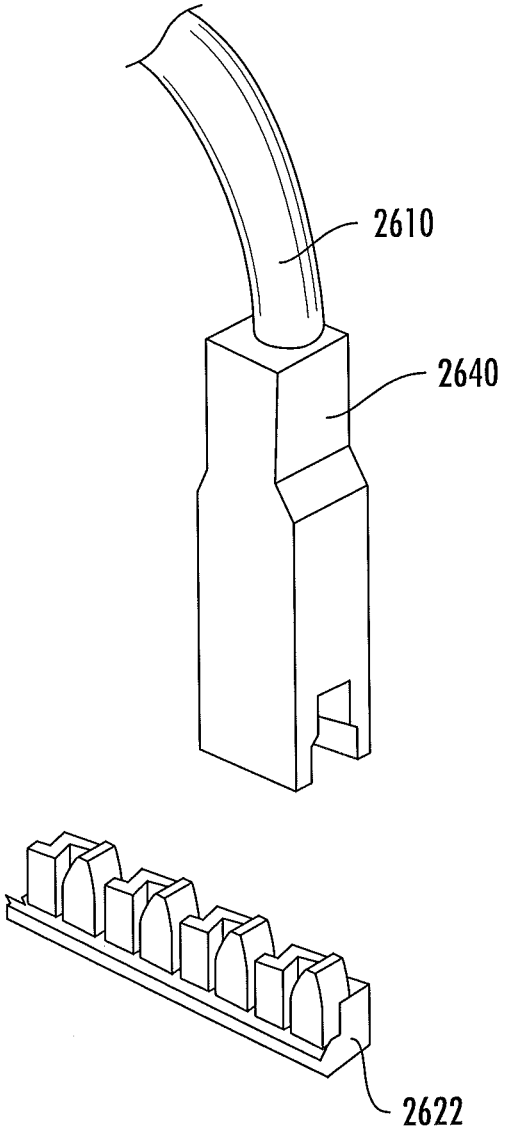
FIG. 75 is schematic perspective view illustrating how the cables that connect to the connection hubs of FIGS. 71-74 may be connectorized.

As shown in FIG. 75, the cable 2610 that supplies the twisted pair wires 2612, 2614 to the IDCs 2630 of the terminal block 2622 may be terminated to a connector 2640. The connector 2640 may be snap locked onto the top of the terminal block 2622, while electrical contacts within the connector 2640 may electrically engage the IDCs 2630 of the terminal block 2622. By this arrangement, the wires of the twisted pair of the cable 2610 are electrically connected to the IDCs 2630 and the IDCs 2630 transmit the signals of the twisted pairs 2612, 2614 to the twisted pairs of a second cable (not shown) that is electrically connected to the bottoms of the IDCs 2630 in accordance with U.S. Pat. Nos. 7,223,115; 7,322,847; 7,503,798 and 7,559,789.

It will also be appreciated that aspects of the above embodiments may be combined in any way to provide numerous additional embodiments. These embodiments will not be described individually for the sake of brevity.

While the present invention has been described above primarily with reference to the accompanying drawings, it will be appreciated that the invention is not limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. It will also be understood that the terms "tip" and "ring" are used to refer to the two conductors of a pair of conductors that may carry a single information signal, and otherwise are not limiting. The pair of conductors may comprise a differential pair in some embodiments.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

Herein, the terms "attached", "connected", "interconnected", "contacting", "mounted" and the like can mean either direct or indirect attachment or contact between elements, unless stated otherwise.

Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An inline communications connector, comprising:

a housing;

a tip contact that is mounted in the housing, the tip contact including a tip input contact structure, a tip output contact structure and a tip connection section that physically and electrically connects the tip input and output contact structures;

a ring contact that is mounted in the housing, the ring contact including a ring input contact structure, a ring output contact structure and a ring connection section that physically and electrically connects the ring input and output contact structures, wherein the tip contact and the ring contact are configured as a pair of contacts for carrying a single differential information signal, wherein the tip input contact structure is not collinear with the tip output contact structure and the ring input contact structure is not collinear with the ring output contact structure, and wherein the tip input and output contact structures and the ring input and output contact structures are each implemented as one of a pin or a socket, wherein the tip input contact structure and the tip output contact structure each extend in a longitudinal direction and are spaced apart from each other along a transverse direction that is perpendicular to the longitudinal direction, and wherein top surfaces of the respective tip input contact structure and the tip output contact structure lie in a first horizontal plane and top surfaces of the respective ring input contact structure and the ring output contact structure lie in a second horizontal plane that is parallel to the first horizontal plane and spaced apart from the first horizontal plane along a vertical direction that is perpendicular to both the longitudinal direction and the transverse direction.

2. The inline communications connector of claim 1, wherein the tip input contact structure, the tip output contact structure, the ring input contact structure and the ring output contact structure each include a respective longitudinal slit.

3. The inline communications connector of claim 1, wherein the tip contact comprises a first tip contact, the tip input contact structure comprises a first tip input contact structure, the tip output contact structure comprises a first tip output contact structure, the tip connection section comprises a first tip connection section, the ring contact comprises a first ring contact, the ring input contact structure comprises a first ring input contact structure, the ring output contact structure comprises a first ring output contact structure, the ring connection section comprises a first ring connection section and the pair of contacts comprises a first pair of contacts for carrying a first information signal, the inline communications connector in combination with:

a second tip contact, the second tip contact including a second tip input tip contact structure, a second tip output contact structure and a second tip connection section that physically and electrically connects the second tip input contact structure and the second tip output contact structure;

a second ring contact, the second ring contact including a second ring input contact structure, a second ring output contact structure and a second ring connection section that physically and electrically connects the second ring input contact structure and the second ring output contact structure, wherein the second tip contact and the second ring contact are configured as a second pair of contacts for carrying a second information signal, and wherein the second tip input contact structure is not collinear with the second tip output contact structure and the second ring input contact structure is not collinear with the second ring output contact structure.

4. The inline communications connector of claim 3, wherein the second tip connection section crosses over the second ring connection section at a second crossover, and wherein the first and second crossovers are positioned at the same distance in the longitudinal direction from an input to the connector.

5. The inline communications connector of claim 3, wherein the first and second tip contacts lie in a first plane and the first and second ring contacts lie in a second plane that is spaced apart from and parallel to the first plane.

6. The inline communications connector of claim 3, wherein a sum of the signal energy coupled between the first tip contact and the second tip contact and the signal energy coupled between the first ring contact and the second ring contact is substantially equal to a sum of the signal energy coupled between the first tip contact and the second ring contact and the signal energy coupled between the second tip contact and the first ring contact when the first information signal is transmitted through the first pair of contacts.

7. The inline communications connector of claim 1, wherein the tip connection section crosses over the ring connection section at a first crossover.

8. The inline communications connector of claim 7, wherein tip input contact structure comprises a tip input socket, the tip output contact structure comprises a tip output socket, the tip connection section physically and electrically connects the tip input and output sockets, the ring input contact structure comprises a ring input socket, the ring output contact structure comprises a ring output socket, and the ring connection section physically and electrically connects the ring input and output sockets.

9. The inline communications connector of claim 7, wherein the tip input contact structure and the ring output contact structure each intercept a first vertical plane that extends in the longitudinal direction, and the ring input contact structure and the tip output contact structure each intercept a second vertical plane that extends in the longitudinal direction, the second vertical plane being parallel to the first vertical plane and spaced apart from the first vertical plane in the transverse direction.

10. The inline communications connector of claim 9, wherein the tip input contact structure comprises a tip input pin, the tip output contact structure comprises a tip output pin, the tip connection section physically and electrically connects the tip input and output pins, the ring input contact structure comprises a ring input pin, the ring output contact structure comprises a ring output pin, the ring connection section physically and electrically connects the ring input and output pins.

11. The inline communications connector of claim 10, wherein the tip contact comprises a first tip contact, the tip input pin comprises a first tip input pin, the tip output pin comprises a first tip output pin, the tip connection section comprises a first tip pin connection section, the ring contact comprises a first ring contact, the ring input pin comprises a first ring input pin, the ring output pin comprises a first ring output pin, the ring connection section comprises a first ring pin connection section and the pair of contacts comprises a first pair of contacts for carrying a first information signal, the inline communications connector in combination with:

a second tip contact, the second tip contact including a second tip input pin, a second tip output pin and a second tip pin connection section that physically and electrically connects the second tip input pin and the second tip output pin;

a second ring contact, the second ring contact including a second ring input pin, a second ring output pin and a second ring pin connection section that physically and electrically connects the second ring input pin and the second ring output pin, wherein the second tip contact and the second ring contact comprise a second pair of contacts for carrying a second information signal, and wherein the second tip input pin is not collinear with the second tip output pin and the second ring input pin is not collinear with the second ring output pin.

12. The inline communications connector of claim 11, wherein the second tip pin connection section crosses over the second ring pin connection section at a second crossover, and wherein the first and second crossovers are positioned at the same distance in the longitudinal direction from an input to the connector.

13. The inline communications connector of claim 11, wherein top surfaces of the first and second tip contacts lie are coplanar with each other and top surfaces of the first and second ring contacts are coplanar with each other and are vertically spaced apart from the top surfaces of the first and second tip contacts.

14. The inline communications connector of claim 11, wherein a sum of the signal energy coupled between the first tip contact and the second tip contact and the signal energy coupled between the first ring contact and the second ring contact is substantially equal to a sum of the signal energy coupled between the first tip contact and the second ring contact and the signal energy coupled between the second tip contact and the first ring contact when the first information signal is transmitted through the first pair of contacts.

15. The inline communications connector of claim 7, wherein tip input contact structure comprises one of a tip input socket or a tip input pin, the tip output contact structure comprises one of a tip output socket or a tip output pin, the tip connection section physically and electrically connects the tip input and output contact structures, the ring input contact structure comprises one of a ring input socket or a ring input pin, the ring output contact structure comprises one of a ring output socket or a ring output pin, and the ring connection section physically and electrically connects the ring input and output contact structures.

16. The inline communications connector of claim 15, wherein the first tip input contact structure is a tip input socket and the first tip output contact structure is a tip output pin.

17. The inline communications connector of claim 15, further comprising:

a second tip contact, the second tip contact including a second tip input contact structure, a second tip output contact structure and a second tip connection section that physically and electrically connects the second tip input and output contact structures;

a second ring contact, the second ring contact including a second ring input contact structure, a second ring output contact structure and a second ring connection section that physically and electrically connects the second ring input and output contact structures, wherein the second tip contact and the second ring contact are configured as a second pair of contacts for carrying a second information signal, and wherein the second tip input contact structure is not collinear with the second tip output contact structure and the second ring input contact structure is not collinear with the second ring output contact structure.

18. The inline communications connector of claim 17, wherein the second tip input contact structure comprises one of a tip input socket or a tip input pin, the second tip output contact structure comprises one of a tip output socket or a tip output pin, the second ring input contact structure comprises one of a ring input socket or a ring input pin, and the second ring output contact structure comprises one of a ring output socket or a ring output pin.

19. The inline communications connector of claim 18, wherein the tip contact is structurally different from the second tip contact, and wherein the ring contact is structurally different from the second ring contact.

20. The inline communications connector of claim 18, wherein the second tip input contact structure is not collinear with the second tip output contact structure and the second ring input contact structure is not collinear with the second ring output contact structure, and wherein the second tip input and output contact structures and the second ring input and output contact structures are each implemented as one of a pin or a socket.

21. An inline communications connector, comprising:

a housing;

a first tip contact that is mounted in the housing, the first tip contact including a first tip input contact structure, a first tip output contact structure and a first tip connection section that physically and electrically connects the first tip input and output contact structures;

a first ring contact that is mounted in the housing, the first ring contact including a first ring input contact structure, a first ring output contact structure and a first ring connection section that physically and electrically connects the first ring input and output contact structures, a second tip contact that is mounted in the housing, the second tip contact including a second tip input contact structure, a second tip output contact structure and a second tip connection section that physically and electrically connects the second tip input and output contact structures; and a second ring contact that is mounted in the housing, the second ring contact including a second ring input contact structure, a second ring output contact structure and a second ring connection section that physically and electrically connects the second ring input and output contact structures, wherein the first tip contact and the first ring contact are configured as a first pair of contacts for carrying a first differential information signal, wherein the second tip contact and the second ring contact are configured as a second pair of contacts for carrying a second differential information signal, wherein the first tip input contact structure is not collinear with the first tip output contact structure and the first ring input contact structure is not collinear with the first ring output contact structure, and wherein the first tip input and output contact structures and the first ring input and output contact structures are each implemented as one of a pin or a socket, and wherein the first tip input contact structure, the first tip output contact structure, the second tip input contact structure, and the second tip output contact structure each reside in a first horizontally-oriented plane, and the first ring input contact structure, the first ring output contact structure, the second ring input contact structure, and the second ring output contact structure each reside in a second horizontally-oriented plane that is parallel to the first horizontally-oriented plane and that is spaced apart from the first horizontally-oriented plane along a vertical direction that is perpendicular to the first and second horizontally-oriented planes.

* * * * *